US007090579B2

(12) United States Patent
Tarantino

(10) Patent No.: US 7,090,579 B2
(45) Date of Patent: Aug. 15, 2006

(54) DICE GAME AND GAMING SYSTEM

(75) Inventor: Elia Rocco Tarantino, Las Vegas, NV (US)

(73) Assignee: Colepat, LLC, North Las Vegas, NV (US)

( * ) Notice: Subject to any disclaimer, the term of this patent is extended or adjusted under 35 U.S.C. 154(b) by 0 days.

(21) Appl. No.: 10/143,367

(22) Filed: May 9, 2002

(65) Prior Publication Data

US 2002/0193160 A1 Dec. 19, 2002

Related U.S. Application Data

(63) Continuation-in-part of application No. 10/004,102, filed on Oct. 23, 2001, now Pat. No. 6,702,671, which is a continuation-in-part of application No. 09/838,949, filed on Apr. 19, 2001, now abandoned, which is a continuation-in-part of application No. 09/684,759, filed on Oct. 6, 2000, now abandoned, which is a continuation-in-part of application No. 09/553,915, filed on Apr. 20, 2000, now Pat. No. 6,605,001, which is a continuation-in-part of application No. 09/439,934, filed on Nov. 12, 1999, now Pat. No. 6,656,047, which is a continuation-in-part of application No. 09/298,604, filed on Apr. 23, 1999, now abandoned.

(51) Int. Cl.
*A63F 9/24* (2006.01)

(52) U.S. Cl. ..... 463/20

(58) Field of Classification Search ..... 463/20, 463/22, 19, 25, 13, 16; 273/146
See application file for complete search history.

(56) References Cited

U.S. PATENT DOCUMENTS 1,696,359 A * 12/1928 Nelson ..... 273/143 R
2,035,084 A * 3/1936 May ..... 273/143 R
4,718,672 A 1/1988 Okada
4,834,386 A 5/1989 Rosenthal et al.
5,031,914 A * 7/1991 Rosenthal ..... 463/22
5,413,342 A 5/1995 Kaplan
5,580,053 A 12/1996 Crouch
5,609,524 A 3/1997 Inoue
5,611,535 A 3/1997 Tiberio
5,695,188 A 12/1997 Ishibashi
5,807,172 A 9/1998 Piechowiak
5,823,873 A * 10/1998 Moody ..... 463/13
5,976,016 A * 11/1999 Moody et al. ..... 463/13
6,159,098 A * 12/2000 Slomiany et al. ..... 463/25

(Continued)

OTHER PUBLICATIONS

Marshall Fey, "Slot Machines, A Pictorial History of the First 100 Years", 1983, Liberty Delle Books, pp. 74-75.

*Primary Examiner*—Corbett B. Coburn
(74) *Attorney, Agent, or Firm*—Weide & Miller, Ltd.

(57) ABSTRACT

A variety of methods of playing games using dice or other indicia and apparatus for implementing the games are disclosed. In one embodiment, the game involves the step of accepting a wager, displaying indicia such as images of the sides of dice and determining if identical indicia are connected. Winning combinations of indicia comprise two or more indicia located in adjoining or connecting relationship within the matrix. In one embodiment, a player's bet determines how many indicia are displayed in the matrix. In one embodiment a bonus or separate game comprises using the existing displayed indicia or displaying a new set of indicia and determining the maximum number of identical indicia. If the maximum number exceeds a predetermined number, the outcome is a winning outcome.

6 Claims, 18 Drawing Sheets

U.S. PATENT DOCUMENTS 6,173,955 B1 * 1/2001 Perrie et al. ..... 273/146
6,213,876 B1 * 4/2001 Moore, Jr. ..... 463/22
6,220,959 B1 4/2001 Holmes, Jr. et al.
6,241,607 B1 6/2001 Payne
6,277,025 B1 8/2001 Margolin
6,296,569 B1 10/2001 Congello, Jr.
6,322,445 B1 * 11/2001 Miller ..... 463/13
6,443,837 B1 * 9/2002 Jaffe et al. ..... 463/16
6,471,208 B1 * 10/2002 Yoseloff et al. ..... 273/143 R

* cited by examiner

DICE GAME AND GAMING SYSTEM

CROSS REFERENCE TO RELATED APPLICATIONS

This application is a continuation-in-part of U.S. application Ser. No. 10/004,102 filed on Oct. 23, 2001 now U.S. Pat. No. 6,702 671, which is a continuation-in-part of U.S. application Ser. No. 09/838,949 filed Apr. 19, 2001 now abandoned, which is a continuation-in-part of U.S. application Ser. No. 09/684,759 filed Oct. 6, 2000 now abandoned, which is a continuation-in-part of U.S. application Ser. No. 09/553,915 filed Apr. 20, 2000 now U.S. Pat. No. 6,605,001, which is a continuation-in-part of U.S. application Ser. No. 09/439,934, filed on Nov. 12, 1999 now U.S. Pat. No. 6,656,047, which is a continuation-in-part of U.S. application Ser. No. 09/298,604 filed on Apr. 23, 1999 now abandoned, each of which is incorporated herein by reference.

FIELD OF THE INVENTION

The present invention relates generally to methods of playing games, gaming devices and systems.

BACKGROUND OF THE INVENTION

Traditional slot machine play typically involves wagering on the spin of a mechanical or video-simulated reel. No decision making is involved, other than the decision to play. No skill is involved where the outcome of such gaming is based upon chance.

The interconnection of multiple gaming machines to facilitate a gaming system with progressive jackpots is in use today. Although such wide area links involve progressive jackpots, they do not take full advantage of the potential created by the interconnection of a plurality of gaming machines. Wide area links of gaming machines typically involve traditional computer-controlled slot machines, which, although popular, do not involve a substantial skill element. Furthermore, traditional slot machines facilitate a limited persistence of play. After any given spin, a player is likely to leave the computer-controlled slot machine, because each spin is a completed cycle rather than part of an ongoing game. A game in which each spin or turn is a part of an ongoing game would be advantageous because such a system would encourage a player to continue playing in order to complete a game in progress.

Additionally, traditional slot machine play is a solitary activity. Players compete only against the house, in an introverted process in which they interact not with each other, but only with the gaming machines. With the advent of wide area links of gaming machines, a tremendous potential exists to facilitate multiple player tournaments, in which players would not only compete for the same progressive jackpots, but actually compete against each other in real time. Such multiple player gaming would be more socially interactive, and would facilitate a fun gaming dynamic.

Also, traditional slot machines are not equipped to permit a player to take a break, and to later resume game play. If a player physically leaves an individual slot machine, that player may never revisit the specific game state which the player left behind. Because players like to take short and long term breaks for a variety of reasons, a method to allow a player to save a game state and later restore the saved game would be advantageous. Players would like to be able to take breaks of any length and later resume a saved game at the same or another physical location.

SUMMARY OF THE INVENTION

The present invention provides apparatus and methods for playing various casino games. The games include the use of a plurality of symbols or indicia, such as dice indicia, in games of skill and/or chance.

In one or more embodiments, the invention comprises a game in which the number of potential winning combinations is reduced over time. As the number of potential winning combinations is reduced, the payout associated with each remaining winning combination increases.

In a number of the embodiments, a set of symbols or indicia are provided. After placing a wager, a number of the symbols from the set are displayed to a player. The player is permitted to hold one or more of the symbols and discard the others. Symbols from the remaining set of symbols are then displayed in replacement of the non-held symbols. The final set of displayed symbols are compared to predetermined winning combinations to determine if the player is a winner. One or more of the symbols are then removed from the set of symbols before the next round of play.

In one embodiment, the combinations comprise combinations achievable using the sides of dice (e.g., all dice showing the same indicia or symbols, the dice showing a full house, straight or the like). In one or more embodiments, the invention comprises a game in which the number of potential winning combinations is reduced as play persists by removing payable indicia based on previous pay by the player. In a number of embodiments, such comprises removing from play face(s) of the dice, by removing the symbols therefrom, replacing them with other symbols or the like.

One game in accordance with the present invention is designated herein by the term Check. In the game of Check, a player spins (rolls) five simulated dice to obtain certain scoring combinations during each turn. Each turn lasts from one to three spins. After the first spin, a player may end the turn or spin again. If a player spins again, the player may re-spin all of the dice, or hold any number of the dice and re-spin the others. After a maximum of three spins in this manner, the turn ends. Once a turn is over, the player must assign the result of the dice to one of a number of categories on a scorecard. If the result of the dice does not fit any of the categories, the player must assign a zero to one of the categories. Over the course of multiple turns, the player attempts to fill out the multiple predefined categories on the scorecard. The game is over when the player has filled all of the predefined categories and the resulting point values are accumulated.

The game of Check involves a substantial skill element. During the course of a game, a player must make various decisions, for example, whether to assign an existing score to a category or to roll again, which dice to roll again and which dice to hold, and to which category to assign a score. The outcome of the game and the amount of a player's winnings or losses are directly dependent upon the decisions the player makes.

Another such game is denoted herein by the term Z Sixty Six. In the game of Z Sixty Six, a player spins (rolls) six simulated dice to obtain three, four, five, and six of a kind. A player must achieve a minimum of three of a kind in order to begin a game.

Each turn of a game lasts from one to three spins. During the first spin of a turn, a player spins all six dice, attempting to achieve a resulting combination in which at least three of the dice are of the same numerical value. After the first spin of a turn, the number displayed by the largest plurality of the dice automatically becomes a target number for the current turn. The dice displaying the target number are automatically held, and if at least three dice displaying the target number have been generated, points are assigned to a score area associated with the target number.

After the first spin, the player re-spins the dice that were not held, attempting to generate more dice displaying the target number. Where more dice displaying the target number are generated, a predetermined number of points is added to the appropriate scoring category, and the additional scoring dice are held. After a maximum of three spins total, the turn ends. Over the course of multiple turns, the player attempts to fill out the multiple predefined, scoring categories. The game is over when the player has filled all of the predefined categories.

Another such game is a game called Z Hot Dice. In accordance with this game, a player is permitted to spin six simulated dice. It is the goal of the player to achieve the maximum number of each of the six symbols one through six via two-spin or roll rounds. After a first spin, the player selects a target number. The target number is a number displayed by one of the dice (or none, as the case may be) which has not already been played. The player holds the dice displaying the target number. The player then spins the non-held dice, resulting in a final combination of six dice. The total number of dice displaying the target number is then determined. If the player receives a sufficiently high number of dice displaying the target number, the player is awarded a winning amount. The player is permitted to continue playing until each target number has been played. After each target number has been displayed, that target number is removed from the simulated dice, reducing the total remaining numbers capable of being displayed.

The total award to the player for each target number is summed and compared against a qualifying score. The qualifying score comprises a score above which the player would be entitled to participate in a jackpot if the jackpot were then awarded.

A variety of options and other forms of play of the game of Z Hot Dice are disclosed.

Another such game is called Z Jackpot Dice. In accordance with this game, a player is permitted to spin five reels each capable of displaying each of the six symbols of a dice, and three other symbols. In one embodiment, the other symbols comprise three letters in the colors red, white and blue, with the letters being B, O, N, U and S.

In similar fashion to the game of Z Hot Dice, the player attempts to receive predetermined combinations of target numbers, the target numbers selected from the dice symbols of one through six. A pay table is provided for each winning combination of the target numbers. In addition, a bonus amount is associated with each target number.

In the course of play, the player spins the reels. If the player obtains a combination of the letters (i.e. non-target symbols), then the player is awarded the bonus amount. If the letters are not of the same color, then the player is awarded the bonus for the bonus associated with the next as yet to be played target number. If the letters are of the same color, then the player is awarded the bonus for all of the target numbers. If the spin results in a combination of the letters only, then the player is permitted to thereafter spin again to play a target number.

After the first spin (or the second spin, if the first resulted in a win based on letters only), then the player is permitted to select a target number and hold the reels displaying the target number. The player is then permitted to spin the non-held reels. Thereafter, it is determined if the player has received a winning combination of the target number. In one embodiment, the player must receive at least 3 of the target number to obtain a winning.

Winnings for each target number and any bonus winnings are added and compared against a qualifying score for determining if the player is presently permitted to participate in a jackpot award. The player is permitted to continue playing until the player has played all of the target numbers. At the conclusion of the game (whether terminated by the player or by completion of all target numbers), the player is provided with a ticket in the event the player's score is sufficiently high to qualify for jackpot participation.

In various of the games, the player inserts coins or utilizes another form of payment/credit to play the game. The player is paid a payout dependent upon receiving predetermined combinations of elements or categories, and the number of rolls needed to achieve the scoring dice combinations. Bonuses may be paid for successfully completing the scorecard.

The games directly facilitate persistence of play. Each spin is part of an ongoing game. A player is encouraged to continue playing to complete turns and games in order to maximize the resulting point values or scores accumulated on the scorecard.

Another game in accordance with the invention is referred to herein as Draw Dice. In accordance with an embodiment of this game, a method of game play comprises the steps of placing a wager, displaying at least two indicia selected from a group of indicia, the group of indicia including at least two indicia representing a side of a dice and the at least two indicia representing a side of the dice having at least one distinguishing attribute, holding none, one or more of the displayed indicia, displaying a replacement indicia from the group of indicia for each displayed indicia which is not held, and determining if the resultant displayed indicia comprises predetermined winning combination of indicia, and if so, paying the player a payout. In one embodiment, the distinguishing attribute comprises a color, such as a color of the dice. In one embodiment, the group of indicia includes each side of a dice in each of three different colors, and whereby said winning combination may include a flush of indicia of the same color.

In one embodiment, there is provided a jackpot or winning for a game in which the jackpot is incremented by the full amount of a wager placed by the player to play the game. In one embodiment, the jackpot is awarded for receiving one particular winning combination of indicia from a group of winning combinations of indicia.

The computer-controlled slot machines may be interlinked onto a local and wide-area network with other computer-controlled slot machines. This facilitates multiple player tournaments in which players compete against each other in real time, in contrast to playing "against the house." The wide area network also facilitates the payment of progressive or other special jackpots. The wide-area link may have progressive jackpots or flat-rate jackpots, and these prizes may be paid daily, weekly, monthly, and/or yearly.

Player participation in the game over time may be enhanced by jackpot participation. A jackpot is preferably awarded at predetermined intervals, such as every week. In one or more embodiments of a game, if the player has obtained a qualifying score, the player is automatically permitted to participate in the jackpot. In a preferred embodiment, the players having the highest scores (such as the twenty highest scores) at the time the jackpot is awarded are permitted to participate. In this arrangement, a player need not win a predetermined combination of symbols or the like to participate in the jackpot. All that is required is that, over the course of game play, the player receive a sufficiently high score as compared to other players. How high of a score is necessary to qualify changes during each jackpot interval.

The present invention also comprises a method by which a player may save and restore games in progress. A player may save a game onto a magnetic card, bar coded voucher, or other machine-readable medium. The player may later resume the saved game by inserting the machine-readable medium into any similar computer-controlled slot machine, either at the same location, or elsewhere on the wide area network. The computer-controlled slot machine is then initialized to the conditions and states determined by the saved game information from the machine-readable medium, and the player may resume the game from where previously terminated.

One or more embodiments of the invention comprise a method of playing a multi-player game and a system for presenting such a game. In one embodiment, the invention comprises a method in which two or more players play a game, the game having the possibility of a different outcome to each player, and the game having a plurality of steps, one or more of which affect the outcome of the game to each player. In one embodiment, the method includes the step of indicating information regarding times by which each of the steps of the game must be completed by each of the players. If a player completes a game step within the required time, then the player is allowed to continue playing the game. If not, the player is not permitted to continue playing the game. Once the steps of the game are completed by one or more of the players within the allotted times, the winner of the game is determined by comparing the outcomes of completed games.

In one or more embodiments, the multi-player game comprises a game of Z Hot Dice or other dice game of the invention. In such an arrangement, each player may be required to place a bet or ante within a time period or by a time certain in order to continue to play the game. If the bet is placed, then each completing player may be required to spin the dice within a given time, and then hold none, one or more of the dice in another time period, and so on. The player attempts to gain the highest score possible from a combination of dice. The outcome of the game is determined by comparing the total scores of the players of the game.

One embodiment of the invention comprises a system for presenting a multi-player game. In one embodiment, the system includes at least two gaming devices for presenting the game to two or more players. Each gaming device is associated with at least one controller which is adapted to provide control information, such as indicated time information regarding when a particular step of the game must be completed.

Another embodiment of the invention comprises a game called Zingo. In one embodiment of this game, at least one set of player symbols or indica are provided. A set of game symbols or indicia are also provided. These symbols may be displayed on a video display. The set of game symbols is compared to the set of player symbols to determine if there are any matching symbols. In one embodiment, three different sets of the game symbols are provided, and each set of game symbols is compared to the same set of player symbols. In one embodiment, a match is declared if a symbol from the set of game symbols matches a symbol from the set of player symbols in a corresponding position or order. A score may be awarded or generated in the event of a match. A player attempt to obtain a high score to achieve an award.

In one embodiment, the set of player symbols comprises a plurality of rows or lines of symbols. The game symbols are arranged in a row and are compared to the symbols in a row of the player symbols. This embodiment game is particular suited to play as a multi-player game, where each player is provided with a set of player symbols and then the game symbols are displayed to all players. Each player attempts to match as many symbols as possible. One or more players achieving a high or the highest score may be awarded a reward.

In one embodiment, the symbols which are display comprise the sides of dice. The player symbols comprise a matrix of 36 sides of dice. The game symbols represent the sides of six rolled dice. The player is awarded points or a score comprising the total of the sides of the matched dice symbols. In one embodiment, a player is entitled to bonus points or a bonus score in the event the player matches a predetermined number of symbols during first or first and second rolls of the game dice.

In one or more embodiments, the game symbols may be computer generated, such as with use of a random number generator. In another embodiment, the symbols comprise the sides of dice and physical dice or other elements are rolled or selected. In one embodiment, a mechanical roller is used, in another, a blower device is used.

In one embodiment, player symbols are displayed on a display. In another embodiment, the symbols are printed on a physical card.

In another embodiment, a player selects some or all of the player symbols. The game proceeds with the player attempting to match their selected symbols to game symbols.

Another embodiment of the invention comprises a game called Link. In one embodiment of this game, at least two indicia are displayed in response to the placing of a wager. A player is permitted to continue to display indicia in sequence, in one embodiment the additional indicia displayed in response to the placing of one or more additional wagers. The player attempts to achieve a predetermined combination of indicia, such as a sequence of the same indicia. If the combination of displayed indicia is not a predetermined combination of winning indicia, then the game is ended.

In another embodiment of the game, a matrix of indicia positions is provided. Preferably, the matrix has m rows by n columns where n or m is at least 2. In one embodiment, the size of a wager placed by a player determines the number of indicia displayed, such as the number of rows or columns of indicia displayed. After the indicia are displayed, it is determined if any of the linked indicia, i.e. indicia which are connected or located in adjacent matrix positions, comprise a predetermined winning combination of indicia. In one embodiment, the predetermined winning combination of indicia comprises a predetermined minimum, such as three, of the same indicia which are linked anywhere in the matrix of displayed indicia. In another embodiment, a predetermined winning combination of indicia results if linked indicia span the entire matrix, such as side-to-side, diagonally, or top-to-bottom.

In one embodiment of the invention, indicia are displayed sequentially and a player attempts to receive matching indicia. In one embodiment, a player places a first wager and two indicia are displayed. If they are matching, the player is permitted to place an additional bet and have one or more additional indicia displayed. If the indicia are matching, a player may be paid winnings or may attempt to continue play to receive additional matching indicia. If the indicia do no match, the game ends.

In one embodiment of the invention a game comprises the steps of displaying a set of indicia and determining if a maximum number of identical displayed indicia exceeds a predetermined number. If a number of identical indicia exceeds the predetermined number, the outcome of the game is a winning outcome and a winning is awarded.

In one embodiment, this game is played as a bonus game to the game of Link. The set of indicia which are utilized to play the game of Link are used to play the bonus game. The bonus game comprises determining if there are any identical indicia from the set of indicia, and if so, whether the number of identical indicia exceeds the predetermined number. In a preferred embodiment, the identical indicia do not need to be connected or linked, but may appear anywhere in the set of displayed indicia.

In one embodiment, a bonus winning is paid if the outcome of the bonus game is a winning outcome. This bonus winning is separate from any winning paid based upon a winning outcome of the game of Link. In one embodiment, a player is entitled to play the game of Link regardless of whether the outcome of the game of Link is a winning outcome and without having to place a separate or additional bet or wager.

Further objects, features, and advantages of the present invention over the prior art will become apparent from the detailed description of the drawings which follows, when considered with the attached figures.

DESCRIPTION OF THE DRAWINGS

FIG. 9 is illustrates score categories comprising two distinct display areas, according to one embodiment of the present invention.

DETAILED DESCRIPTION OF THE INVENTION

The invention comprises methods and apparatus for presenting and playing a game. In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention In general, one aspect of the invention comprises a game which presents to a player the opportunity to obtain an increasing payout as play continues. In one or more embodiments, the invention comprises a game in which the number of potential winning combinations is reduced over time. As the number of potential winning combinations is reduced, the payout associated with each remaining combination winning combination increases. In a number of the embodiments, as described below, the combinations comprise combinations achievable using the sides of dice (e.g., all dice showing the same face, the dice showing a full house, straight or the like). In one or more embodiments, the invention comprises a game in which the number of potential winning combinations is reduced as play persists by removing payable indicia based on previous pay by the player. In a number of embodiments described below, such comprises removing from play face(s) of the dice, by removing the symbols therefrom, replacing them with other symbols or the like. One or more embodiments of the invention comprise a game in which one attempts to achieve one or more particular combinations of indicia. Other embodiments of the invention comprise a game in which indicia from a first set of indicia are compared to indicia of a second set of indicia. One or more embodiments of the invention comprise a game in which a player attempts to obtain indicia in a particular sequence or specific indicia linked or connected in one or more arrangements. These and other aspects of the invention will become apparent when considering the detailed description below.

Figure 1:
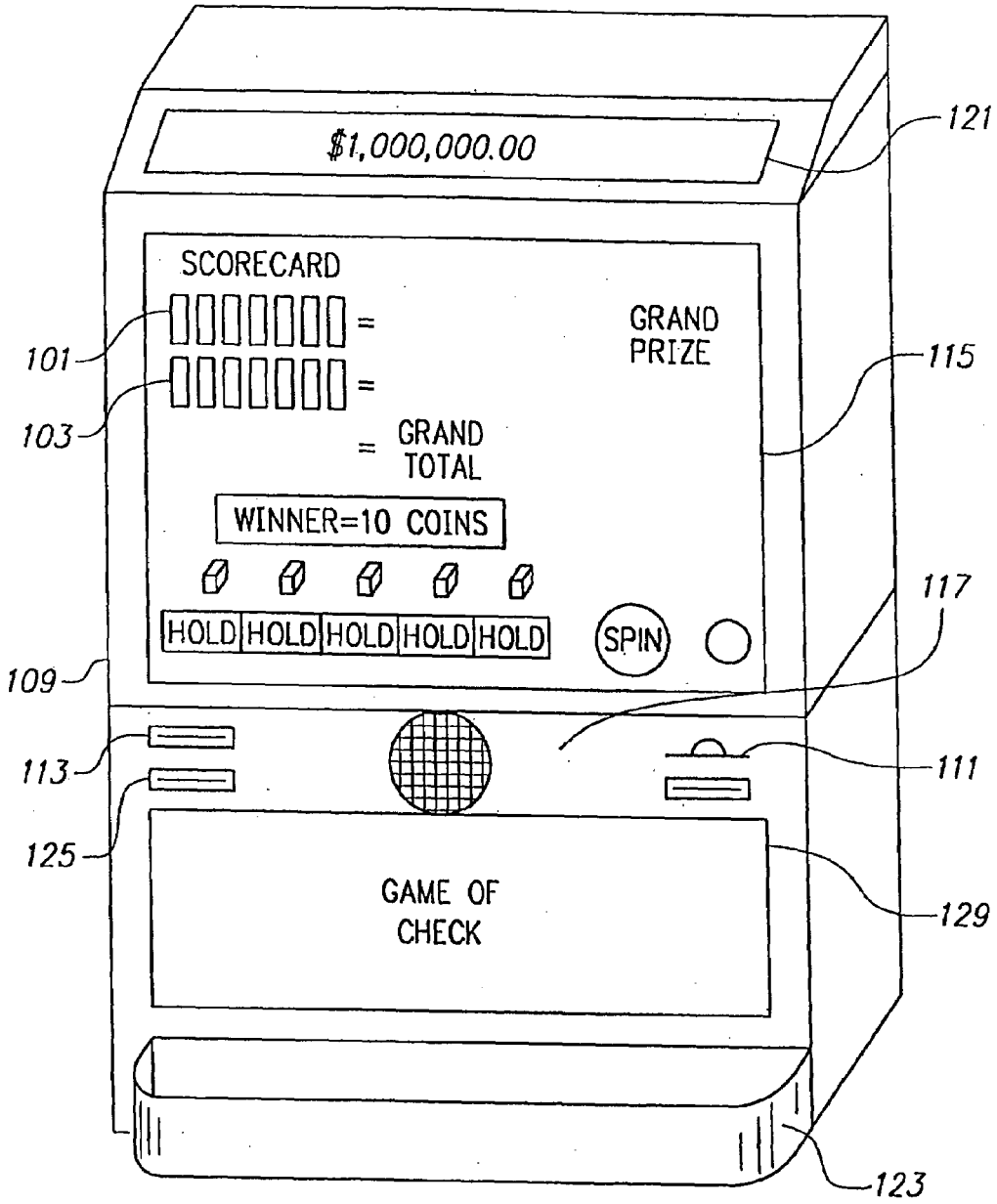
FIG. 1 is a perspective view of a computer-controlled slot machine, in accordance with one embodiment of the gaming system of the present invention.

In a preferred embodiment of the present invention, one or more games are presented for play on a computer-controlled slot machine, for example as shown in FIG. 1. As described below, these games may include the games of Check, Z Sixty Six, Z Hot Dice, Z Jackpot Dice, Draw Dice, Zingo and variations thereof. The computer-controlled slot machine 101 includes a microprocessor-controlled computer 103 within a tamper proof and lockable cabinet 109 having a coin acceptor 111 for wagers and a bill validator 113 for wagers, and preferably including a touch-sensitive display 115 for player input and game display. In addition, the computer-controlled slot machine includes a sound speaker 117 for output of digital sound and voice simulations, a tower light 119 (not shown) to indicate jackpots and other game statistics, and a meter 121 to display progressive jackpot information and other text. The computer 103 controls release of coins to a coin hopper 123 for paying players, and controls a ticket printer 125 for generating vouchers. The computer 103 also controls a machine-readable medium reading and writing device 129 for saving and restoring games in progress.

Figure 2:
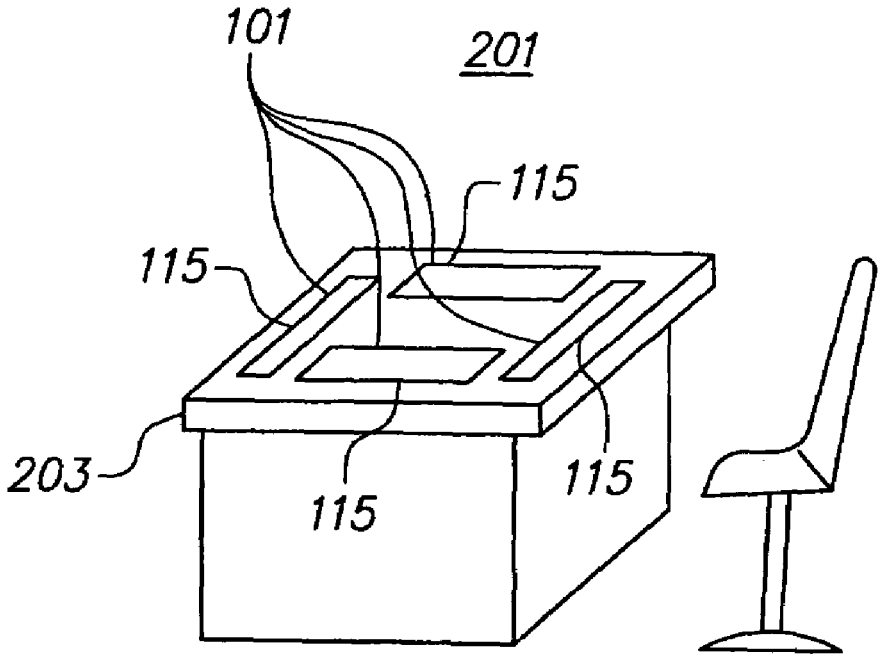
FIG. 2 is a perspective view of four computer-controlled slot machines assembled in a bar table according to another embodiment of the present invention for single or simultaneous multiple user play.

An alternative embodiment of the computer-controlled slot machine is illustrated in FIG. 2. A "bar buddy" version of a computer-controlled slot machine 201 includes all of the features of the computer-controlled slot machine 101. Each "bar buddy" computer-controlled slot machine 201 contains four such computer-controlled slot machines 101, assembled within a bar table 203. Each of the four touch-sensitive displays 115 for player input and game display are mounted in the surface of the bar table 203. The bar buddy computer-controlled slot machine 201 enables from one to four players to play games of the invention simultaneously, either against each other or against the house. The various modes of game play are detailed below.

Figure 3:
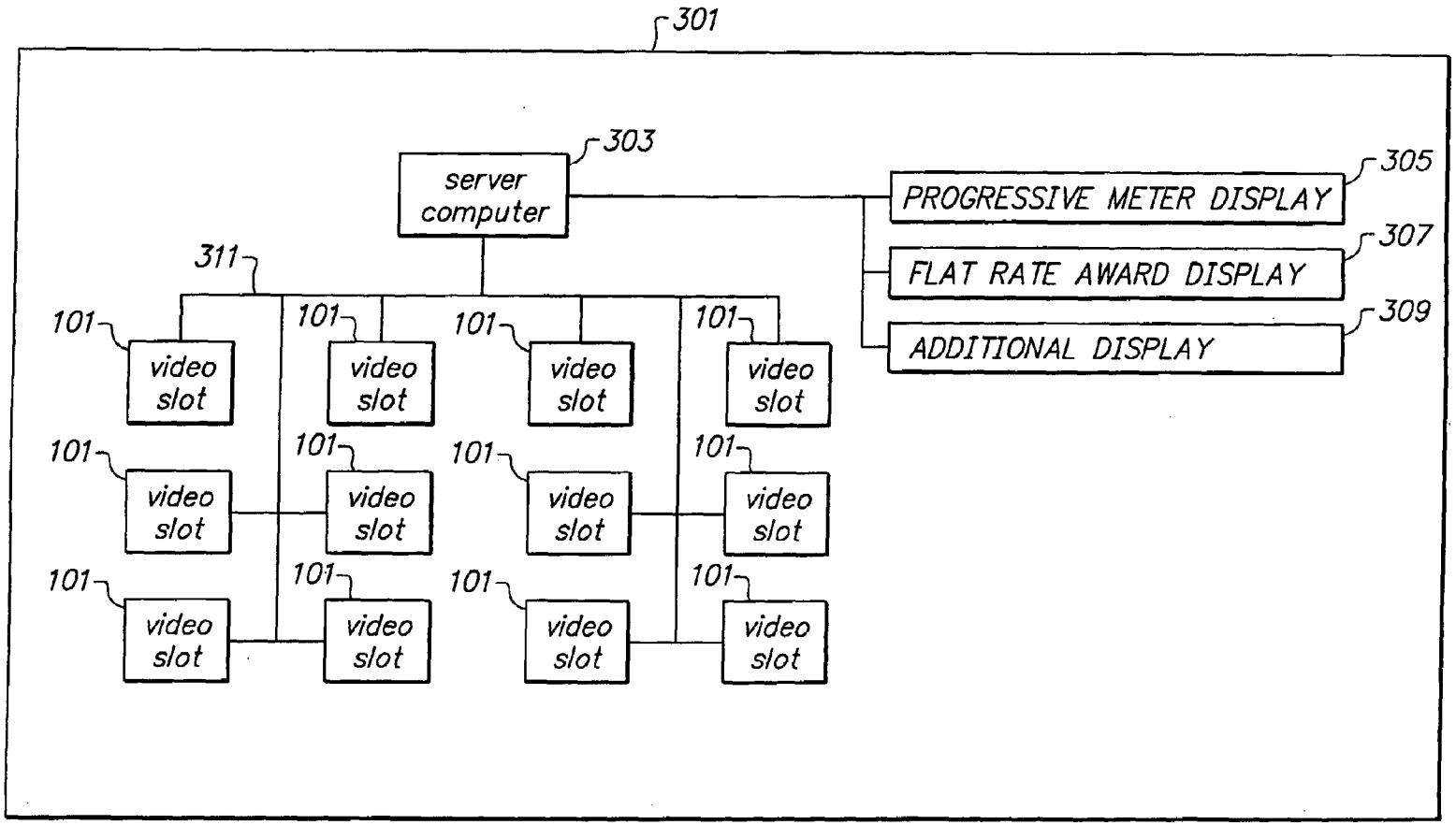
FIG. 3 is a block diagram of a local area network of computer-controlled slot machines, according to the present invention for progressive gaming activity.

Each computer-controlled slot machine 101 is preferably connected to a local area computer network as illustrated in FIG. 3. The local area computer network 301 is controlled by a microprocessor-controlled server computer 303 which controls game play, records game statistics, accounts for vouchers and jackpots, and links the games together. The local area computer network 301 also preferably includes a progressive meter display 305 for showing progressive jackpot information, a flat rate award display 307 for showing flat rate jackpot information, and an additional display 309 for showing the scores that presently qualify for jackpots on the local area network 301. In the preferred embodiment of the present invention, all of the computer-controlled slot machines 101 are connected to the local area computer network 301 in conventional manner via private dedicated lines 311. In an alternative embodiment, some or all of the computer-controlled slot machines 101 positioned at remote locations are connected to the local area computer network 301 via modems and public telephone lines operated in secure mode through encryption/decryption techniques.

Figure 4:
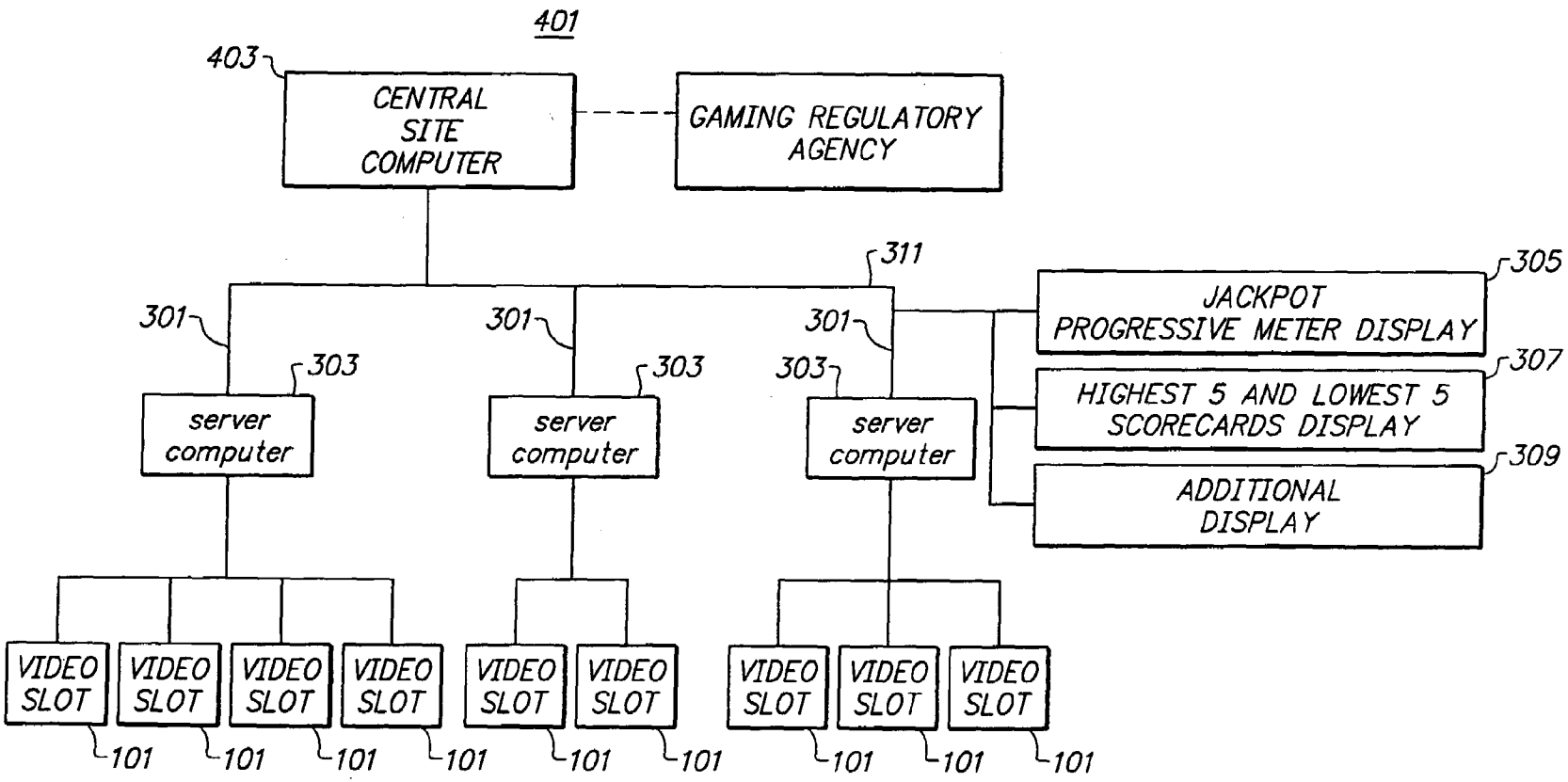
FIG. 4 is a block diagram of a wide area network of computer-controlled slot machines, according to the present invention for progressive gaming activity.

Each local area network 301 of computer-controlled slot machines 101 maybe connected to a wide area computer network as illustrated in FIG. 4. The wide area computer network 401 includes local area computer networks 301 at various physical locations. The wide area computer network 401 is controlled by a central-site computer 403 which operates in 24-hour-a-day communication with all local area computer networks 301 on the wide area computer network 401 for security, accounting, and verification of games and jackpots. If a local area computer network 301 is connected to a wide area computer network 401, the progressive meter display 305, the flat rate award display 307, and the additional display 309 of that local area computer network 301 all display jackpot and other information pertaining to the entire wide area network 401. For example, the additional display 309 of a local area computer network 301 which is connected to a wide area computer network 401 shows scores that presently qualify for jackpots on the wide area network 401. In the preferred embodiment of the present invention, each local area computer network 301 is connected to the wide area computer network 401 in conventional secured cryptographic manner via private dedicated lines 311. In an alternative embodiment, some or all of the local area computer networks 301 are connected to the wide area computer network 401 in secured cryptographic manner via modems and public telephone lines.

In one embodiment the games of the invention may be presented on gaming devices which are linked by a satellite communication link. In one arrangement, a first local area computer network is connected to a second local area computer network via a satellite communication link which includes a transmitter/receiver at the location of the first network and a transmitter/receiver at the location of the second network. Data is transmitted from one location to the other via one or more satellites.

This communication network is particularly suited to an arrangement where one local area computer network is located in a first sovereign territory (such as Indian lands) and the second local area computer network is located in a second sovereign territory. In this communication network, the transmission of data can be completed between the first and second sovereign territories without the communication needing to pass through a third or other sovereign territory (ies). This may avoid the necessity of compliance with rules and regulations of the third or additional sovereign territory, simplifying the implementation of the game.

This communication arrangement using satellite links may be applied to games or gaming networks other than that described herein and other than those used to implement the one or more games described herein. For example, in one embodiment, the central site or main computer 403 or other host may be located in one of the sovereign territories, and gaming machines in the other sovereign territory may be linked via the satellite communication link, such as by a transmitter/receiver associated with a server computer 303 in that territory.

In a preferred embodiment of the present invention, the computer-controlled slot machine 101 includes a touch-sensitive display 115 for player input and game display. FIG. 5A illustrates the layout of the touch-sensitive display in accordance with an embodiment of the present invention for playing the game of Check. The touch-sensitive display 115 allows the player to make input selections conveniently, and displays game information in various ways, depending upon game state. The upper left area of the display 115 displays a scorecard 501 which includes thirteen dual purpose score areas 503 pertaining to the thirteen possible scoring categories. These areas are utilized to accept a player's selection of a scoring category after achieving a scoring spin, and also to display the score achieved by a player in that category, as detailed below with respect to game play.

The computer-controlled display scorecard 501 is divided into two portions. The upper portion 505 of the scorecard 501 includes dual purpose score areas 503 of the display for Ones (or Aces) 507, Twos (or Deuces) 509, Threes 511, Fours 513, Fives 515, and Sixes 517. If the player exceeds a pre-determined score threshold on the upper portion 505 of the scorecard 501, the player is awarded a bonus score which is displayed in the bonus score display area 519 of the upper portion 505 of the scorecard 501. The upper portion 505 of the scorecard 501 also includes an upper portion score total display area 520 for displaying the total of all of the scores achieved in the scoring categories of the upper portion 505 of the scorecard 501. A detailed explanation of scoring is provided below with respect to game play.

The lower portion 521 of the display scorecard 501 includes dual purpose score areas 503 for 3-of-a-Kind 523, 4-of-a-Kind 525, Full House 527, a four-dice Straight 529, a five-dice Straight 531, the sum of all five dice (or Chance) 533, and 5-of-a-Kind (or Check) 535. The lower portion 521 of the scorecard 501 also includes a lower portion score total display area 537 for displaying the total of all of the scores achieved in the scoring categories of the lower portion 521 of the scorecard 501.

The display 115 includes a grand total score display area 539 which displays a player's grand total score as the sum of the upper portion score total and the lower portion score total.

The bottom left area of the display 115 includes five simulated dice 541. The bottom left area of the display 115 includes five hold buttons 543 immediately below the simulated dice 541. These hold buttons 543 are touch-sensitive areas, and are for holding a specific simulated dice 541 on a series of spins (rolls) when the player is attempting to obtain a certain combination, as detailed below with respect to game play.

The middle left area of the display 115 includes a text message box 545 for informing players of games states, such as number of spins remaining, winning combinations, game over, and for informing players of the amount of payouts.

The upper right area of the display 115 includes a message area 547 showing the position of the current scorecard 501 in the daily, weekly, monthly, or yearly prize jackpot award among multiple player networks for the prevailing scores. Alternatively, the message area 547 may show the top five scores on a multiple-player network that qualify for a jackpot, as well as the bottom five scores that so qualify, so that the player can see scores required to achieve a jackpot, as detailed below with respect to jackpots.

The bottom right area of the touch-sensitive display 115 includes a number of touch-sensitive areas which facilitate configuration and control of the game of Check. Specifically, a touch-sensitive spin button 549 activates a spin (roll) of the simulated dice 541, a touch-sensitive reset button 551 resets the scorecard 501, and a touch-sensitive start game button 553 starts a game. A touch-sensitive wager button 555 allows a player to select the number of credits to wager, a touch-sensitive game mode selection button 557 allows a player to switch between game modes, and a touch-sensitive save-restore game button 559 allows a player to save or restore a game in progress to or from a card or voucher of machine-readable medium. Of course, the various buttons or control inputs, for example 543, 549, 551, 553, 555 and 557, described herein as touch-sensitive areas on the display, 115 may also be provided as mechanical electrical input devices, as desired.

FIG. 5B illustrates the layout of the touch-sensitive 115 display in accordance with an embodiment of the present invention for playing the game of Z Sixty Six. The touch-sensitive display 115 allows the player to make input selections conveniently, and displays game information in various ways, depending upon game state. The upper left area of the display 115 displays a paytable 561 which indicates predetermined amounts to be paid for achieving specific scoring combinations. The paytable 561 is updated as the game progresses to reflect predetermined amounts to be paid for achieving scoring combinations at different stages of game play.

Below the paytable 561 are six score areas 503 of the display 115. There is a score area for Ones (or Aces) 507, for Twos (or Deuces) 509, for Threes 511, for Fours 513, for Fives 515, and for Sixes 517. Scoring combinations are assigned to appropriate score areas 503. A detailed explanation of scoring is provided below with respect to game play.

The bottom left area of the display 115 includes six simulated dice 541. In the embodiment shown in FIG. 5B, the simulated dice are in the form of a video simulated dice reels. Below the video simulated dice 541 is a touch sensitive spin button 549 that activates a spin (roll) of the simulated dice 541. In the embodiment illustrated in FIG. 5B, the spin button 549 is in the form of one spin bar common to all simulated dice 541 on the display 115.

The upper central area of the display 115 includes a text message box 545 for informing players of games states, such as number of spins remaining, winning combinations, game over, and for informing players of the amount of payouts. The upper right area of the display 115 includes a message area 547 showing the top score on a multiple-player network that qualifies for a jackpot, as well as the bottom score that so qualifies, so that the player can see scores required to achieve a jackpot, as detailed below with respect to jackpots. Alternatively, the message area 547 may show the position of the current score in the daily, weekly, monthly, or yearly prize jackpot award among multiple player networks for the prevailing scores.

In the embodiment illustrated in FIG. 5B, a text message box 545 for informing players of payout amounts, and a text message box 545 for informing players of the number of accumulated credits are located below the message area 547.

The bottom right area of the touch-sensitive display 115 includes a number of touch-sensitive areas which facilitate configuration and control of the game of Z Sixty Six. A touch-sensitive reset button 551 resets the game, and a touch-sensitive start game button 553 starts a game. A touch-sensitive game mode selection button 557 allows a player to switch single and multiple-player game modes. A touch-sensitive save-restore game button 559 allows a player to save or restore a game in progress to or from a card or voucher of machine-readable medium. A touch-sensitive collect button 563 allows a player to collect accumulated winnings. In one embodiment, a touch-sensitive translate button 565 allows a player to select a language to be used for display output. Of course, the various buttons or control inputs, for example 551, 553, 557, and 559 described herein as touch-sensitive areas on the display 115, may also be provided as mechanical electrical input devices, as desired.

Figure 6:
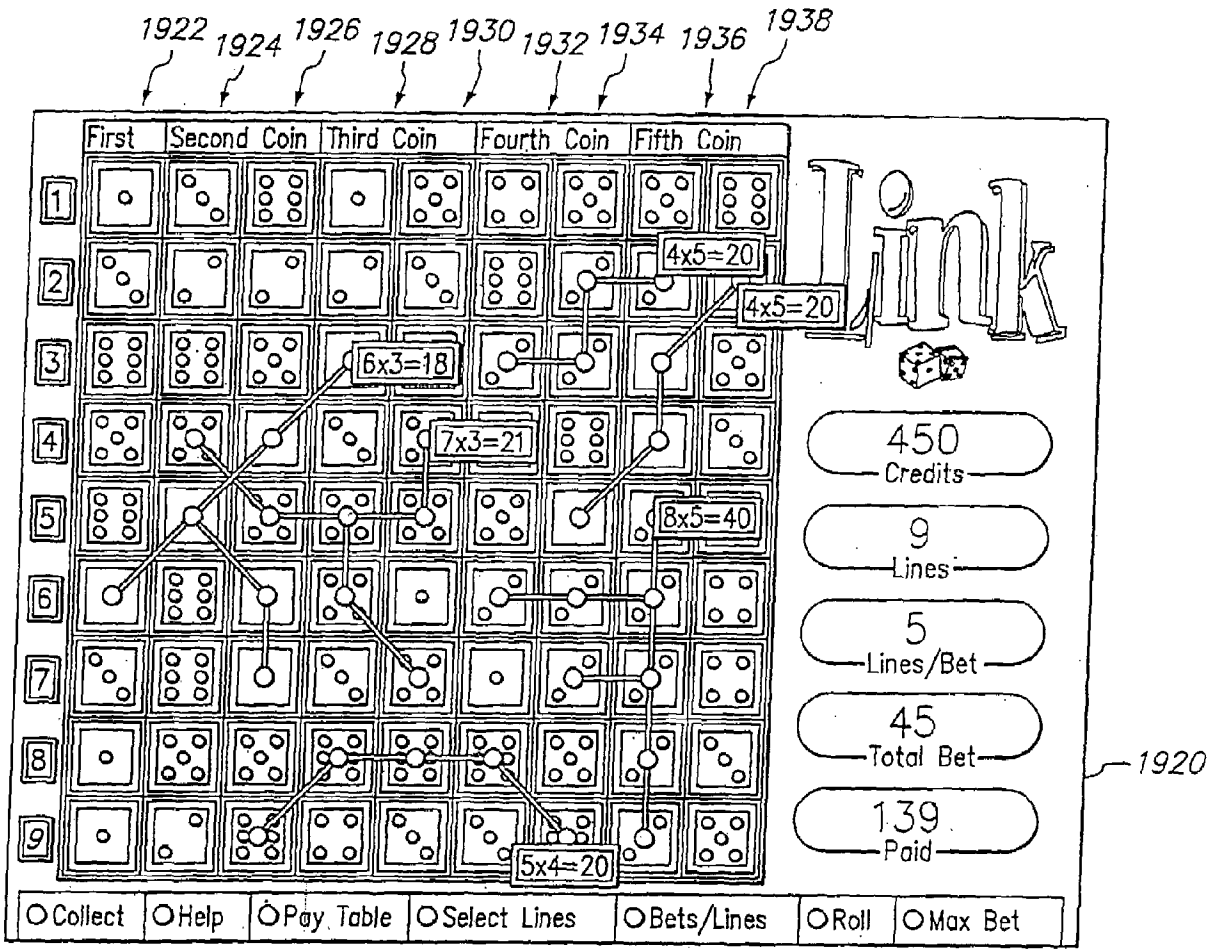
FIG. 6 is a block diagram of the microprocessor-controlled computer and the computer program which facilitate game play according to one embodiment of the present invention.

FIG. 6 illustrates the computer system that facilities game play. In a preferred embodiment of the present invention for playing the game of Check, game play is facilitated by a computer program 601 executing in the microprocessor-controlled computer 103 within the computer-controlled slot machine 101. In the preferred embodiment of the present invention, the computer program is stored on a read-only memory integrated circuit 603 that is operatively coupled to the microprocessor-controlled computer 103 in the computer-controlled slot machine 101. Of course, in alternative embodiments, the computer program may be stored on various other storage media, such as semiconductor memory or optical or magnetic disk, or the like.

The computer program 601 executes from the random access memory 605 of the microprocessor-controlled computer 103 in the computer-controlled slot machine 101, and includes code 607 and data 609 to facilitate the play of the game of Check in accordance with the game rules, as detailed below with respect to game play.

The computer program accepts user input from various user input devices 611 of the types previously described, including coin acceptor 111, bill validator 113, the touch-sensitive display 115, and the machine-readable medium reading and writing device 129. Other input devices including mechanical button type switches and lever-arm switch actuators may be used in alternative embodiments as desired.

The computer program also controls computer operation of the various output devices 613 such as the display 115, the sound speaker 117, a tower light 119, the meter 121, the coin hopper 123, the ticket printer 125, and the machine-readable medium reading and writing device 129.

Preferably, the computer program 601 also controls communication with the microprocessor-controlled server computer 303 which controls the local area computer network 301. The computer program 601 controls this communication via a network port 615 and network connectivity circuitry 617 contained within the microprocessor-controlled computer 103.

The computer program 601 utilizes a random number generator 619 to produce random numbers that represent the results of the simulated rolling of the simulated dice 541. The computer program 601 utilizes animation circuitry 621 to produce the simulation of dice on the display 115.

Figure 7:
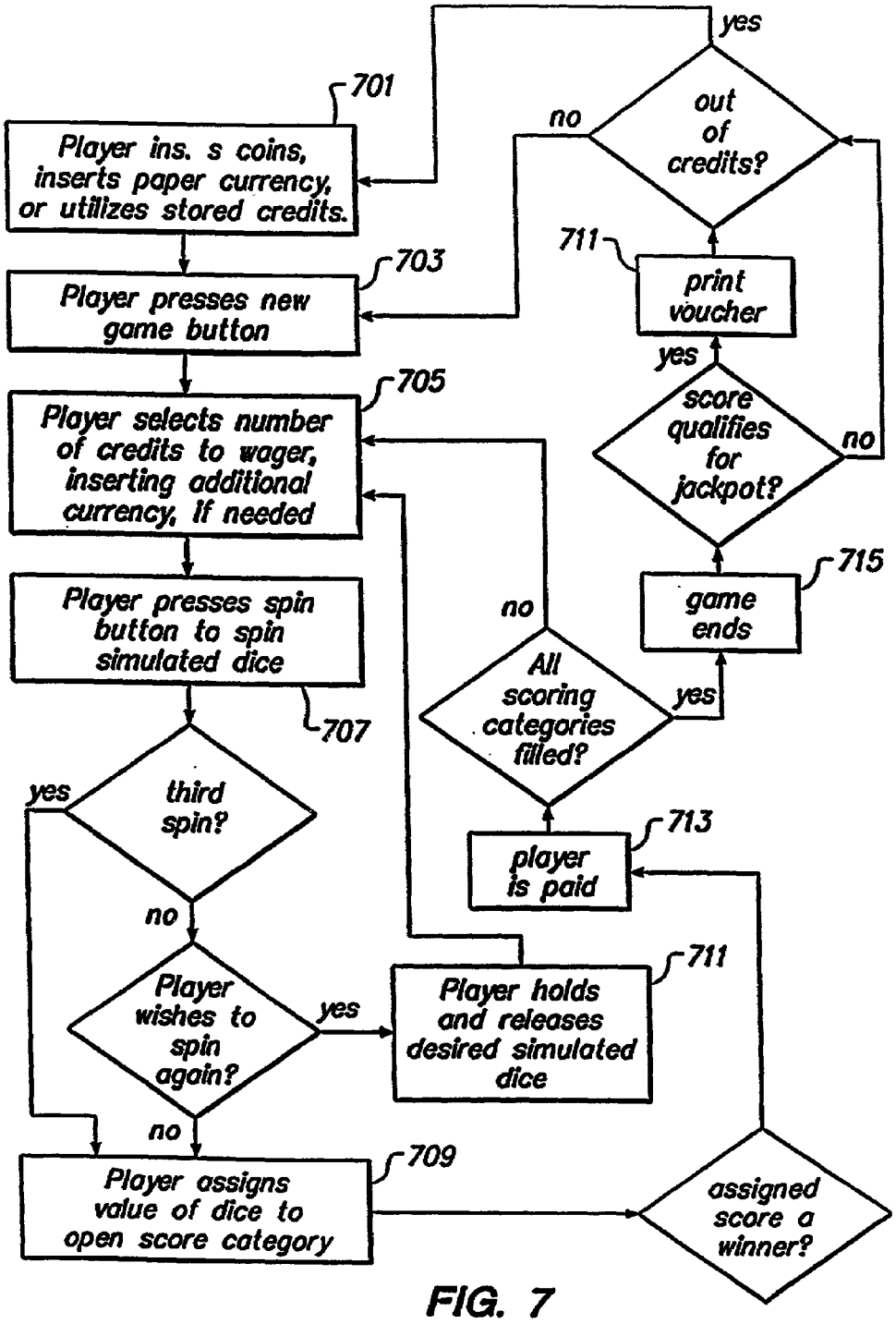
FIG. 7 is a flowchart illustrating the steps of game play according to one embodiment of the present invention.

FIG. 7 is a flowchart, illustrating play of the game of Check according to one embodiment of the present invention. The object of the game is to 'spin' the simulated dice 541 for scoring combinations, and to get the highest total score accumulated within scoring categories of possible dice combinations. A player begins by inserting 701 one or more coins into the coin acceptor 111, by inserting 701 one or more bills into the bill validator 113, or by utilizing credits. The player then presses 703 the touch-sensitive start game button 553 to begin game play. The player then selects 705 the number of credits to wager on the spin of the simulated dice 541 by utilizing the touch-sensitive wager button 555 which controls the selection of the number of credits to be wagered. The player next spins 707 the simulated dice 541 by pressing the touch-sensitive spin button 549. The computer program 601 utilizes the random number generator 619 to produce random numbers that represent the results of the simulated roll of the simulated dice 541.

On each turn, the player may spin 707 the simulated dice 541 up to three times in order to get the highest scoring combination for one of thirteen scoring categories. The thirteen scoring categories are illustrated by the following Table 1:

| | How the Dice Score |
|---|---|
| Upper Portion of Scorecard | |
| One (or Aces) | Total of dice showing One only |
| Twos (or Deuces) | Total of dice showing Two only |
| Threes | Total of dice showing Three only |
| Fours | Total of dice showing Four only |
| Fives | Total of dice showing Five only |
| Sixes | Total of dice showing Six only |
| Bottom Portion of Scorecard | |
| 3-of-a-Kind | Total of all five dice |
| 4-of-a-Kind | Total of all five dice |
| Full House (3 of one number, 2 of another number | 25 |
| Four-Dice Straight | 30 |
| Five-Dice Straight | 40 |
| 5-of-a-Kind (or a Check) | 50 |
| Chance (any five dice) | Total of all five dice |

After each spin the player may assign 709 the value of the simulated dice 541 to one of the possible scoring categories by utilizing the dual purpose score areas 503 of the touch-sensitive display 115. If a player does so, the computer under program control senses the touched areas 503 and totals the value of the simulated dice 541 and calculates and displays the resulting score in the dual purpose score area 503 on the touch-sensitive display 115. The total score of the upper portion 505 of the scorecard 501 is displayed on the upper portion score total display area 520 on the touch-sensitive display 115. If the total score of the upper portion 505 of the scorecard 501 is 63 or higher, for example, then a bonus of 35 points, for example, is added to the upper portion score. This bonus is displayed on the bonus score display area 519 on the display 115. The total score of the lower portion 521 of the scorecard 501 is displayed on the lower portion score total display area 537 on the display 115. The grand total score is calculated by adding the upper portion and the lower portion scores together. The grand total score is displayed on the grand total score display area 539 on the display 115.

Each scoring category can only be scored or selected once during a game. Once a category is used, it cannot be reused until the next game either when the game is over because the scorecard 501 is complete or the player presses the touch-sensitive reset button 551. Pressing the touch-sensitive reset button 551 clears the entire scorecard 501 in preparation for the start of a new game.

Instead, if the player has not yet spun 707 three times during the present turn, the player may elect not to assign 709 the value of the simulated dice 541, but instead to spin 707 again. If the player elects to spin 707 again, the player may hold 711 one or more of the simulated dice 541 by pressing one or more of the associated hold button(s) 543. The player may also release 711 one or more of any held simulated dice 541 by again pressing the associated hold button(s) 543. The player may also elect not to hold or release 711 any of the simulated dice 541. The player then selects 705 the number of credits to wager on the spin of the simulated dice 541 by utilizing the touch-sensitive wager button 555. The player next spins 707 the simulated dice 541 by pressing the touch-sensitive spin button 549.

A turn is over after a player has spun 707 three times, or has assigned 709 the value of the simulated dice 541 to one of the possible scoring categories by utilizing the dual purpose score areas 503 of the touch-sensitive display 115. After a player has spun 707 three times, the player must assign 709 the value of the simulated dice 541 to one of the possible scoring categories by utilizing the dual purpose score areas 503 of the touch-sensitive display 115. If the score cannot be placed into one of the categories because it does not correspond or qualify, then the player must utilize the dual purpose score areas 503 of the touch-sensitive display to assign 709 a zero to one of the remaining categories.

If the player has achieved a scoring combination and assigns 709 it to one of the scoring categories, the player is paid 713 via the coin hopper 123. Alternatively, the player may elect to receive credits. The computer program 601 calculates payment according to a paytable, which is based upon points scored per turn, and the number of spins needed to achieve the points, as shown, for example, in the following Tables 2 and 3:

| CATEGORY | NUMBER OF COINS ×3 Spin 1 | ×2 Spin 2 | ×1 Spin 3 |
|---|---|---|---|
| ONES | TOTAL × 3 | TOTAL × 2 | TOTAL OF 1's |
| TWOS | TOTAL × 3 | TOTAL × 2 | TOTAL OF 2's |
| THREES | TOTAL × 3 | TOTAL × 2 | TOTAL OF 3's |
| FOURS | TOTAL × 3 | TOTAL × 2 | TOTAL OF 4's |
| FIVES | TOTAL × 3 | TOTAL × 2 | TOTAL OF 5's |
| SIXES | TOTAL × 3 | TOTAL × 2 | TOTAL OF 6's |
| 3 of a Kind | TOTAL × 3 | TOTAL × 2 | TOTAL × 1 |
| 4 of a Kind | TOTAL × 3 | TOTAL × 2 | TOTAL × 1 |
| Full House | 75 | 50 | 25 |
| Small Straight | 90 | 60 | 30 |
| Large Straight | 120 | 80 | 40 |
| Chance | TOTAL × 3 | TOTAL × 2 | TOTAL × 1 |
| Check | 150 | 100 | 50 |
| Check Bonus 1 | 300 | 250 | 100 |
| Check Bonus 2 | 300 | 200 | 100 |
| Check Bonus 3 | 300 | 200 | 100 |

| SCORECARD BONUSES | |
|---|---|
| TOP HALF 63+ POINTS | +35 COINS |
| ALL CATEGORIES FILLED | +100 COINS |
| SCORE 250–299 PTS. | +50 COINS |
| SCORE 300–349 PTS. | +100 COINS |
| SCORE 350–399 PTS. | +150 COINS |
| SCORE 400–449 PTS. | +200 COINS |
| SCORE 450–499 PTS. | +250 COINS |
| SCORE 500–549 PTS. | +300 COINS |
| SCORE 550–599 PTS. | +350 COINS |
| SCORE 600–644 PTS. | +400 COINS |
| PERFECT SCORE | +6000 COINS |

If the player assigns 709 a zero score to one of the categories, the player is not paid. Alternative embodiments may employ different paytables, as desired.

The player may then proceed with the next turn and continue filling the scorecard 501. To proceed with the next turn, the player utilizes the touch-sensitive wager button 555 to select 705 the number of credits to be wagered on the spin of the simulated dice. The player next spins 707 the simulated dice 541 by pressing the touch-sensitive spin button 549 and plays a turn, as described above. The game ends 715 when the player has filled all thirteen categories with a score or a zero or is out of credits to play the computer-controlled slot machine 101.

Once the game has ended, the computer program 601 evaluates the player's scorecard 501 against other current scores to determine if a progressive jackpot will be awarded on a daily, weekly, monthly, or yearly basis. If the player has a currently qualifying scorecard 501, the computer-controlled slot machine 101 prints 717 a voucher for the player with a control number and other pertinent information for later redemption, if the scorecard 501 is a winner.

Utilizing a local area computer network 301 and a wide area computer network 401, multiple players may play the game of Check against one another instead of "against the house." Utilizing a local area computer network 301, each participating player deposits money into an individual computer-controlled slot machine 101 for each spin. The player who achieves the highest scorecard 501 of all of the players who are participating in that multiple player game on the local area computer network 301 wins the money deposited by the various participating players (typically, minus a percentage for the house). The same methodology can be utilized across a wide area computer network 401, allowing players at different physical locations to compete against each other in real time.

Figure 8:
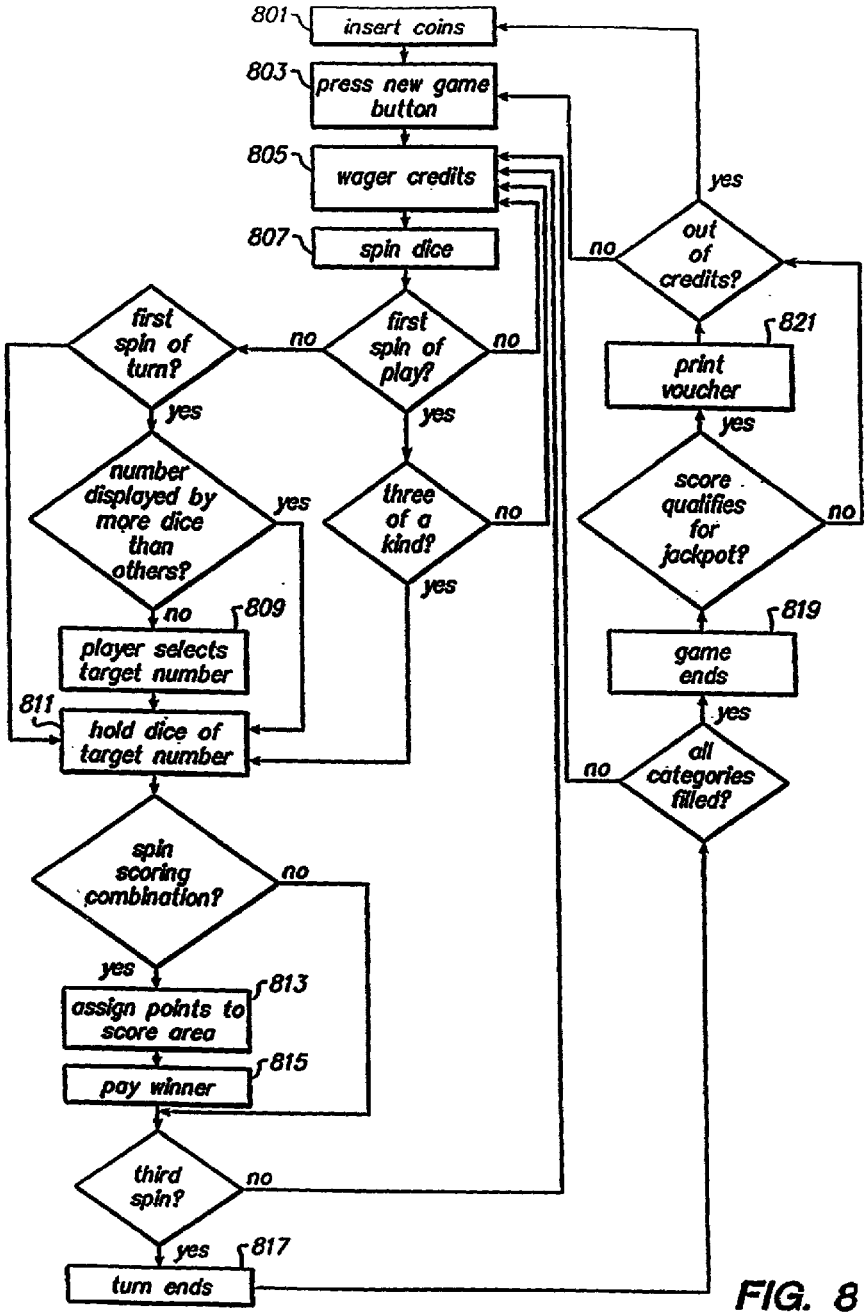
FIG. 8 is a flowchart illustrating the steps of game play according to an alternative embodiment of the present invention.

FIG. 8 is a flowchart, illustrating play of the game of Z Sixty Six according to one embodiment of the present invention. The object of the game is to 'spin' the simulated dice 541 for scoring combinations, and to get the highest total score accumulated within scoring categories of possible dice combinations. A player begins by inserting 801 one or more coins into the coin acceptor 111, by inserting 801 one or more bills into the bill validator 113, or by utilizing credits. The player then presses 803 the touch-sensitive start game button 553 to begin game play. In one embodiment, three credits are automatically wagered 805 on each spin of the simulated dice 541. In another embodiment, the player selects the number of credits to wager on the spin of the simulated dice 541 by utilizing the touch-sensitive wager button 555 which controls the selection of the number of credits to be wagered. The player next spins 807 the simulated dice 541 by pressing the touch-sensitive spin button 549. The computer program 601 utilizes the random number generator 619 to produce random numbers that represent the results of the simulated roll of the simulated dice 541.

The player must achieve at least three of a kind on a single spin to begin play of an individual game. Until a spin generates at least three simulated dice 541 displaying identical numbers, the player must continue spinning 807 to attempt to generate the minimum achievement required for game entry. A wager is required for each spin of the simulated dice 541. Once a spin generates at least three simulated dice 541 displaying identical numbers, those simulated dice 541 are automatically held 811, and a predetermined number of points is automatically assigned 813 to the appropriate scoring area 503. The number of points awarded is displayed in the appropriate score area 503, which preferably changes color to indicate active status. The spin that generated the requisite achievement is counted as the first spin of a turn, and the scoring number becomes a target number for the remainder of the turn. A target number is a number that the player can receive points for generating during a given turn.

For example, if a first spin results in four aces (ones), the predetermined number of points for achieving four of a kind on the first spin of a first turn is automatically assigned 813 to the scoring area 503 for aces 507. Aces becomes the target number for the remainder of the turn. Thus, on the subsequent spins of the turn, the player will receive additional points only for generating aces.

The requirement of generating at least three of a kind applies only to the first turn. A player must achieve three of a kind to enter the game and begin the first turn. Once a player has generated the requisite achievement and entered the game, subsequent turns do not require a minimum achievement to begin.

On each turn, the player may spin 807 the simulated dice 541 up to three times in order to get the highest scoring combination for one of six scoring categories. The six scoring categories are illustrated by the following Table 4:

| Score Category | How the Dice Score |
|---|---|
| One (or Aces) | Dice showing One only |
| Twos (or Deuces) | Dice showing Two only |
| Threes | Dice showing Three only |
| Fours | Dice showing Four only |

-continued

| Score Category | How the Dice Score |
|---|---|
| Fives | Dice showing Five only |
| Sixes | Dice showing Six only |

After the first spin of a turn, the number displayed by the largest plurality of the video simulated dice 541 automatically becomes the target number for the current turn. The simulated dice 541 of the target number are automatically held 811, and the score area 503 for the target number preferably changes color to indicate that it is the active score area 503 for the turn. If at least three dice 541 displaying the target number have been generated, a predetermined number of points is assigned 813 to the score area 503 for the target number.

If the first spin does not result in a largest plurality of dice 541 displaying any one number, the player selects 809 a target number from amongst those displayed by an equal number of the simulated dice 541. For example, if the first spin results in two aces, two deuces, one four and one five, the player may select 809 acres or deuces as the target number. The selection is made by touching the desired score area 503 of the touch-sensitive display 115. Preferably, the score areas 503 which the player may touch to choose a target number blink or change color or size or otherwise provide visual indication of the choices available.

If the player has not yet spun 807 three times during the present turn, the player may spin 807 again. The player next spins 807 the simulated dice 541 by pressing the touch-sensitive spin button 549. During the second and third spins of a turn, any generated dice 541 displaying the target number are held 811. Preselected numbers of points are assigned 813 to the appropriate scoring area 503 for scoring three, four, five, or six of the target number.

After each spin, if the player has achieved a scoring combination, the player is paid 815 via the coin hopper 123. Alternatively, the player may elect to receive credits. The number of predetermined points awarded for various scoring achievements is displayed in a paytable 545 on the display 115. The paytable 545 is adjusted as the game progress, reflecting predetermined numbers of points to be paid for various achievements at a particular stage of the game. For example, more points are awarded for achieving a six of a kind on a first spin than on a third spin. Amounts to be paid are based upon the odds of achieving various scoring combinations at a given stage of game play, taking into account number of unheld dice to be spun, and numbers removed from possible generation. An example of paytable 545 for a first spin of a game appears below in Table 5.

| ACHIEVEMENT | NUMBER OF POINTS TO BE PAID |
|---|---|
| THREE OF A KIND | 3 |
| FOUR OF A KIND | 10 |
| FIVE OF A KIND | 50 |
| SIX OF A KIND | 500 |

Alternative embodiments may employ different paytables 545, as desired.

A turn ends 817 after a player has spun 807 three times, or achieved six of the target number prior to the third spin.

Each scoring category can only be scored or selected once during a game. Once a category is used, it cannot be reused until the next game either when the game is over because a score has been assigned to each category, or the player presses the touch-sensitive reset button 551. Pressing the touch-sensitive reset button 551 terminates the current game and starts a new game. Once a scoring category for a given number has been used, that number is replaced for the remainder of the game by a non-numerical symbol, for example the letter "Z" or a graphic symbol of a piece of fruit, or as desired. During subsequent turns, when the random number generator 619 generates the used number, the non-numerical symbol is displayed instead.

After completing a turn, the player may then proceed with the next turn and continue filling the score areas 503. To proceed with the next turn, the player next spins 707 the simulated dice 541 by pressing the touch-sensitive spin button 549 and plays a turn, as described above.

The game ends 819 when the player has filled all six score areas 503 with a score, or is out of credits to play the computer-controlled slot machine 101.

FIG. 9 illustrates an embodiment of the present invention in which each score area 503 comprises two distinct display areas. A first display area 901 is utilized to display accumulation of points for the associated scoring category. A second display area 903 identifies the associated scoring category, for example by displaying an identification video simulated dice 905 displaying the number of the scoring category. Additionally, the second display area 903 is used to indicate a current target number for a turn, preferably by changing color to indicate that the number of the associated scoring category is the active target number. Also, the second display area 903 is preferably utilized to choose a target number from amongst those displayed by an equal number of the simulated dice 541 when necessary. The player chooses a target number by touching the second display areas 903 associated with the chosen target number. The second display area 903 which the player may touch to choose a target number blink or change color or size or otherwise provide visual indication of the choices available. Additionally, once a scoring category for a given number has been filled, the indicator for the associated second display area is replaced for the remainder of the game by a non-numerical symbol 907, for example the letter "Z" or a graphic symbol of a piece of fruit, or as desired.

In alternative embodiments, display of accumulated points, identification of score category, indication of current target number, indication of available choices of target number, and indication of filled categories (and in other embodiments more or fewer functions as desire) are divided between at least two display areas, in various combinations as desired.

Once the game has ended, the computer program 601 evaluates the player's score against other current scores to determine if a progressive jackpot will be awarded on a daily, weekly, monthly, or yearly basis. If the player has a currently qualifying score, the computer-controlled slot machine 101 prints 821 a voucher for the player with a control number and other pertinent information for later redemption, if the score is a winner. In various embodiments, jackpots are awarded for achieving high scores, for achieving high scores low scores, or for achieving both high and low scores as desired.

Another embodiment of a game of the present invention will be described with reference primarily to FIGS. 10–11. This game is referred to herein as the game of Z Hot Dice.

Figure 10:
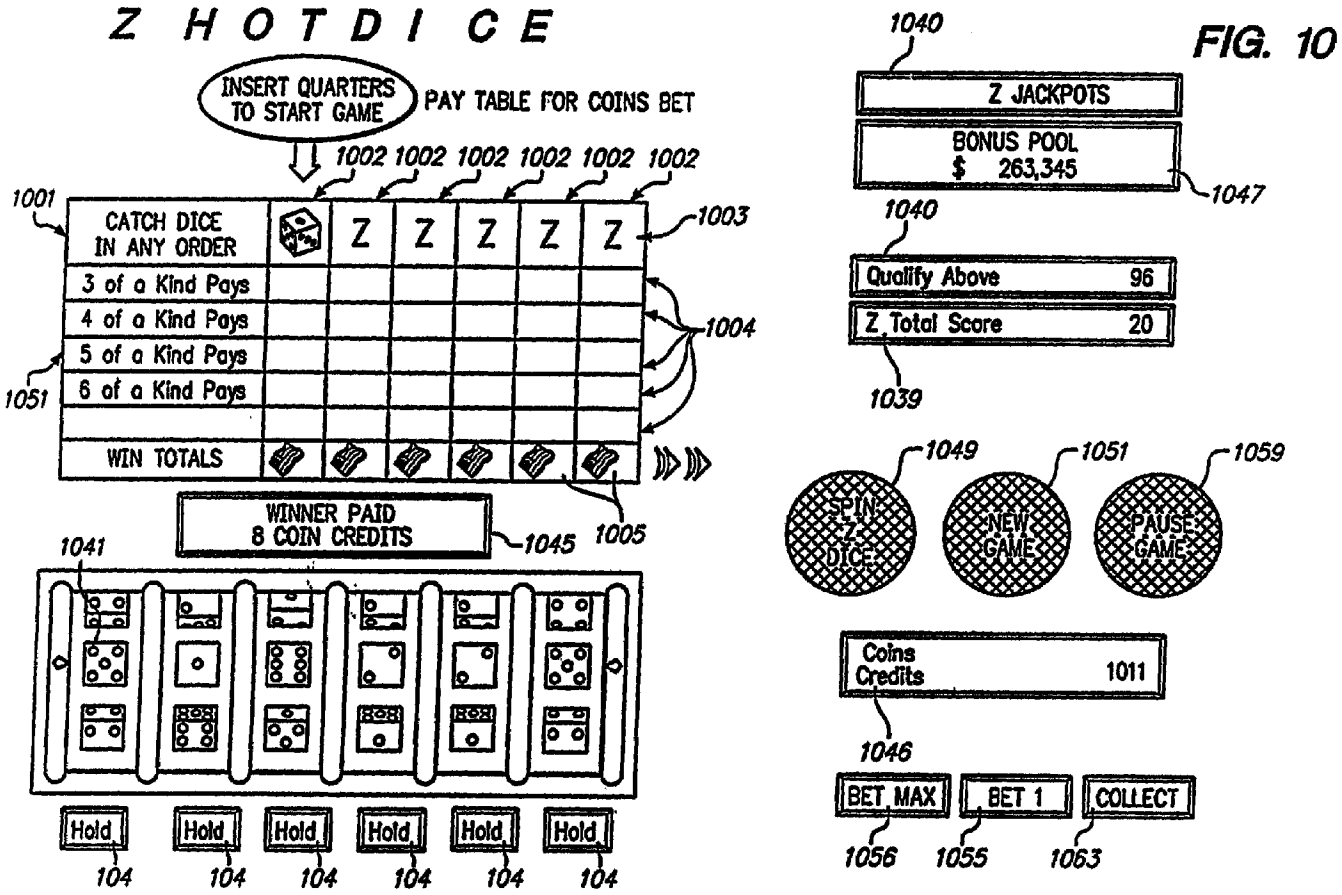
FIG. 10 illustrates a user-interface for an alternate game of the present invention.
Figure 11:
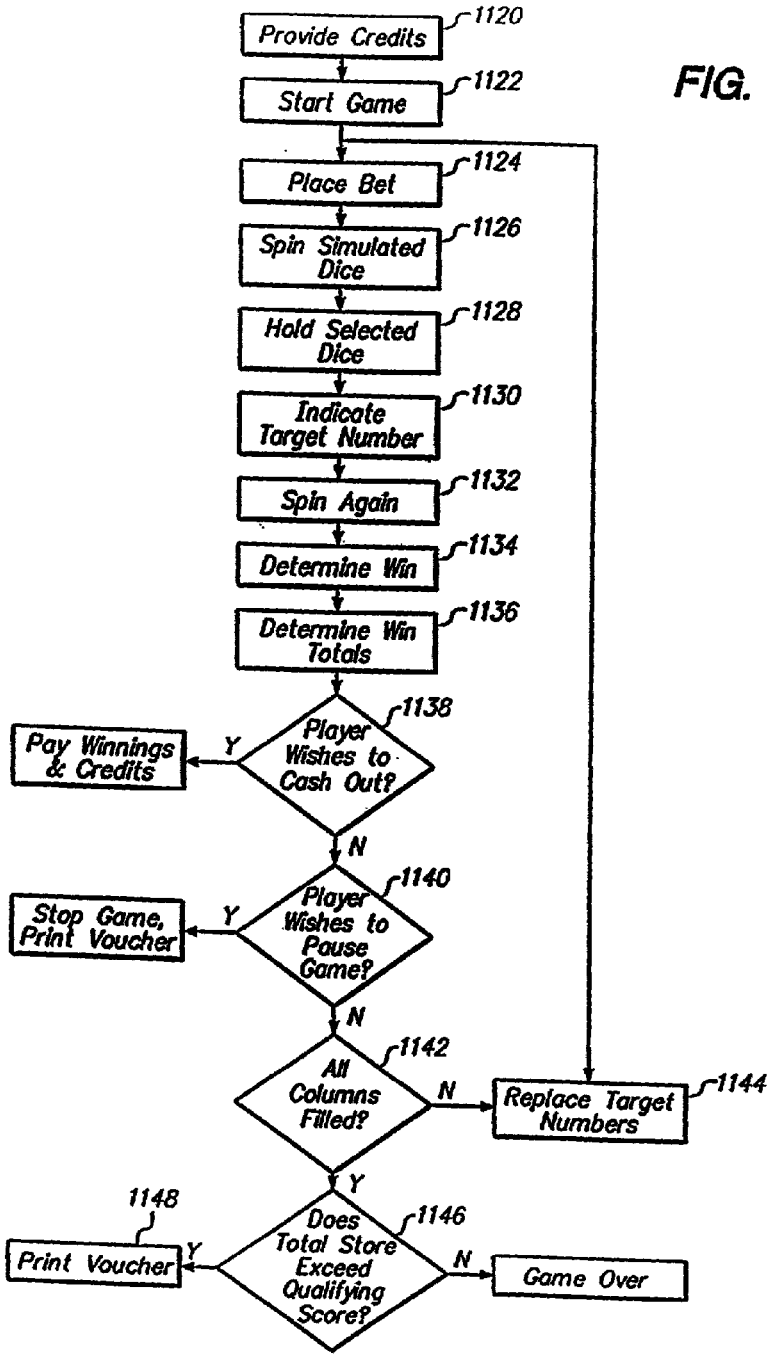
FIG. 11 is a flowchart illustrating the steps of game play of the game having the interface illustrated in FIG. 10.

FIG. 10 illustrates a touch sensitive display 1015 for implementing the game of Z Hot Dice. A scorecard 1001 area is provided in an upper left-hand corner. The scorecard 1001 displays information regarding a particular event, the pay table for that event, prior played events, and win totals for each prior played event and the current event.

The scorecard 1001 includes six columns 1002, the number of columns being the same as the number of sides of dice. During game play, as described below, a target number is associated with one of the columns 1002, the target numbers comprising one of the numbers associated with a side of a dice (i.e. the numbers one through six). At a top of each column 1002 is provided a target number indicator 1003. In one embodiment, before a target number has been selected, this indicator 1003 displays a "Z" or other symbol (or nothing). A central portion 1004 of each column 1002 indicates the payout which will be awarded to a player for receiving a particular combination of the target number(s).

In the embodiment illustrated, the central portion 1004 is arranged to display payouts for receiving 3 of a Kind, 4 of a Kind, 5 of a Kind or Six of a Kind of the target number. A win total 1005 is provided at the bottom of each column 1002 for indicating the total payout or winnings to the player for a particular event. Those of skill in the art will appreciate that other winning combinations may be provided, such as a full house (i.e. three of the target number along with two of another number).

The display 1015 displays a number of simulated dice 1041, in a similar manner to that described above. Below each simulated dice area 1041 is a hold button 1043. Each button 1043 is associated with one of the simulated dice 1041 and, as described in more detail below, arranged to permit a player to "hold" the a particular simulated dice 1041 in a fixed position.

A number of other display areas are provided for displaying game information. For example, a message area 1047 is provided for displaying the amount of winnings in a jackpot pool. A grand total area 1039 is provided for indicating to the player their total score for the win totals 1005 of all columns 1002. In addition, a qualify score 1040 is displayed so that the player may determine if his or her grant total is sufficiently high to qualify for a bonus or jackpot (as described below).

A new game button 1051 is provided for permitting a player to begin a new game. As described in more detail below, once a player has placed a wager, a text messages area 1045 displays winnings paid or other information for a player. The player may bet or wager credits in single increments with a "Bet 1" button 1055, or may bet or wager a maximum allowed number of credits using a "Bet Max" button 1056. A credits area 1046 displays the credits belonging to the player.

A spin button 1049 is provided for permitting a player to effectuate a spin of the simulated dice 1041. A pause game button 1059 is provided for permitting a player to pause a game in progress. A player may elect to cash out by pressing a collect button 1063.

As described in more detail below, while in one arrangement the user interface or screen comprises a touch screen arranged to display information to a player and receive input therefrom, the user interface may comprise a combination of electrical and mechanical devices. For example, one or more of the buttons may comprise electromechanical buttons which may be depressed by a player. Those of skill in the art will appreciate that many players like the "tactile" feel of buttons as compared to touch screen input. Further, while the display areas are discussed separately, they may be integrated or be arranged in a number of ways other than as shown.

A method of play of the game of Z Hot Dice will be described with reference to FIG. 11. In a first step 1120, a player inserts a number of coins or provides other consideration for playing the game. The consideration may be dollar bills, credits from a player card or the like.

In a step 1122, the player presses the new game button 1051 to initiate a new game. In one or more embodiments, the gaming apparatus is configured such that if the player presses the new game button at any time during the pendency of a game, the player is prompted to press the new game button again if the player actually intends to start a new game. This serves to reduce the likelihood that the player may accidentally or unintentionally press the new game button 1051 and cause a new game to begin. The prompt message may be illuminated in the text message box 1045.

In a step 1124, the player places a wager or bet. In one embodiment, this step comprises the player pressing the "Bet 1" button 1055 or the "Bet Max" button 1056. In one embodiment, a player is permitted to bet between one and five credits. Each credit may comprise any of a number of values, such as $0.05 U.S., $0.10 U.S., $0.25 U.S. or the like. The player may utilize the "Bet 1" button 1055 to place wagers incrementally, or press the "Bet Max" button 1056 to place a maximum bet. The payouts displayed on the central portions 1004 of the columns 1002 may be updated, as necessary, to reflect an increased payout for achieving a predetermined winning combination when the player increases the amount wagered.

In a step 1126 the player presses the spin button 1049. Upon depressing the spin button 1049, the simulated dice 1041 spin or move (such as in a motion simulating a "reel" displaying die faces), and then stop, as described above to simulate the random roll of dice.

At this point, six simulated die 1041 are displayed to the player, each dice 1041 displaying one face, and thus one number, towards the player. In the arrangement illustrated in FIG. 10, the simulated die 1041 display a five, a one, a six, a two, another two, and another five.

In a step 1128, the player is then permitted to "hold" the dice which that player wishes to play. The held dice identify a selected target number, the target number being that number shown on the face of the held dice. For example, in the arrangement illustrated in FIG. 10, the player may elect to hold the simulated die 1041 displaying fives. In such event, the player presses the right-most and left-most buttons 1043, and the target number then comprises five.

In a step 1130, when the player makes a selection, the target number is displayed in the first available column 1002 of the scorecard 1001. In one embodiment, the first available column comprises the left-most column 1002 which has not been utilized during the game. Preferably, the target number is illustrated by replacing the "Z" or other symbol in the indicator 1003 with a dice displaying the target number. In the example given above, a dice displaying a five would be displayed in the left-most column 1002.

In one or more embodiments, a player is not permitted to select as a target number a number which has already been played in a particular game. If the player attempts to do so, a message may be displayed in the text message box 1045 to the effect that the selected number has already been played and the player must either select a new target number or spin again. Another spin may be required where the first spin does not result in the display of any available target numbers (as described below, after a target number has been played, it is preferably removed from the simulated die 1041 and will not be re-displayed). In addition, if the player selects more than one number (such as a simulated dice 1041 displaying a five and another displaying a two) the player be instructed that the action is not permitted and the player must select only one target number.

Preferably, when a number is selected, the particular column 1002 is highlighted, such as in brightness or a different color, to aid the user in identifying which information is pertinent to the present round of the game.

In one or more embodiments, the particular payout is dependent upon the player's wager, with the payout increasing with an increasing wager. Set forth below are possible paytables for wagers of one, two, three, four and five coins or bet increments for each target number. As will be appreciated, the payout increases as the number of target numbers played increases (for reasons described below). Of course, a variety of payouts may be different than those illustrated.

| | First Target Number | Second Target Number | Third Target Number | Fourth Target Number | Fifth Target Number | Sixth Target Number |
|---|---|---|---|---|---|---|
| For one 1 bet: | | | | | | |
| 3 of a Kind | 1 | 2 | 3 | 4 | 5 | 6 |
| 4 of a Kind | 3 | 4 | 5 | 8 | 11 | 33 |
| 5 of a Kind | 30 | 40 | 50 | 80 | 110 | 330 |
| 6 of a Kind | 300 | 400 | 500 | 800 | 1100 | 3300 |
| For 2 coins bet: | | | | | | |
| 3 of a Kind | 2 | 4 | 6 | 8 | 10 | 12 |
| 4 of a Kind | 6 | 8 | 10 | 16 | 22 | 66 |
| 5 of a Kind | 60 | 80 | 100 | 160 | 220 | 660 |
| 6 of a Kind | 600 | 800 | 1000 | 1600 | 2200 | 6600 |
| For 3 coins bet: | | | | | | |
| 3 of a Kind | 3 | 6 | 9 | 12 | 15 | 18 |
| 4 of a Kind | 9 | 12 | 15 | 24 | 33 | 99 |
| 5 of a Kind | 90 | 120 | 150 | 240 | 330 | 990 |
| 6 of a Kind | 900 | 1200 | 1500 | 2400 | 3300 | 9900 |
| For 4 coins bet: | | | | | | |
| 3 of a Kind | 4 | 8 | 12 | 16 | 20 | 24 |
| 4 of a Kind | 12 | 16 | 20 | 32 | 44 | 132 |
| 5 of a Kind | 120 | 160 | 200 | 320 | 440 | 1320 |
| 6 of a Kind | 1200 | 1600 | 2000 | 3200 | 4400 | 13200 |
| For 5 coins bet: | | | | | | |
| 3 of a Kind | 1 | 10 | 15 | 20 | 25 | 30 |
| 4 of a Kind | 15 | 20 | 25 | 40 | 55 | 165 |
| 5 of a Kind | 150 | 200 | 250 | 400 | 550 | 1650 |
| 6 of a Kind | 1500 | 2000 | 2500 | 4000 | 5500 | 16500 |

If after the first spin and hold, the player has a winning combination of simulated dice 1041, then the win total is indicated in the win total area 1005 of the scorecard 1001, and the text message box 1045 may indicate the winnings. For example, in the event upon the first spin of the game the spin results in four simulated dice 1041 showing a five, then the player may hold these four simulated dice for a "4 of a Kind" of a target number of fives. The payout for this combination may then be indicated in the win total area for the first column 1002, and the text message box 1045 indicate the winnings to be paid.

In one embodiment, payouts for combinations of target numbers which are eliminated may be removed from the scorecard 1001. For example, in the above-referenced example, the payout for a 3 of a Kind may be removed from the first column 1002, since the player has already received at least a 4 of a Kind. In addition, the payout which the player has already received upon the first spin for that target number may be highlighted to bring to the attention of the player that he or she has already won. This highlighting may be by displaying the payout in a distinguishing color or brightness or other means available. The word "paid" may be indicated in the particular area of the scorecard 1001 as well.

In accordance with the present invention, in a step 1132, after holding one or more of the simulated dice 1041, or after an indication that no dice can be held, then the player presses the spin button 1049 again. All of the simulated dice 1041 which were not held spin and then stop, again displaying a number.

In a step 1134, the total number of simulated dice 1041 displaying the target number after the second spin are then counted for determining whether a payout is to be awarded. A win total is displayed in the win total area 1005 of the particular column. This win total may be 0, in the event the player did not receive a sufficiently high number of simulated dice 1041 displaying the target number (for example, a player may elect to hold two dice showing the target number after the first spin and not receive any additional dice showing the target number after the second spin, thus not receiving a minimum three of the target number for an award). The payout for that "round" may then be updated in the text message box 1045.

In a step 1136, the win totals from all win total areas 1005 are summed and displayed as a total score in the total score area 1039. Preferably, a qualifying score for a jackpot bonus is displayed in the qualifying score area 1040, again which the player may compare their score.

In a step 1138 it is determined if the player wishes to cash out. This is indicated by a player pressing the collect button 963. In such event, any accumulated winnings and credits are paid to the player. In that event, the game ends.

In a step 1140, it is determined if the player wishes to pause the game. If the player wishes to pause the game, the player pushes the pause game button 1059. A process is then initiated by which the player may leave the game and being play at a later time and even at different gaming machine, as described in more detail below.

If the player wishes to continue the game, it is determined in a step 1142 if all of the columns 1002 of the scorecard 1001 are filled. If so, then the player has completed the game. In a step 1146, the player's total score is compared to the qualifying score to determine if the player qualifies for participation in the jackpot. If the player qualifies, then in a step 1148, the player is provided with a voucher or the like, in similar manner to that described above with respect to the game of Z Sixty Six.

In a step 1144, after a particular target number has been played in a round, that target number is replaced on each simulated dice 1041 with another symbol or is removed. As described above, this may be a symbol, such as a "Z," or a picture of a fruit or the like. In one embodiment, it is preferred that the replacement symbols be different so that at no time can a player receive a sequence of the same symbols during a spin. Such may be confusing to a player and lead a player into believing that they have spun into a winning combination. For example, the replacement symbols may comprise an X on the first simulated dice 1041, an 0 on the second simulated dice 1041, an X on the third simulated dice 1041 and so on, so that if a player spins and the simulated dice stop on the replacement symbols, they display XOXOX. In a preferred embodiment, the side of the dice is effectively made blank or the symbol removed from preventing its further display.

In another embodiment, the replacement symbols may actually be arranged so that a player may spin into a new bonus combination for which a payout is awarded. For example, each number or dice face may be replaced with a $ symbol, such that during later play if the player receives a display of all of these symbols after a spin, the player is awarded a special prize or payout.

If all of the columns 1002 of the scorecard 1001 are not filled, the player may, repeating again to step 1124, place a bet or wager. The player may be provided with an indication in the text message box 945 after a given round that they may place a bet to continue with the game.

The game then continues as described above. It will be appreciated that after a first target number has been played, a spin of the simulated dice 1041 may result in a display of all of the remaining numbers and/or the symbols used to replace the already played target number. As the number of played numbers increases, the probability of receiving a target number decreases. For this reason, as detailed above, the payout for receiving a winning combination of each target number increases as the game progresses.

The player may continue playing until each of the target numbers one through six, have been played (in any order). At such time, the total score for the player is compared to the qualifying score to determine if the player is entitled to participate in a jackpot or additional play. Regardless of the outcome, the player must then begin a new game to continue play.

Another embodiment of a game of the present invention will be described with reference primarily to FIGS. 12–13. This game is referred to herein as the game of Z Jackpot Dice.

Figure 12:
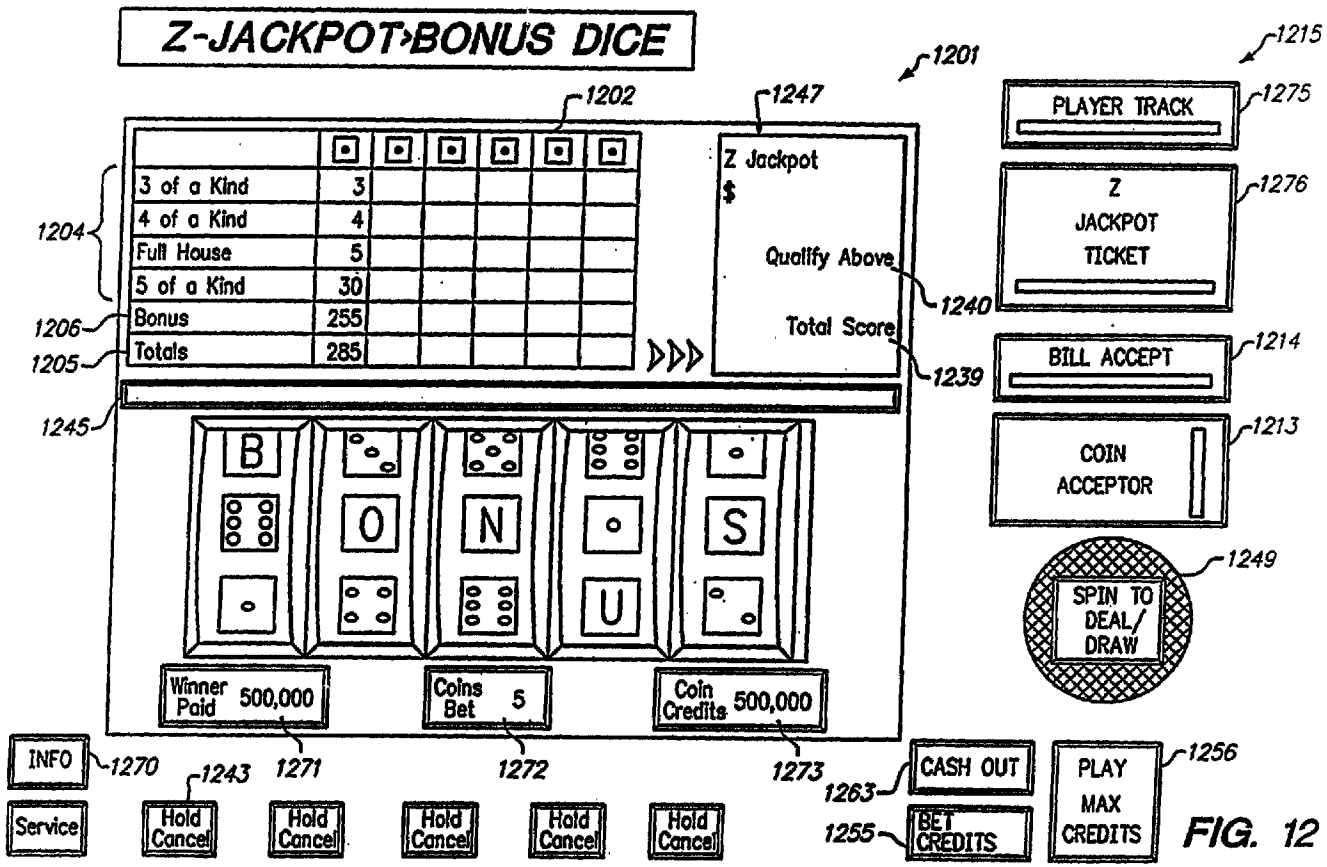
FIG. 12 illustrates a user-interface for an alternate game of the present invention.
Figure 13:
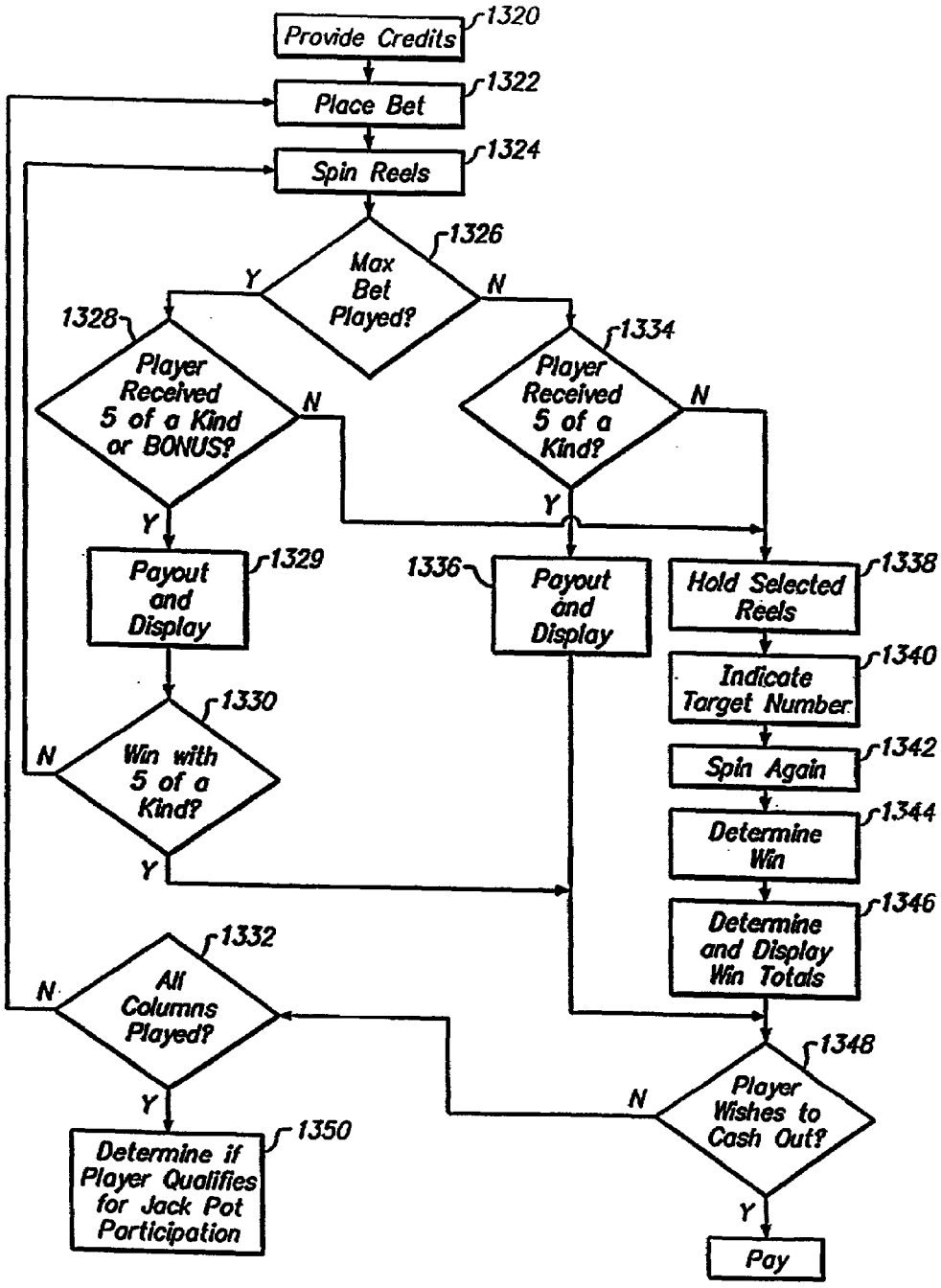
FIG. 13 is a flowchart illustrating the steps of game play of the game having the interface illustrated in FIG. 12.

FIG. 12 illustrates an interface 1215 for implementing the game of Z Jackpot Dice. A scorecard 1201 area is provided in an upper left-hand corner. The scorecard 1201 displays information regarding a particular play event, the pay table for that event, prior played events, and win totals for each prior played event and the current event.

The scorecard 1201 is similar to that of the previous embodiment in many respects, and includes six columns 1202, one for each of the six sides of a dice and the numbers associated therewith. At a top of each column 1202 is provided a target number indicator 1203. In one embodiment, before a target number has been selected, this indicator 1203 comprises a blank dice. A central portion 1204 of each column 1202 indicates the payout for a particular combinations of the target number and/or other numbers. As illustrated, the central portion 1204 is arranged to display payouts for receiving 3 of a Kind, 4 of a Kind, and 5 of a Kind of the target number, as well as a full house, a full house comprising three of the target number and a pair of another number. Preferably, the payouts for all combinations are illustrated in the central portion 1204, regardless of whether a particular column 1202 is active (as described below). However, it is desired that the payout information for the non-active column to be displayed less brightly or less visibly than the information provided in the active column. In this manner, a player is provided with information regarding the possible payouts for receiving combinations in any particular column, but the player's attention is directed to the active column 1202 so as to avoid the player being confused as to which column 1202 is being played.

A bonus value 1206 is provided in the column 1202. The bonus value 1206 comprises a payout value which the player may win in a manner described in more detail below. In a preferred embodiment, the bonus value 1206 comprises a sum which is related to the amount of wagers placed by players when playing the game, such as a percentage of the wagers or retained winnings by the game provider/house.

A win total 1205 is provided at the bottom of each column 1202 for indicating the total payout or winnings to the player for a particular event.

The interface 1215 also includes a number of reels 1241. In the preferred embodiment of this game, five reels 1241 are provided. In a preferred embodiment, each reel 1241 is capable of displaying one of nine symbols: one symbol each comprising a side of a dice, and three symbols comprising a letter in three different colors. Thus, each reel 1241 is capable of displaying dice sides having a one, two, three, four, five and six thereon. The first reel is preferably arranged to display the letter "B" in the colors of red, white and blue. The second reel is preferably arranged to display the letter "O" in the colors of red, white and blue. The third reel is preferably arranged to display the letter "N" in the colors of red, white and blue. The fourth reel is preferably arranged to display the letter "U" in the colors of red, white and blue. The fifth reel is preferably arranged to display the letter "S" in the colors of red, white and blue.

It will be appreciated that the reels 1241 may comprise a displayed image on a video display. In one or more other embodiments, the reels 1241 may comprise mechanical reels having one or more of the images printed thereon and/or capable of being displayed thereon. In general, each reel 1241 is arranged to simulate a throw or spin of an imaginary nine-side diced having sides displaying the above-described numbers and symbols. Thus, as one aspect of the invention, dice or similar physical items are represented either graphically or on a physical reel.

Below each reel 1241 is a hold button 1243. Each button 1243 is associated with one of the reels 1241 and, as described in more detail below, arranged to permit a player to "hold" the position of a particular reel 1241 in a fixed position.

A number display areas are provided for displaying related game information. For example, a message area 1247 is provided for displaying the amount of winnings in a jackpot pool. A grand total area 1239 is provided for indicating to the player the total score of the win totals 1205 of all columns 1202. In addition, a qualify score 1240 is displayed so that the player may determined if his or her grant total is sufficiently high to qualify for a bonus or jackpot (as described below).

A new game button 1251 is provided for permitting a player to begin a new game. As described in more detail below, once a player has placed a wager, a text messages area 1245 may be used to display information, such as game play information. The game play information may be accessible by pressing an information button 1270.

Display areas are provided for displaying winner paid information 1271, bet information 1272, and credit information 1273. The player may bet or wager credits in single increments with a "Bet 1" button 1255, or may bet or wager a maximum allowed number of credits using a "Bet Max" button 1256.

A spin button 1249 is provided for permitting a player to effectuate a spin of the simulated dice 1241. A player may elect to cash out by pressing a cash out button 1263.

As illustrated, a coin acceptor 1213 and bill acceptor 1214 are provided for accepting wagers by a player. A player card reader 1275 is provided for reading a player card. The player card 1275 may contain credits which can be used to place bets, may contain player information for reading by the machine, and may store game information, such as a qualifying score, as described in more detail below. A ticket dispenser 1276 is provided for dispensing tickets. As described in detail below, the ticket information may comprise game information, such an in-progress or completed game information.

A method of play of the game of Z Jackpot Dice will be described with reference to FIG. 13. In a first step 1320, a player inserts a number of coins (as by coin acceptor 1213), bills (as by bill acceptor 1214) or provides other consideration for playing the game. Consideration may also comprise credits from a player card or the like.

In a step 1322, the player places a wager or bet. In one embodiment, this step comprises the player pressing the "Bet 1" button 1255 or the "Bet Max" button 1256. In one embodiment, a player is permitted to bet between one and five credits. Each credit may comprise any of a number of values, such as $0.05 U.S., $0.10 U.S., $0.25 U.S. or the like. The player may utilize the "Bet 1" button 1255 to place wagers incrementally, or press the "Bet Max" button 1256 to place a maximum bet.

In a step 1324 the player presses the spin button 1249. Upon depressing the spin button 1049, the reels 1241 spin or move (either by mechanical rotation or by computer generated graphics) and then stop. At this point, one symbol is displayed in association with each reel 1241. In the arrangement illustrated in FIG. 12, the symbols six, white O, blue N, one and red S are displayed.

In a step 1326, it is determined if the player placed the maximum bet. If so, then in step 1328 it is determined if the player has received a specific combination of displayed symbols on the reels 1241. In one or more embodiments, a player is declared a winner if the player receives the symbols spelling BONUS. In one embodiment, if the player receives the symbols spelling BONUS in mixed colors, then the player is awarded the bonus amount in the display 1206 for the present column. If the player receives the symbols spelling BONUS in the same colors (i.e. all red, white or blue) then the player is awarded the bonus amount in the display 1206 for all columns 1202.

In one or more embodiments, a player is declared a winner if the player receives the same number on each of the reels 1241 (i.e. all ones, twos), and that number has not already been played. In a preferred embodiment, when the player receives the same number on each of the reels 1241, then the player is awarded the payout for 5 of a Kind as well as the bonus amount.

If the player is a winner, then in step 1329, the total of any winnings is displayed in the total 1205 portion of the column being played. In the preferred embodiment, the column being played is the left-most column 1202 which has yet to be played. The totals of all column 1202 totals are displayed in the total score area 1239.

As an example, if a player receives BONUS spelled in other than symbols of a single color, then the player receives the bonus amount 1206 for that column. That amount is then placed into the total portion 1205 of that column and then indicated in the total score area 1239 along with any other previous total amounts. If a player receives BONUS spelled in a single color, then the player receives the bonus amount 1206 for each and every column. In such event, the totals 1205 for each column 1202 are updated to reflect this winning, as is the player's total score. If a player receives a 5 of a Kind of a new target number, then the player is awarded the payout for a 5 of a Kind and the bonus amount, and the first open column 1202 is highlighted and the target number displayed thereabove.

In a step 1330, once the player has been declared a winner, it is determined if the player received a win by a 5 of a Kind or receiving the BONUS symbols. If the player received a 5 of a Kind win, then in step 1332, it is determined if the player wishes to cash out (as via a step 1348 as described below). If the player won by receiving the BONUS symbols, then the player is entitled to respin again in an attempt to obtain a combination of target numbers, as in step 1224. Of course, if the player again receives a win on the first spin, the process repeats. If the player received the same number on each of the reels, i.e. a 5 of a Kind, then the play for that particular target number is completed and the player moves to the next round. In one or more embodiments, the player may be required to place another bet in order to spin again after having received a win by hitting the BONUS win.

If in step 1326 it is determined that the player did not place a maximum bet, then in step 1334 it is determined if the player received a 5 of a Kind of a new target number. If so, then in step 1336, the player is awarded the payout for that combination, and the award is displayed in the appropriate column. It is next determined if the player wishes to cash out in step 1348.

If in steps 1326 and 1334 it is determined that the player did not receive a BONUS win or a 5 of a Kind, then in step 1338, the player is permitted to "hold" any of the reels 1241 which display a number. When the player holds a particular number, that that number becomes the target number. For example, referring to FIG. 12, the player may wish to hold the six displayed in the first column 1202.

In a step 1240, when the player makes a hold selection, the target number is displayed in the first available column 1202 of the scorecard 1201. In one embodiment, the first available column comprises the left-most column 1202 which has not been utilized during the game. Preferably, the target number is illustrated by illustrating the target number on the dice at the top of the column. In the example given above, a dice displaying a six would be displayed in the left-most column 1002.

In one or more embodiments, a player is not permitted to select as a target number a number which has already been played in a particular game. If the player attempts to do so, a message may be displayed in the text message box 1245 to the effect that the selected number has already been played and the player must either select a new target number or spin again. Another spin may be required where the first spin results in only numbers which have already been utilized. In addition, if the player selects more than one number (such as a simulated dice 1241 displaying a five and another displaying a two) the player be instructed that the action is not permitted and the player must select only one target number. Also, a player is not permitted to hold any of the non-numeric symbols, such as B, O, N, U or S.

Preferably, when a number is selected, the particular column 1202 is highlighted, such as in brightness or a different color, to aid the user in identifying which information is pertinent to the present round of the game. In addition, once a particular target number is selected, the payouts are highlighted in the central payout portion 1204 of the scorecard 1201.

In one or more embodiments, the particular payout is dependent upon the player's wager, with the payout increasing with an increasing wager. These payouts may be similar to those described and illustrated above.

In one embodiment, payouts for combinations of target numbers which are eliminated may be removed from the scorecard 1201. For example, the payout for a 3 of a Kind may be removed from the column 1202 being played when the player has already received at least a 4 of a Kind. In addition, the payout which the player has already received upon the first spin for that target number may be highlighted to bring to the attention of the player that he or she has already won. This highlighting may be by displaying the payout in a distinguishing color or brightness or other means available. The word "paid" may be indicated in the particular area of the scorecard 1201 as well.

In accordance with the present invention, in a step 1342, after holding one or more of the reels 1041, or after an indication that no reels 1241 can be held, then the player presses the spin button 1249 again. All of the reels 1241 which were not held spin and then stop, again displaying a number.

In a step 1344, it is determined if the player has received any predetermined winning combinations. If the player did not hold any of the reels 1241, it is possible that on the second spin the player received the symbols spelling BONUS. Preferably, the player is awarded a win as described above for spelling BONUS, if the player has placed the maximum bet. In any event, if the player spells BONUS, that player is entitled to an extra spin in order to permit the player to receive the maximum number of the target numbers.

It is also determined if the player has received a combination of the target number which qualifies as a win. In the embodiment illustrated, the player is a winner if he or she receives at least three of the target number, such as 3 of a Kind, 4 of a Kind or 5 of a Kind of the target number, or if the player receives a full house (i.e. 3 of a Kind of the target number plus a pair of another number).

A win total is displayed in the win total area 1205 of the particular column. This win total may be 0, in the event the player did not receive a winning combination (for example, a player may elect to hold two dice showing the target number after the first spin and not receive any additional dice showing the target number after the second spin, thus not receiving a minimum three of the target number for an award). The total payout to the player may be updated in the winner paid display area 1271.

In a step 1346, the win totals from all win total areas 1205 are displayed, then summed and displayed as a total score in the total score area 1239. Preferably, a qualifying score for a jackpot bonus is displayed in the qualifying score area 1240, again which the player may compare their score.

In a step 1348 it is determined if the player wishes to cash out. This is indicated by a player pressing the collect button 1263. In such event, any accumulated winnings and credits are paid to the player. In that event, the game ends.

If the player wishes to continue the game, it is determined in a step 1332 if all of the columns 1202 of the scorecard 1201 are filled (i.e. all of the target numbers have been played). If so, then the player has completed the game. In a step 1350, the player's total score is then compared to the qualifying score to determine if the player qualifies for participation in the jackpot. If the player qualifies, then in a step 1248, the player is provided with a voucher or the like, in similar manner to that described above. This voucher may be dispensed by the jackpot ticket dispenser 1276.

If all of the columns 1202 of the scorecard 1201 are not filled, the player may, repeating again to step 1224, place a bet or wager. The player may be provided with an indication in the text message box 1245 after a given round that they may place a bet to continue with the game.

In a preferred embodiment, after a particular target number has been played in a round, that target number is removed from each reel 1241. Preferably, the space for the removed target number is made blank. In other embodiments, as described above, the symbol may be replaced.

Further, upon the beginning of the next round, the column 1202 for the last target number is darkened or the like so that the player's attention is directed to the now active column 1202. It is preferred, however, that any winning amounts to the player still be displayed in the prior columns 1202 for identification by the player. In addition, it is preferred that the bonus amount for each played column be removed so as to not confuse the player. In such event, the bonus amount for each previously played column is placed in a bonus pool for award to the player in the event the player receives a combination of the letters BONUS in all of the same color.

The game then continues as described above. It will be appreciated that after a first target number has been played, a spin of the reels 1241 may result in a display of all of the remaining numbers and/or the symbols used to replace the already played target number. As the number of played numbers increases, the probability of receiving a target number decreases. For this reason, as detailed above, the payout for receiving a winning combination of each target number increases as the game progresses.

It will be appreciated that the particular symbols which are utilized in the game of Z Jackpot Dice may vary. For example, the non-numeric symbols need not comprise the letters B, O, N, U and S, and do not need to comprise one of each in three different colors. For example, the non-numeric symbols might comprise pictures of fruit or other items. Differing combinations of the non-numeric symbols may be achieved through color, size or other designation. In addition, a greater or lesser number of non-numeric symbols may be provided with each reel. For example, there may be only two, or as many as four or more of each of the letters, each in different colors.

It will also be appreciated that in one or more embodiments, player may be permitted to hold one of the non-numeric symbols, i.e. B, O, N, U, and/or S, in an attempt to gain a winning combination of such symbols on a second spin or play.

While a specific order of events has been described for the play of Z Jackpot Dice, the order of events and activities may be varied from that above. For example, the times at which columns are highlighted, played numbers are indicated at the top of the columns and the like may vary from that described above. In this regard, the above-description is simply exemplary of an implementation of the concepts of the Z Jackpot Dice game.

Utilizing a local area computer network 301 and a wide area computer network 401, multiple players may play the game Z Sixty Six, Z Hot Dice or Z Jackpot Dice against one another instead of "against the house." Utilizing a local area computer network 301, each participating player deposits money into an individual computer-controlled slot machine 101 for each spin. The player who achieves the highest game score of all of the players who are participating in that multiple player game on the local area computer network 301 wins the money deposited by the various participating players (typically, minus a percentage for the house). The same methodology can be utilized across a wide area computer network 401, allowing players at different physical locations to compete against each other in real time.

As described above, in any of the games of the invention, including Check, Z Sixty Six, Z Hot Dice and Z Jackpot Dice, a player may attempt to obtain a high total score for qualifying for a jackpot. In one or more embodiments, the jackpot comprises a percentage of the monies wagered by the players of the game(s). In this manner, the jackpot continues to increase over time with play, and over time, may comprise multi-million dollars in size. The jackpot may comprise monies belonging to the establishment offering the game, and may comprise other than cash prizes.

In one or more embodiments, jackpot prizes are awarded at various intervals. The interval may be daily, weekly, monthly, yearly, or the like. The intervals may vary or be evenly spaced.

In a preferred embodiment, jackpot prizes are awarded to one or more players who have achieved a high score playing the game. In one embodiment, a set number of players, such as twenty, who have achieved the highest scores playing the game during a jackpot interval may participate in the jackpot. For example, the jackpot may be awarded on the $1^{st}$ of each month, with the players who have achieved the twenty highest scores during the previous month participating in the jackpot. Of course, a gaming establishment may determine the total number of participants.

The participation by the players in the jackpot may be even (i.e. divide the jackpot by the number of participating players) or may be on a sliding or other scale where the higher the player's ranking, the greater that player's participation in the jackpot. The jackpot may also be a fixed amount for each player, or be fixed based on their ranking.

Of course, the manner by which a player is determined to be entitled to participate in the jackpot may vary. For example, players having the lowest scores may be entitled to participate.

Those of skill in the art will appreciate the enticement of such a jackpot award system to a player. In this arrangement, a player need not receive any specific predetermined winning combination or point total. Instead, a player need only achieve a sufficiently high score to be included in the jackpot award. The high score is not fixed, but is dependent upon the scores of other players. Thus, during any particular jackpot interval, the score which a player needs to achieve to participate in the jackpot may vary.

A player may track whether or not they are in the running to win the jackpot during a given payout interval. The player may compare their score(s) against the minimum qualifying score at any time to determine if they are still entitled to participate in the jackpot. A player may determine that their score is no longer high enough to qualify for jackpot participation (such as by reason of a number of later players receiving higher scores and displacing the player from the top twenty highest scores). In such event, a player may play one or more games before the award of the next jackpot in an attempt to re-qualify.

In one or more embodiments, the jackpot qualifying scores may be published, such as on the Internet, permitting a player to conveniently track their participation. In addition, the list of winners of a particular jackpot may be published. The winners may be listed by winning number, which number is printed on the player's voucher. The player may then redeem the voucher for their jackpot award at a gaming establishment or other location.

Alternatively, achieving a predetermined score may be utilized for awarding a predetermined jackpot. For instance, if a player achieves a perfect score, meaning the theoretically highest score for each category, then a jackpot may be awarded for such achievement.

In one or more embodiments of the invention, a number of different jackpot prizes may be provided, the prizes associated with different intervals. For example, a first jackpot prize may be associated with a weekly interval, and another jackpot prize associated with a monthly interval. In one embodiment, jackpot prizes associated with longer intervals may be larger than those which are associated with shorter intervals.

In this embodiment, a player may be permitted to select which jackpot prize they wish to play for. For example, a player may begin a game and be permitted to select the desired jackpot to play for. A player may select the "weekly" jackpot. The player's game result is then used in determining whether the player is entitled to the weekly jackpot at the time the jackpot is awarded. In such an embodiment, the player's game result or score is not associated with participation in other jackpots, such as the monthly jackpot.

In another embodiment, a player may be permitted to attempt to win more than one jackpot. For example, for an additional bet, a player may be permitted to participate in one additional jackpot. For yet another additional bet, a player may be permitted to participate in another additional jackpot. By way of example, upon a player placing two additional bets, a player may attempt to win both the weekly and monthly jackpot using the score or result of their game.

In another embodiment, a jackpot or prize may be awarded for game outcomes (such as highest score) of a group or number of games. For example, a jackpot or prize may be awarded to the player receiving the highest score while playing a game of a group or set of 100 games played. In one embodiment, each gaming machine may be arranged to provide such a jackpot or prize for each set or group of games played.

It will be appreciated that the predetermined winning combinations and their payouts may vary from those described and illustrated herein. For example, instead of attempting to achieve a five of a kind of a given number, a player may be directed to achieve a full house, a straight or other combinations. In one or more embodiments, especially when bonuses or jackpots are not awarded, winning combinations may include the more commonly obtained 2 pair or even a single pair. It will be appreciated that when a portion of the wager is diverted to the generation of bonus and jackpot payouts, paying on such commonly occurring combinations is less desirable, as the hold for the game may be minimal or non-existent to the house.

In one or more embodiments of a game in accordance with the invention, bonus points or awards may be provided when a player receives particular indicia combinations. In one embodiment, a player may be awarded a bonus, such as bonus points, for completing a particular scoring category on a first spin or roll of the dice. For example, in the event the player receives five "4's" on first roll of the dice, thus filling the category for "4's" then the player may be awarded bonus points in addition to the points awarded for the total of "4's." Referring to FIG. 5(*a*), the player may be awarded 20 points for the five "4's" plus a bonus of 300 points for completing the "4's" category on the first spin.

In one embodiment, a bonus or bonus points may be awarded for receiving a combination or completing a category on other than the first spin or roll. For example, a first bonus may be awarded for receiving a combination or completing a category on the first roll, a second bonus for doing so on the second roll, and a third bonus for doing so on the third roll. If upon the third roll the player did not complete the category, then no bonus may be awarded. For example, if after the third roll the player received only three "4's," the player may be awarded only the 12 points for the "4's." In one embodiment, the bonus associated with receiving a combination or completing a category may decrease for each additional spin necessary.

In addition, the total number of reels or simulated dice may be varied. In the examples illustrated, 5 or 6 of such simulated dice or reels are illustrated and described. However, the games may be played with a lesser number or greater number (i.e. such combination as 7 of a Kind being obtainable, or a maximum of 4 of a Kind). Those of skill in the art will appreciate that as the total number of available combinations changes, the payouts may need to be changed in order to both entice a player into playing and yet prevent the house from risking loss.

In the above-described games, a player may preferably save a game in progress by pressing the touch-sensitive save-restore game button 559/pause game button 1059. The computer program 601 then utilizes the machine-readable medium reading and writing device 129 to write the present scores and game states to a card, voucher (such as a printed ticket or token) or other medium which the player can take with them. The player may later resume the saved game by inserting such card or voucher of machine-readable medium into the reading and writing device 129 of any computer-controlled slot machine 101. The saved game information is then read from the card or voucher to initialize the conditions and states of the computer-controlled slot machine 101. In various embodiments, a magnetic or optical or semiconductor medium may be used as desired to store and transfer scores and game states and other pertinent data on such card or voucher produced by the video slot machine 101. In one or more embodiments, when the player elects to pause or save a game in progress, game state information is generated. This information may be stored to the medium which is provided to the player, or may be stored remotely, such as at a central server associated with the games when they are linked. In such event, a code or other information need only be stored or associated with the medium provided to the player. When the code is read or inputted into a game at a later time, the code may cause the game to access the game state information stored separately from the medium. In this manner, a player may be permitted to cease playing a game at a first time and pickup that same game at a later time, and even at a different gaming station offering the game. It will be appreciated that such a similar function may be applied to the game of Z Jackpot Dice or even games other than those described herein, such as those games now known or later invented. Further, it should be noted that the games may be arranged so that a player may engage the pause function, as well as the cash-out and other features of the games, at times other than those specifically described above. For example, a player may be permitted to pause a game at any point, and not specifically only after the completion of a given round of play.

Figure 15:
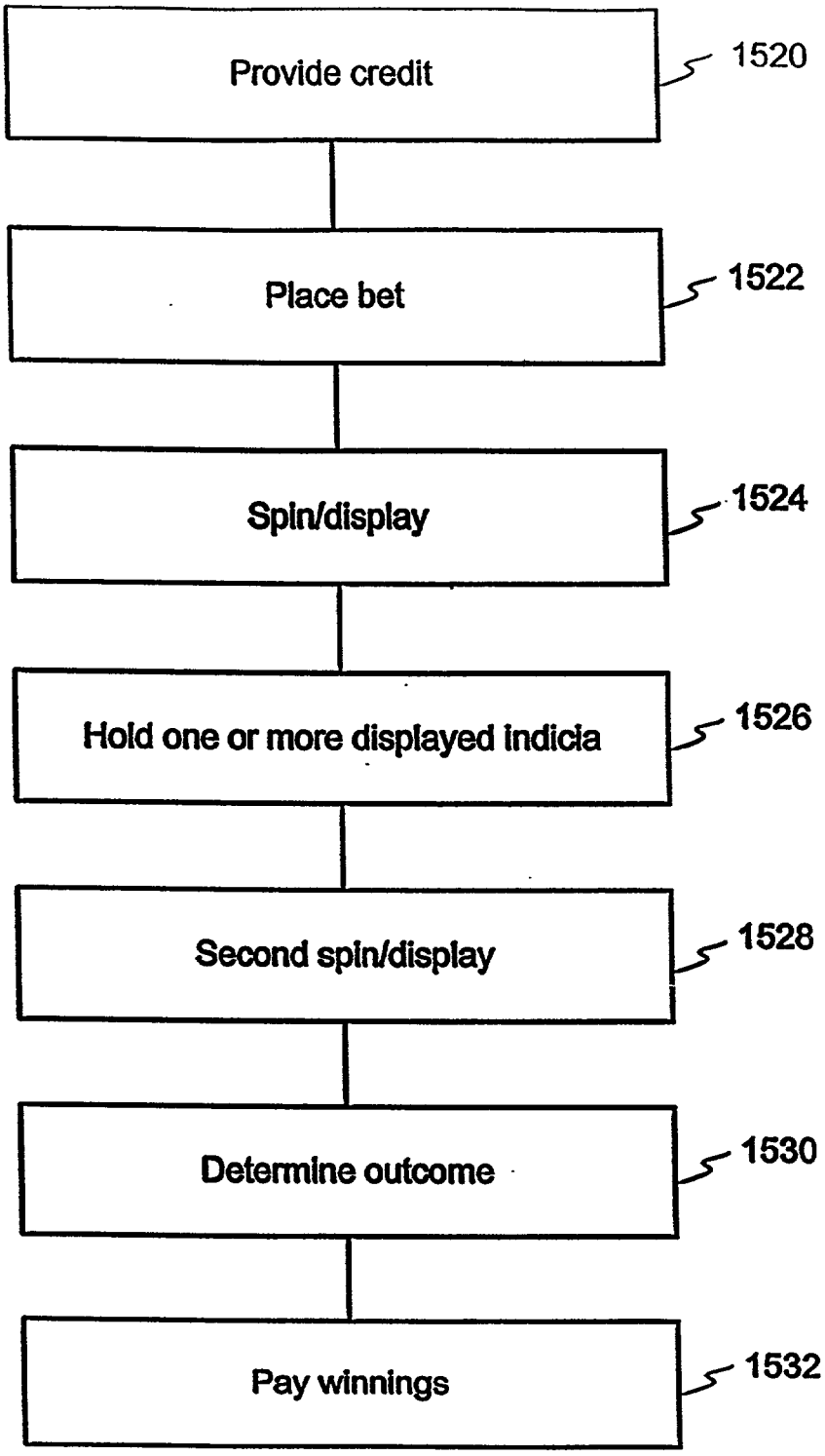
FIG. 15 is a flowchart illustrating the steps of game play of the game having the interface illustrated in FIG. 14.
Figure 16:
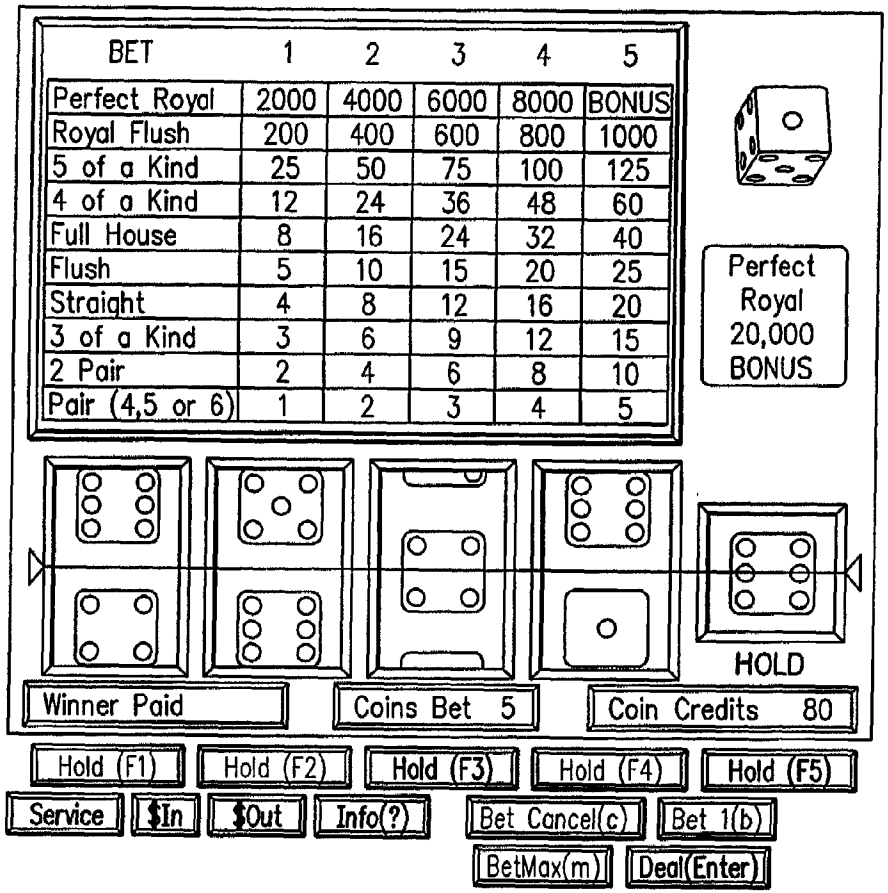
FIG. 16 illustrates said user-interface of said game illustrated in FIG. 14 in a particular game condition.

Another embodiment of a game of the present invention will be described with reference primarily to FIGS. 14–16. This game is referred to herein as the game of Draw Dice.

Figure 14:
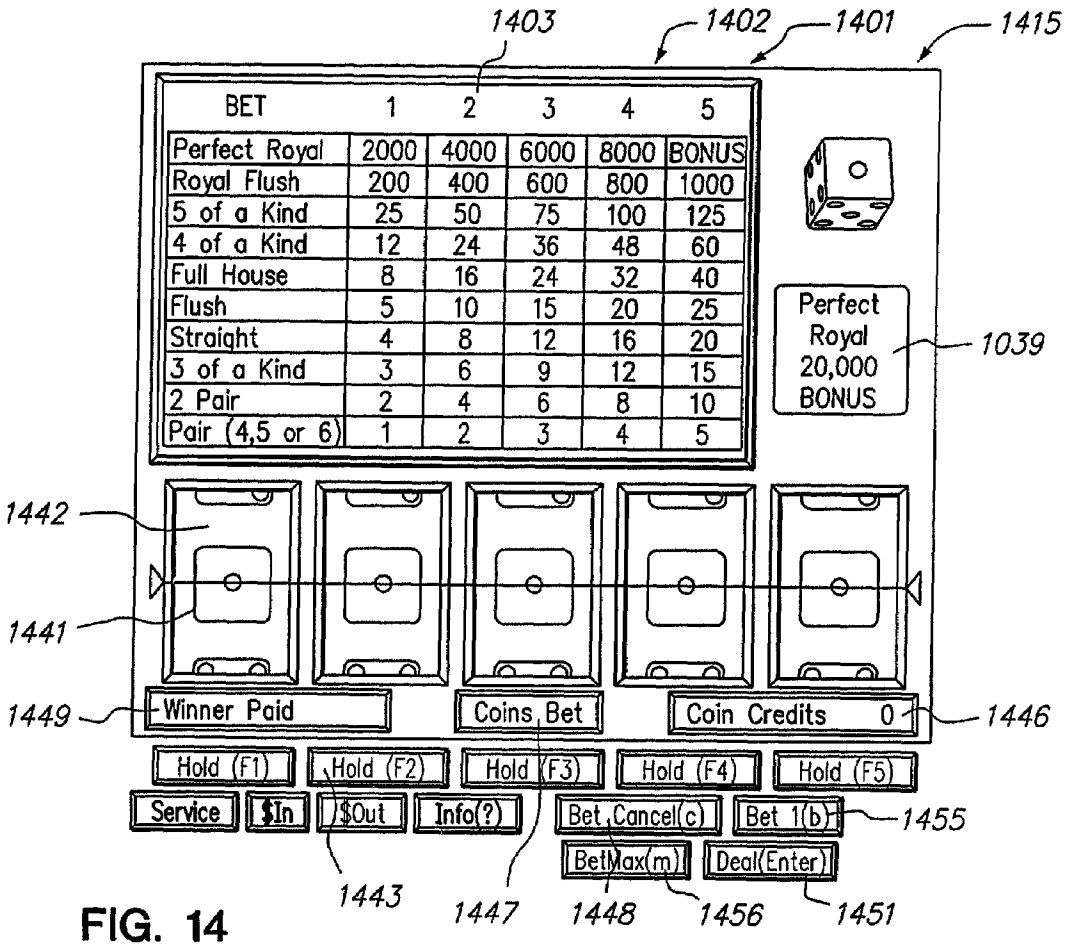
FIG. 14 illustrates a user-interface for an alternate game of the present invention.

FIG. 14 illustrates a touch sensitive display 1415 for implementing the game of Draw Dice. A payout table 1401 is provided in an upper left-hand corner. The payout table 1401 displays information regarding a particular winning combination and the payout for the combination.

The payout table 1401 includes six columns 1402. In a first column are listed a variety of particular combinations of indicia which may be obtained by play of the game described in more detail below. At a top of the remaining columns 1402 is a bet indicator 1403. Below each bet indicator 1403 is a payout amount which indicates the payout which will be awarded to a player for receiving a particular winning combination.

In the embodiment illustrated, the payout table 1401 displays payouts for receiving two pairs of 4's, 5's or 6's, 2 pair, 3 of a Kind, a Straight, a Flush, a Full House, a 4 of a Kind, a 5 of a Kind, a Royal Flush or a Perfect Royal. The significance of these combinations will be described below. Those of skill in the art will appreciate that other winning combinations may be provided, dependent upon the type of game which is implemented.

The display 1415 displays a plurality of indicia. In a preferred embodiment, the indicia include a number of simulated dice 1441 (or at least one face or side of a dice), in a similar manner to that described above. Below each simulated dice area 1441 is a hold button 1443. Each button 1443 is associated with one of the simulated dice 1441 and, as described in more detail below, arranged to permit a player to "hold" the a particular simulated dice 1441 in a fixed position.

A number of other display areas are provided for displaying game information. For example, a jackpot bonus value 1039 is displayed In order to play the game, the player is preferably required to place a wager, such as by providing coins, dollar bills or other credit. The player may bet or wager credits in single increments with a "Bet 1" button 1455, or may bet or wager a maximum allowed number of credits using a "Bet Max" button 1456. A credits area 1446 displays the credits belonging to the player. A coins bet area 1447 is provided for displaying the number of coins bet by a player on a given game.

A wide variety of other features may be provided. For example, a bet cancel button 1448 may be provided to permit a player to cancel their bet. Winnings may be displayed in a winner paid area 1449. A spin button 1451 is provided for permitting a player to effectuate a spin of the simulated dice 1441.

As described in more detail below, while in one arrangement the user interface or screen comprises a touch screen arranged to display information to a player and receive input therefrom, the user interface may comprise a combination of electrical and mechanical devices. For example, one or more of the buttons may comprise electromechanical buttons which may be depressed by a player. Those of skill in the art will appreciate that many players like the "tactile" feel of buttons as compared to touch screen input. Further, while the display areas are discussed separately, they may be integrated or be arranged in a number of ways other than as shown.

As described herein, a wide variety of combinations of indicia may be used to comprise the simulated dice 1441 or other indicia used in the game. In the preferred embodiment of Draw Dice, there are five reels 1442 or simulated reels. Each reel 1442 is capable of displaying symbols or indicia comprising or representing each of the six sides of a dice 1441. In a more preferred embodiment, each reel 1442 is capable of displaying each of the six sides of a dice in each of a plurality of colors or otherwise including distinguishing attributes or characteristics. In one embodiment, each reel 1442 is capable of displaying each of the six sides of a dice in each of three colors, such as red, white and blue.

In one embodiment, play of the game results in each reel 1442 displaying one indicia as part of a resulting combination of a spin or event. In one embodiment, a spin may result in a reel 1442 displaying a blank or non-dice indicia which comprises part of the results of a spin. The reel 1442 may also display indicia representing a side of a dice. As illustrated in FIG. 16, while at most only one side of a dice or other indicia (such as a blank space) comprises the result of a spin for purposes of determining if a winning combination has been received, other indicia may be displayed and be viewed by a player.

In the preferred embodiment, the ability of the reels 1442 to display each dice side in three different colors or with other distinguishing attributes creates the opportunity for unique winning combinations, as detailed in part above with respect to the payout table 1401. In one embodiment, a winning combination may comprise a pair of 5's, whether of the same or different colors. The opportunity for a flush exists, the flush comprising a combination of dice of the same color, regardless of value (i.e. regardless of which sides of the dice are shown). A royal flush comprises any combination of five simulated dice 1441 comprising each of the values 1–5 or 2–6, in any color. For example, a royal flush may comprise the dice combination 5 blue, 3 red, 1 white, 2 blue and 4 red. A perfect royal comprises any in sequence combination of simulated dice 1441 all of the same color. This requires that the simulated dice be displayed in forward or reverse order 1-2-3-4-5, 5-4-3-2-1, 2-3-4-5-6 or 6-5-4-3-2. Because each reel 1442 is capable of displaying the sides of the dice in three colors, there are 3×4, or 12, ways to achieve the perfect royal flush. In addition, as a result of the fact that five simulated dice may be displayed in combination, the opportunity exits for a 5 of a Kind comprising five simulated dice showing the same side or value. It will now be appreciated that by providing indicia comprising the sides of dice, and multiples of each side of dice having distinguishing attributes, and by providing several reels, a wide variety of unique combinations of indicia are provided which may comprise winning combinations. Further, because of the number of variable parameters, the payouts for winning combinations may be particularly selected. For example, a gaming manufacturer or establishment may wish to provide a particular percentage return on wagers placed, and may wish to pay winnings for combinations which are frequently received. In both cases, such can be achieved using the many variable parameters associated with the indicia and reels.

It will be appreciated that the number of duplicates of each side of a dice may vary, such as by having each reel 1442 capable of displaying two or four or more of each side of a dice. In such event, two colors or four or more colors may be used to distinguish the duplicates of the sides of the dice. As stated above, other distinguishing attributes may be provided, such as card suits, secondary values and the like. In one embodiment, there may be multiples of each side of a dice each having the same attribute. For example, each reel 1442 may select an indicia for display from a group which includes multiples of the same side of a dice in the same color. It will be appreciated that such combinations are useful in changing the odds of receiving a particular combination. As used herein, the term "selection" for purposes of determining which indicia is to be displayed is not limited to the stoppage of a reel 1442 having the indicia displayed, but may be simply as a result of a computer generation or selection (such as randomly or randomly with odds factors) of the indicia, and then the display of that indicia or the stoppage of the reel at a point displaying that indicia.

In one embodiment, upon a second spin or display of indicia, each reel 1442 is capable of redisplaying the same indicia (e.g. the group of indicia from which the indicia is selected upon the second spin is the same as upon the first spin). In another embodiment, once an indicia has been displayed by a reel 1442, upon a second spin it can not be re-displayed.

In one or more embodiments, the reels 1442 may be capable of displaying a wide variety of indicia other than the dice indicia 1441. As stated above, these indicia may comprise blank spaces or other non-dice indicia. In such event, the winning combinations may be varied. For example, the reels 1442 may be capable of displaying a colored spot, wherein that colored spot may be used to form a flush, but not a straight (since it has no associated value).

The present invention is not limited to the display of the dice side indicia by video means. The indicia may be displayed in a variety of manners, such as on a mechanical reel, by hologram or the like.

A method of play of the game of Draw Dice will be described with reference to FIG. 15. In a first step 1520, a player inserts a number of coins or provides other consideration for playing the game, such as dollar bills. Consideration may also comprise credits from a player card or the like.

In a step 1522, the player places a wager or bet. In one embodiment, this step comprises the player pressing the "Bet 1" button 1455 or the "Bet Max" button 1456. In one embodiment, a player is permitted to bet between one and five credits. Each credit may comprise any of a number of values, such as $0.05 U.S., $0.10 U.S., $0.25 U.S. or the like. The player may utilize the "Bet 1" button 1455 to place wagers incrementally, or press the "Bet Max" button 1456 to place a maximum bet.

In a step 1524 the player presses the spin button 1449. Upon depressing the spin button 1549, the reels 1442 spin or move (either by mechanical rotation or by computer generated graphics) and then stop. At this point, one symbol is displayed in association with each reel 1441. As described above, the symbol may comprise a "blank."

In a step 1526, the player elects to hold one or more of the reels 1442 and associated displayed dice or other indicia. In one embodiment, the player may elect to hold none, one or more or all of the reels 1442.

In a step 1528, the player spins the non-held reels 1442 a second time. This step may be initiated by the player depressing the spin button 1451. In this embodiment, each of the non-held reels 1442 is spun. In the event all of the reels 1442 have been held, then none of the reels spin.

In a step 1530, the outcome of the game after the second spin is analyzed in order to determine if a winning combination was received. If a winning combination was received, then winnings are awarded to the player in accordance with the payout table 1401, as per step S1532. If a winning combination was not received, then the game ends.

As illustrated, in the event the player placed the maximum bet and received a Perfect Royal combination, then the player is awarded a bonus amount. In a preferred embodiment, each time a player places a bet, the entire value of the bet is credited to the bonus or jackpot amount which may be won. In one embodiment, the bonus amount is initially credited with a base amount greater than the payout for the highest hand (i.e. Perfect Royal in this case) with the next smaller bet (i.e. 4 coins in this case). Thereafter, all additional bet monies are credited to the base amount, generating a total bonus or jackpot amount. In the event the player receives this predetermined winning hand with the maximum bet, the player is awarded the total bonus amount. It will be appreciated that this concept of generating a bonus or jackpot amount which increments by the fully value of the bet or wager may be applied to a wide variety of games.

In one embodiment of the invention, when a player holds a particular reel 1442, the display of that reel or indicia changes so that only the held indicia is displayed. This effect is illustrated in FIG. 16, where the player has elected to hold the fifth reel. As illustrated, when this occurs, the display of the reel 1442 changes so that only the held value is displayed. This visually indicates to the player that the reel 1442 has been held, and makes it easier for the player to see the resulting combination of indicia for determining whether a winning combination has been received.

In one embodiment of the invention, a multiplier (not illustrated) may be displayed. The multiplier may cause one or more amounts won by a player to be increased. For example, a multiplier value may be indicated on the display 1415. The value may comprise 2, 3, 4 or other values, including greater values, lesser values, and even 0. In the event a player obtains a particular predetermined combination, the value from the payout table 1401 for that win may be multiplied or increased by the multiplier value and then the new winning amount paid to the player. It will be appreciated that the multiplier value may be a value which is actually multiplied against the winning, or may comprise a value which is added to the base winning. In one embodiment, the multiplier value may be randomly selected from a plurality of value and then displayed, or may increase with time, or be selected in accordance with a variety of other criteria.

It will be appreciated that one or more aspects of the game of Draw Dice may be applied to the other embodiments of the game described herein. In addition, one or more of the embodiments of the other games of the invention may be applied to the game of Draw Dice.

It will be appreciated that games in accordance with the invention need not be the same as those described above. In one or more embodiments, the game includes the step of removing from the set of symbols at least one of the symbols, thereby reducing the possible number of combinations achievable thereafter by the player. Preferably, as the number of combinations which the player may achieve are reduced, the payout for achieving a winning combination increases. In the embodiments described above, the symbols or indicia are or include the sides or faces of dice. As target numbers are played, those number or indicia are removed from play. Of course, such a game may utilize other indicia. For example, such aspects of the game may be applied to a "slot-type" machine which includes reels displaying symbols such as cherries, 7s, bells and the like. As rounds, hands or the like of play are completed, the symbols may be removed randomly or in accordance with winnings combinations received by the player.

In one or more embodiments, features such as jackpots and bonuses may be omitted. On the other hand, any combination of jackpots or bonuses as described herein may be applied to such a game or any of the games herein.

In particular, a number of other alternate embodiments or alternate arrangements to the games other than as described above are contemplated, and it will be appreciated that one or more of the features described herein, whether or not described with a particular game, may be applied to another. By way of example, a player may be permitted to "hold" the simulated dice in the game of Z Sixty Six as well as in the games of Check and Z Hot Dice. In addition, the replacement symbols utilized in the games of Check and Z Sixty Six may, as in the case of Z Hot Dice, comprise symbols which either prevent a player from obtaining what appears to be a unique or winning combination of replacement symbols, or may comprise a combination of symbols which permits a player to receive a winning combination of replacement symbols.

In any of the embodiments, the replacement symbols may comprise no symbol at all, but comprise a blank or an indicia which otherwise will not contribute to a predetermined winning combination. A variety of criteria may be applied to the games of the invention for determining when a player has qualified or completed a round or category. For example, as described above, a player may be required to receive at least 3 of a Kind to start play. In one or more embodiments, a player may be required to play until they achieve at least a 3 of a Kind before any score is attributed to a particular category (i.e. not just the first). For example, after completing a first target number if on the next two spins the player achieves at most a pair, the player may be required to place an additional wager and utilize two more spins in an attempt to gain at least 3 of a Kind. In other embodiments, such as described above, the player may receive a zero score if they do not receive a winning combination on each set of spins. For example, after completing a first target number or category, if on the next two spins a player receives only a pair of the same indicia, the score for that category may be credited as zero, and then the player forced to move to the next target number or category.

In one or more embodiments of the invention, a player may be declared a winner for receiving other combinations of symbols/events. For example, a player may be paid a special award or winning or receiving at least 4 of a Kind of each target number. For example, in the embodiment illustrated in FIG. 12, an additional column 1202 may be provided which indicates the amount of a bonus the player may receive for obtaining a 3 of a Kind, 4 of a Kind or the like of each of the target numbers in the other columns. Such a bonus may be utilized in addition to a "per-column" bonus as described above in the game of Z Jackpot Dice or the jackpot as described herein.

In one or more embodiments of the invention, may as described above with respect to the game of Check, not include the step of removing one or more of the symbols as game progresses. Instead, the player may continue play, attempting to achieve winning combinations, jackpots, bonuses (or other of the features/elements) using the same set of symbols as play progresses.

In an alternative embodiment, the games of Check, Z Sixty Six, Z Hot Dice, Z Jackpot Dice or Draw Dice or other game variations described herein may be played over the Internet or other wired/wireless communications network/system among a random collection of players at diverse locations, forming a virtual wide area network of such competing players.

In alternative embodiments, numerous other wagering games, including but not limited to Poker Dice, and Aces in the Pot may be configured for play and display on the display 115, and played over a local area computer network 401 or wide area computer network 501 of computer-controlled slot machines 101.

In accordance with one or more embodiments of the invention, there is a method of playing a game and a system for presenting a game including multiple players. Several arrangements of machines 101 in a network configuration for use in presenting such a multi-player game are illustrated in FIGS. 3 and 4.

In a preferred embodiment of the invention, the process of game play of games played by more than one player is linked or commonly controlled. In one embodiment, a common controller controls the or governs the play of the multiple games. As one example, the common controller may comprise a server 303 such as illustrated in FIG. 3.

In one embodiment, the controller provides control information to two or more computer-controlled gaming machines (such as machines 101 in FIG. 3). The control information may comprise a control signal transmitted over a network (or other communication link) connecting the controller and the gaming machines, such as dedicated lines 311 as illustrated in FIG. 3.

In one or more embodiments, based on the control information, at least one or more events associated with or regarding the play of the games by the one or more players is dictated. In one embodiment, the one or more events comprise a game start, game stop or individual game play steps. In one or more embodiments, the aspect of these one or more events which is dictated comprises the timing of the event. The dictated timing may comprise a precise time or a time window or window by which an event must occur, as detailed below.

A preferred embodiment of the invention as applied to the game of Z Hot Dice will be described with reference to FIG. 11. In one embodiment, each of the players who wish to participate in the game provide credits. Preferably, the common controller generates a signal which defines the start of the game, as in step 1122. In one embodiment, the controller sends a signal representing information to each gaming machine regarding how soon the game will begin. This information may comprise a visible timer, time clock, graph or other indicator which is displayed to the player of each gaming machine regarding the time at which the game will begin. For example, the controller may send information which is continuously updated regarding the time until the game is to begin. In one or more embodiments, each player wishing to participate in the game must have their credits provided before the game starts.

In one embodiment, at the start of the game the controller sends a signal to each gaming device polling that device for information regarding credits placed. If the gaming device sends back a signal indicating that credits have been placed, then the controller may send a signal to the gaming device permitting further input to the player and indicating to the player that they are permitted to play the game. If the gaming device sends back a signal indicating that credits have not been placed, then the controller may send a signal to the gaming device preventing the gaming device from accepting input from a player until the completion of the pending game. The signal may also cause the gaming device to present information to the player that the gaming device is presently not usable.

Once the game starts, the controller sends a control signal to each gaming machine instructing the player to place their bet, as in step 1124. In one or more embodiments, the controller is arranged to generate and send information regarding a period of time during which the player is permitted to take action. For example, the controller may send clock or timer data, as described below, which indicates to a player how long, or how much longer, they have to take the appropriate action.

Once the time period has ended, only players who placed bets are allowed to continue. Next, the controller is either arranged to cause the dice to spin (as in step 1126) or allow the player to effectuate the spin. The controller next sends a signal regarding a time during which each player must make their section of held dice and the indicated target, as in steps 1128 and 1130. When this time period expires, the controller either causes the respin or provides a period of time during which each player may respin.

The win totals are then posted and the controller may dictate a period of time during which a player may leave the game or continue with the game by placing an additional bet (as in steps 1140, 1142 and 1144.

In one or more embodiments of the invention, the multiple players play against one another in an attempt to win a prize. In such an embodiment, the outcome of each player's game may be compared to the outcome of all other players' games for determining the winner of the multi-player event. For example, in the example of Z Hot Dice, each player may attempt to obtain the highest total score (see element 1039 in FIG. 10). The player who receives the highest total score for a particular game may be awarded a jackpot. Other criteria may be utilized for determining one or more winners of the multi-player game, such as lowest score or the highest three scores. In a preferred embodiment, a player is awarded winnings based on the outcome of their game, regardless of whether their result qualified them for winnings when compared to all other players.

In one embodiment other prizes may be awarded based on other criteria. For example, the player(s) who receives the highest score during a particular round (i.e. a pair of spins in an attempt to fill a single category) may be awarded a prize, such as money or bonus points towards their total score.

As one aspect of the invention, the order or sequence of the play of the game by a plurality of players is generally synchronized or otherwise controlled. In the embodiment just described, the timing of each step of the game as played by the players is controlled from a time perspective. It will be appreciated that only the play of the game broadly need be controlled from a time perspective. For example, the controller may define a window during which all players are entitled to a play an entire instance of the game.

As indicated, in one or more embodiments, the controller controls the time or time periods for certain activities to occur, such as a player input. One or more embodiments of the invention include a method and system for providing time information to a player. In an embodiment where a player is permitted a time period during which an activity must occur in order for the player to proceed or for the player's act/selection to occur, time period information may be displayed. The time period information may comprise numeric time information, graphical information or other forms of information recognizable by a player. For example, the information may comprise a pie-type graph with remaining time indicated as one portion of the graph illustrated in one color and expired time indicated as a portion of the graph in another color.

In one or more embodiments, audible or visible alarms or alerts may be provided to a player. For example, an area of the display may flash and indicate to a player that the player only has a short period of time remaining (such as 1 minute, 15 seconds or the like) to take action.

In one or more embodiments, when the player takes action, the time indicator may be removed or other information displayed to the player indicating that the player's action/selection has been accepted. In one or more embodiments, certain actions by a player may be rescinded and a new action/selection permitted. For example, a player may elect to rescind particular held dice and hold different dice, so long as such action occurs during the particular time period or by the time indicated.

In one or more embodiments, a method of game play is disclosed in which one or more aspects of game play must occur within a particular time period or before a certain time. If one or more of the acts or inputs are not provided within the required time, the player may be prevented from continuing further and completing the game.

Selections by a player, game state information and similar information is preferably forwarded from each gaming device or machine to the controller. In the event a player does not take the necessary action within the required time, then the controller may be adapted to send a signal to the gaming machine to cause the gaming machine to not accept input from the player for proceeding in game play. This same signal may cause the display of information to the player that the player did not act in sufficient time and that the player is not permitted to continue playing.

In one or more embodiments, a player's bet may be refunded if the player does not take action within the required time. For example, if a player places a bet but does not then spin the reels within the required time, the player's bet may be credited back or refunded. Preferably, the player's bet is not refunded if the player fails to provide input after one or more of the steps which define the outcome of the game occurs. For example, a player may not be entitled to a refund of their bet if after a spin of the dice the player does not hold one or more dice, as such may allow the player to take advantage of the casino/house by ceasing to act except where a favorable combination of dice are received on the first spin.

In one or more embodiments of the invention, the multiple gaming machines which are used to present the games to the multiple players may be located adjacent to one another or located remote from one another. For example, a plurality of gaming machines associated with a controller may be located in a particular room or rooms of a casino. On the other hand, the gaming machines may be associated with a local or wide area network allowing the gaming machines to be located remote from one another and/or the controller. For example, one or more of the gaming machines may be located in a first casino and other of the gaming machines located in an entirely different casino.

In one or more embodiments, the controller need not be entirely computer. As one aspect of the invention, a human "caller" may be involved in the control of the multi-player game. The caller may provide information to players, such as instructions to take particular actions (e.g. "place bets," "spin," "hold dice"). The caller may also provide time information and generate or cause the generation of a control signal event. For example, the caller may cause the initiation of a time period via a computer or other device associated with the controller or providing input directly to the controller. The caller may provide an input to the controller causing the controller to start a period of time running or set a time by which an event is to occur. In this arrangement, the caller may provide gaps of time between events. For example, the caller may announce a two minute period of time during which players are to engage in their first spin. The caller may then allow a minute or two to lapse before starting a two minute time period during which the players are required to make dice hold selections.

As one aspect of the invention, the caller may be provided with information regarding player activities, such as the total number of players and the number of players having made and/or not made a selection or engaged in the require activity. This information may be used by the caller to prompt players to take action or permit an extension of the time period for taking action.

A caller may be utilized even when the gaming machines are located remotely from one another. In one embodiment, the image of the caller may be transmitted to each player, such as by a separate communication channel and one or more displays which are visible to players of the gaming machines, or even by picture-in-picture display of the information to the player directly at the gaming machine. In one or more other embodiments, a caller may be utilized even though the caller is not present or visible to the player. For example, a caller may be used to controller the game play, such as starting and stopping time periods, which time periods are only indicated to a player.

The arrangement of the system including the one or more devices for implementing a method of multi-player game play in accordance with the invention may vary. As indicated, in one embodiment, a plurality of gaming machines or devices are associated with at least one controller via one or more communication pathways. In one embodiment, each gaming device may be provided with its own gaming controller, such as including a random number generator for generating game outcomes. The main controller may provide control information to each gaming machine, and each gaming machine may be arranged to generate (within the control of the main controller) the game information specific to that gaming machine, such as the outcome of a particular spin.

In another embodiment, all or substantially all of the game play information may be generated remotely from the gaming machine. For example, the controller including a random number generator for generating a plurality of game outcomes for the differing gaming machines. This game play information may then be transmitted to each particular gaming machine.

The game which is played by multiple players may comprise a wide variety of games other than the game of Z Hot Dice as described above. For example, any of the games herein may be implemented for multi-player play. Other games which are presently known may also be configured for play in accordance with the method of the invention, such as the game of video poker.

In one or more embodiments of the invention, information regarding each player's own game play, including prior game play, and others' game play may be presented. In one embodiment, information regarding a player's previous game play, such as previous resulting dice combinations and awarded points may be displayed. Such information may be useful to the player in assessing how to proceed with a present game or round of a game. In one embodiment, information regarding other players' game results may be displayed to a player. For example, in one embodiment, at the end of each round of the game of Z Hot Dice, the player or players having receiving the highest points for the last round and players having the highest total points for rounds may be displayed to other players. In this manner, a player may compare their total points to those of other players for determining where they stand in an attempt to win the game against the other players.

In one or more embodiments, the multiple players may play against the house, such as a computer generated game result. In one such embodiment as implemented to the game of Z Hot Dice, the controller may play a game and generate results of spins, fill categories and achieve point totals associated with those categories and total points. In one embodiment, prizes or awards may be provided to a player who obtains a greater total of points than the house. The size of the prize awarded may depend on the number of players who are successful in beating the house. In this embodiment, the house's dice hands and the house point totals may be displayed to all players for their observation.

The multi-player game of the invention has many unique aspects and advantages. First, a multi-player game is provided. As is known, current gaming devices are arranged to be played by single players against the house, lending to a very solitary form of play. In accordance with the invention, there is provided a method of presenting a game on a gaming device which is associated with many other players. A player of the gaming device feels attached or associated with these other players, even though they may be located remote from one another. Of course, in one or more embodiments, a plurality of gaming devices may be located adjacent one another, whereby players located in close proximity to one another all participate in the same game, lending to substantial comradery and interaction.

In accordance with the invention there is provided a multi-player game where each player's luck and/or skill in playing an event of the game is outcome determinative as to the overall game. In one embodiment, each player is in competition with the others, attempting to gain a highest score or other result which entitles them to be declared a winner of the game. In another embodiment, each player is in competition with the house, attempting to beat the house and be declared a winner. Regardless, a player's decisions, such as which dice to hold, dictate in part the outcome of the game for the player.

As used herein, the term "computer-controlled slot machine" denotes a computer controlled machine which facilitates wagering, which generally requires the input of money in order to be operated, and which outputs money in response to the achievement of winning wagering results. It will be appreciated that one or more aspects of the machine, including the interface or what is referred to herein as the touch sensitive display may be electrical, mechanical and/or electro-mechanical in nature. For example, while the buttons may comprise touch-sensitive areas of a display, they may comprise electromechanical buttons which are activated by mechanical movement (such as depression) by a player. In addition, the simulated dice may, instead of comprising solely computer generated images, actually comprise dice or dice faces mounted on a rotating reel and arranged to stop in controlled positions. The simulated dice or other symbols may be provided in a variety of other manners, such as by laser light generation. The dice or other symbols are referred to in certain instances as "simulated," but could actually comprise faces of actual physical dice. The displays and display areas may comprise CRT type displays, LCD or LED displays or any other means for displaying information now known or later developed.

Of course, the present invention is not limited to the generation and display of images in the form of the video simulated dice. In other embodiments, other images are generated and displayed in the course of game play. For example, in one embodiment, the images generated and displayed are in the form of different colors. In another embodiment, graphical representations of different types of fruit are generated and displayed. In yet another embodiment, roman numerals are utilized. The generation and subsequent display of any image in a set of at least two display areas in the course of game play is within the scope of the present invention.

It will be appreciated that various features of the present invention may be applied to existing games or games later developed. For example, the feature of permitting a player to "pause" a game and then continue the game at one or one of several gaming machines may be applied to present or future games. For example, the pause feature may be applied to video poker games or the like. Likewise, the feature of having bonuses associated with more than one event and/or cumulative bonuses may be applied to present or future games. For example, a typical slot machine may be configured to include particular winning combinations which, when received by a player, entitle the player to a first bonus. Additional bonuses may be won by receiving other combinations, and a total bonus may be awarded for receiving yet another special combination.

Another feature which may be applied to the games of the invention involves the duplication of displayed dice or symbols after a spin into additional "hands." For example, after a first spin, a player may elect to hold a target number which is displayed three times (i.e. a 3 of a Kind). These same symbols may then be displayed in one or more additional rows or hands. The player may then be permitted to spin again, in an attempt to achieve a winning combination in any or all of the hands or rows. In the example given, either 2 or 3 additional symbols (depending on whether each row had a maximum of 5 or 6 symbols) would be displayed randomly to fill each row. The combination of the newly displayed symbols and the three originally held symbols would then be evaluated to determine if the player had won. The player may be awarded a payout for each winning row, or only for rows for which the player placed a wager. Alternatively, the player might be permitted to retain the highest winning combination from the several rows for determining the payout to be awarded in the column for that target number.

In one or more embodiments of the invention, such as illustrated in FIG. 6, a gaming machine in accordance with the invention may include a random number generator. The random number generator is adapted to produce random numbers which represent the outcome of the rolls of the dice or other symbols. For example, the numbers 1 2 4 3 5 5 may be randomly generated representing the outcome of a roll of six dice. These numbers may correspond to the side of the die bearing the symbols 1 2 4 3 5 5.

In another embodiment of the invention, permutations of roll outcomes are stored in a memory. One of the permutations is selected in order to determine the outcome of a roll. In one embodiment, the selection is random. In one embodiment, particular permutations may be removed depending on the status of the game. For example, if a player has played the target number 2, then all permutations containing the number 2 may be removed from selection. In one embodiment, the permutations may be associated with registers or memory locations. Selections of outcomes may then be made from memory locations. For example, permutations of outcomes without 2's may be located in one memory location, and outcomes without 3's may be located in another memory location.

Another embodiment of a game in accordance with the invention will be described with reference where applicable to FIG. 17. This game is referred to herein as the game of Zingo.

Figure 17:
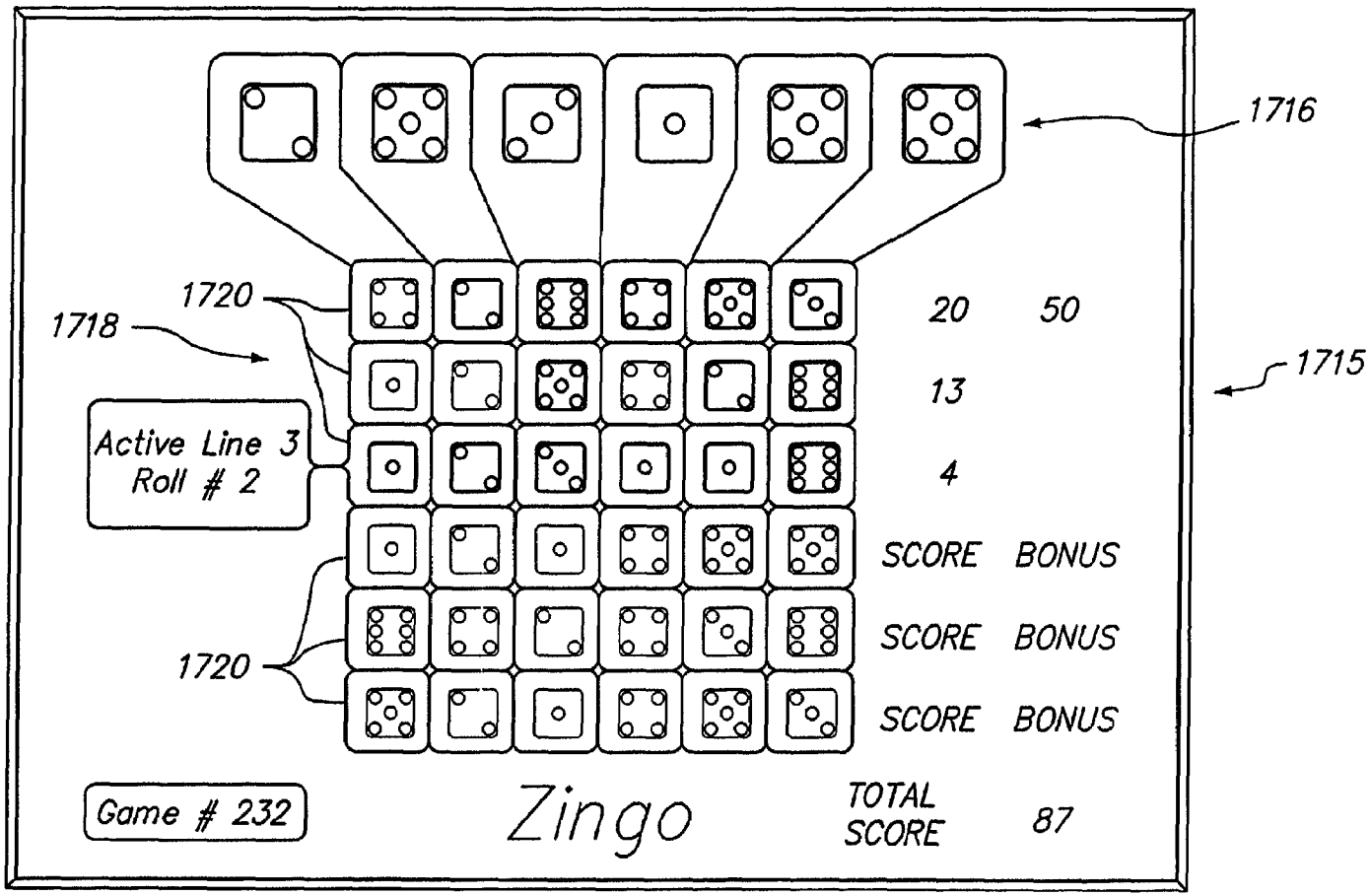
FIG. 17 illustrates a user-interface for an alternate game and method of playing a game in accordance with the invention.

FIG. 17 illustrates a touch sensitive display 1715 for implementing the game of Zingo. A first area 1716 of the display 1715 is arranged to display a set of symbols or indicia. In one embodiment, the symbols comprise the sides of a dice. A second area 1718 of the display 1715 is arranged to display one or more combinations of player symbols. The displayed symbols preferably comprise combinations of the symbols which may be displayed in the first area 1716. In one embodiment, the combinations of player symbols are arranged into lines or rows 1720, each line or row having the same number of positions for display of symbols as may be displayed in the first area. As illustrated, six positions are provided in the first area 1716 for displaying a combination of six symbols. Preferably, the second area 1718 is thus arranged to display rows of six symbols as well.

As described in more detail below, as one object of the invention, a player attempts to match as many of the symbols in the second area 1718 with symbols which are displayed in the first area 1716. The symbols displayed in the first area 1716 may be referred to as the game, house, post, called or other symbols, as such symbols form a set of symbols over which the player has no control but attempts to match to their symbols in the second area 1718. As detailed below, in one embodiment, these symbols change during the course of a game. The symbols in the second area 1718 may be referred to as the player's symbols, main or other symbols. As detailed below, in one embodiment, these symbols remain the same during the course of a game.

As stated, the symbols which may be displayed in either area preferably comprise each side or face of a dice. Thus, each position of first area 1716 is capable of displaying each of the six sides of a dice. In other embodiments of the invention, other symbols may be displayed. For example, as detailed above in conjunction with the description of other games herein, the symbols or indicia may comprise pictures of fruit, letters, numbers or representations of other elements/items. The symbols may be distinguished by color (such as red, white and blue as described above) or in other manners. The total number of different symbols which may be displayed at each position is preferably at least two, and may be more or less than 6. In one embodiment, the number of symbols which may be displayed at each position may vary from another position.

Preferably, the number of positions of symbols in each row or line 1720 of symbols displayed in the second area 1718 is the same as the number of positions of symbols in the first area 1716. This number of positions may comprise 6, but may also comprise less than six or more than six. In a preferred embodiment, 6 positions are chosen when the symbols to be displayed comprise combinations of the 6 sides of a dice.

In one embodiment of the invention, a plurality of combinations of symbols are displayed in the second area 1718. In the embodiment illustrated, six rows 1720 of symbol combinations are displayed. Preferably, each row displays a different combination of symbols.

A method of playing a game will now be described with reference to FIG. 17. In one embodiment, the game is arranged as a wager-type game in which a player is required to "buy-in" to the game, such as by placing a bet. When the game is presented on a display 1715, the display may be associated with a gaming machine including a wager-accepting device, such as a coin or bill acceptor. As described below, the player need not provide payment in this form or at the time the game starts. For example, when playing a "paper" version of the game, the player may purchase a game card on which player indicia are printed.

In accordance with one embodiment of the invention, the method thus includes the step of a player placing a wager or otherwise establishing entitlement to play the game. In a next step, a combination of symbols is displayed in the first area 1716. In a preferred embodiment, the symbols which are displayed are selected randomly. The symbols displayed in the first area 1716 are compared to the symbols displayed in the first row in the second area 1718. If any of the symbols are the same, in one embodiment, a "match" is declared. In the preferred embodiment, a match only occurs if the symbol which is displayed in the first area 1716 is the same as and in the same position as the symbol displayed in the second area 1718.

In one embodiment, if a match results, then the symbol in the row in the second area 1718 is highlighted or another indication is provided to the player of the match. In one embodiment, the indication of match occurs by a computer comparing the displayed symbols. In another embodiment, the player is required to provide input for a match, such as by pressing a "hold" button associated with the position or touching the area of the display where the symbol is displayed.

In the preferred embodiment of the invention, a player receives a score associated with a match. In one embodiment, the score comprises points or another numerical value. In one embodiment, the points comprise the points of the matched dice. The player's score associated with a particular row is displayed on the display 1715.

In a preferred embodiment, a player has three opportunities to match the symbols displayed in a row of the second area 1718 with symbols displayed in the first area 1716. Thus, in a next step, a new or next set of symbols is displayed in the first area 1716. Each display of a new set or combination of symbols in the first area 1716 may be referred to as a "roll" or "spin." After the second spin or roll, the symbols displayed in the first area 1716 are compared to those displayed in the same row of the second area 1718, and matches are determined. In a preferred embodiment, once a symbol in the row of the second area 1718 has been matched, it does not need to be matched again during later spins or rolls. A player attempts to match each of the symbols in the row with a symbol displayed in the first area 1716 at least once during the course of the three (or other number) of rolls. If new matches result from the second spin or roll, then the player's score is updated. A new (i.e. third) spin or roll is initiated. The resulting displayed symbols are again compared.

In one embodiment, a round of play comprises the display of one or more sets of symbols in the first area 1716 for comparison with the symbols displayed in the second area 1718. In a preferred embodiment, during a round three sets of symbols displayed in the first area 1716 are compared against symbols in the second area 1718. The player's total for the round may then be used to determine if the player is a winner of the game, such as for entitlement to an award.

In a preferred embodiment, as illustrated in FIG. 17, however, the game includes more than one round. In one embodiment, the number of rounds is dependent upon the number of groupings (rows 1720 in the embodiment illustrated) of symbols in the second area 1718 to which symbols are compared from the first area 1716. In each round, the game continues in similar fashion to that described above until the player has completed play with respect to each row or combination of symbols in the second area 1718. In the embodiment illustrated, as a result of the play of the first round, the player matched the dice symbols 2, 6, 4, 5, 3 during one or more of the rolls or spins of the symbols in the first area 1716. This resulted in a player receiving 20 points: the sum of the faces of the dice. In the second round, the player matched the dice symbols 5, 2, 6 for a score of 13.

In a preferred embodiment, the display 1715 is arranged to display a player's score for each row and, in one or more embodiments, any bonus received. In one embodiment, in similar fashion to the game of Draw Dice previously described, a player may receive a bonus score for matching at least a specified minimum number of the symbols, or a specified minimum number of symbols upon the first or by the second roll or spin. For example, a player may be awarded a 50 point bonus for matching five symbols upon the first spin, as illustrated in FIG. 17.

In a preferred embodiment, the display 1715 displays a total score comprising the sum of the score for each row and the bonus (if any) for each row.

In one embodiment, a player is rewarded an award or declared a winner based upon the player's score. A player may be declared a winner if the player's score is greater than a predetermined score. In another embodiment, the player may be declared a winner based upon the player's score as compared to the scores of other players or the house.

In one or more embodiments, the game is implemented as a multi-player game. In one embodiment, the players may play the game at the same or different times, and one or more players may be awarded winnings as the end of a predetermined time. Such an arrangement is described above, wherein the players achieving the highest scores during a predetermined period of time, such as a week, may be declared winners. In another embodiment, the game may be played by several players simultaneously, such as described above.

In the multi-player version of the game it is preferred that each player have the opportunity to obtain the same highest score. On the other hand, it is preferred that the players not play the exact same form of the game when playing the game simultaneously, since each players game outcome would be the same. In an embodiment such as illustrated in FIG. 17, it is desired that each player play a game in which the symbols displayed in the second area have the same point total, but comprise different combinations of symbols. In the embodiment illustrated where a matrix of 6 rows of 6 symbols (i.e. 36 symbols) of sides of dice are displayed, the sum of the faces may comprise 126. In that event, there are over 1000 different combinations of symbols which may be displayed in the matrix, such that at least one thousand players may play the game at the same time using a unique combination of symbols. Of course, a greater or lesser number of combinations may result when a greater or lesser number of symbols is used.

Figure 18:
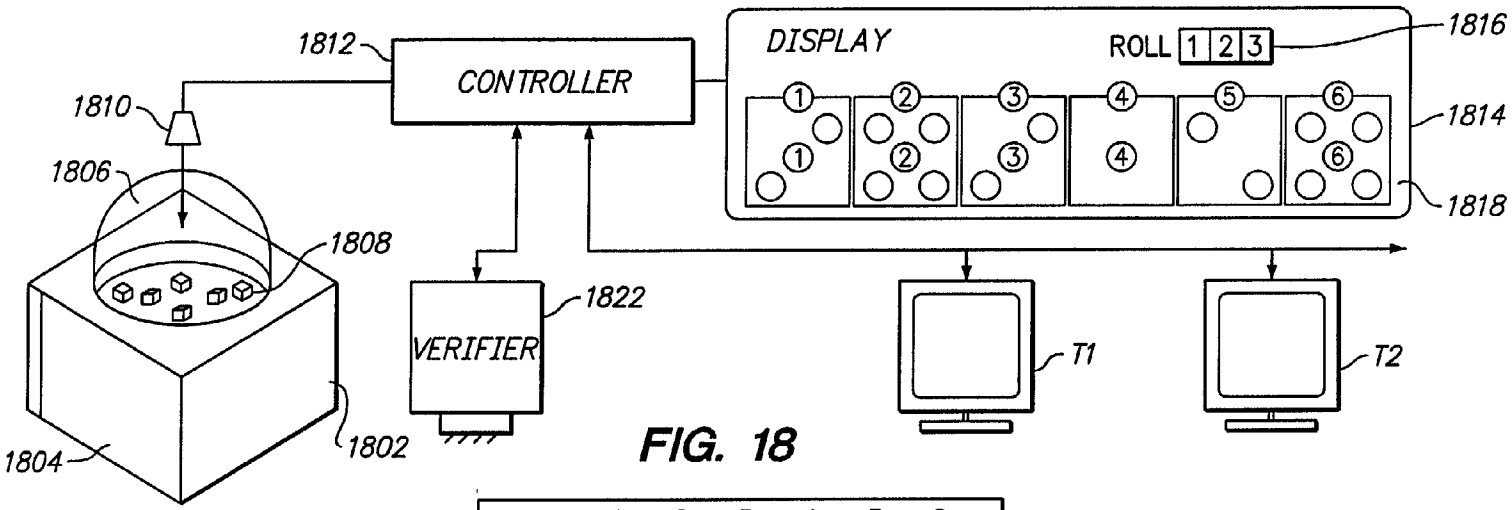
FIG. 18 illustrates a system for playing one or more games, including games of the present invention.

Another embodiment of an arrangement of apparatus for presenting the game of Zingo, and additional aspects and variation of such a game, is illustrated in FIG. 18. As indicated above, in one embodiment, the dice which are rolled and used to determine a match may be computer generated. A random number generator may generate random numbers, those numbers representative of a dice orientation or side. In the embodiment just described, five random numbers may be generated representing five dice sides used in each roll/round.

Referring to FIG. 18, a mechanical device is used to produce the outcome of the roll. In one embodiment, a mechanical roller 1802 is provided. The roller 1802 includes a housing 1804 supporting a compartment 1806. One or more dice 1808 are located in the compartment 1806. In one embodiment, the compartment 1806 has one or more portions through which the dice 1808 therein may be viewed. As illustrated, the compartment 1806 has a top formed from a generally hemi-spherical, transparent dome.

Means are provided for moving the dice 1808 in the container 1806. This means may comprise one or more of a wide variety of elements. For example, in one embodiment, the means may comprise a motor for vibrating all or a portion of the container 1806 or the dice 1808 therein. Other means may comprise air, or other mechanical or electromechanical devices.

Means are provided for determining the outcome of a roll of the dice 1808. In one embodiment, the means comprises an image collection device 1810. The image collection device 1810 may comprise a camera or other device arranged to collect image information regarding the one or more dice 1808. A controller utilizes the collected image information to determine the outcome of the roll, i.e. the side of each dice 1808 which is facing upwardly after the roll. In one embodiment, the controller may be associated with the roller 1802 or the image collection device 1810. In the embodiment illustrated, the controller is part of a master controller 1812.

The means for determining the outcome of the roll of the dice 1808 may comprise other than a camera. The means may comprise any of a wide variety of device for reading machine readable code. For example, the dice 1808 may be imprinted with bar codes representing the indicia 1, 2, 3, 4, 5, and 6, and the reader may comprise a bar code reader. To avoid tampering, the dice 1808 may be printed with indicia readable only under exposure to ultraviolet light.

The master controller 1812 may comprise a wide variety of hardware and/or software. The master controller 1812 may be similar to computer 303 illustrated in FIG. 3. In general, the master controller 1812 is arranged to receive and send information, including signals.

In one embodiment, the master controller 1812 controls a display 1814. The display 1814 may be of a variety of types, such as CRT, LCD or the like. In one embodiment, the display 1814 is configured to display information regarding a particular round or roll 1816 and the images of one or more dice 1818 or representations thereof. In one embodiment, the information regarding a particular round or roll 1816 comprises a textual identifier "ROLL" and an illuminated or displayed number 1,2 or 3. The images of dice 1818 comprise computer generated images of one or more dice having the orientation as indicated by the controller 1812 via the reader 1810. Instead of computer generated image data, the image collection device 1810 may transmit actual image data which is then displayed at the display 1814.

In one embodiment, a plurality of gaming terminals T1, T2, etc. are in communication with the controller 1812. Each terminal T1, T2, etc. is adapted to display game information, such as in the format illustrated in FIG. 17. As illustrated in FIG. 17 and described above, this information may comprise the images of the rolled (or simulated rolled) dice, and a plurality of indicia to be matched with the rolled dice.

Figure 19:
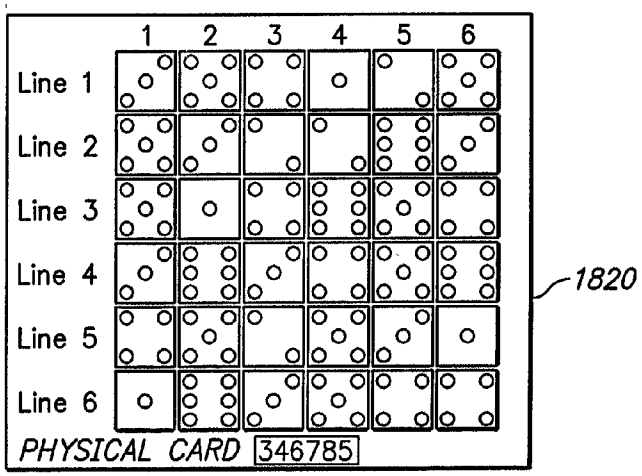
FIG. 19 illustrates a gaming card for use in playing one or more games of the invention.

In one embodiment of the invention, the game of Zingo may be played using physical cards, such as printed sheets. An embodiment of a card 1820 is illustrated in FIG. 19. As illustrated, the card 1820 displays a plurality of indicia. Preferably, the arrangement of the indicia comprises randomly dispersed game indicia, i.e. the sides of dice in this embodiment.

The card 1820 may be provided with a card number or other identifier. This identifier may be associated with a file, data record or the like which is stored at or accessible by the controller 1812. The file or data record preferably contains information regarding the card, including the indicia printed on the card. Preferably, the file or data record also includes information regarding the status of the card, such as the card being issued or revoked. In addition, when the card is issued and used in game play, main indicia (rolled and displayed) may be computer matched against the indicia on the card 1820. In this manner, the controller 1812 may track the play of each card in mirror fashion to the actual play by the player(s).

Referring again to FIG. 18, in one embodiment, a verifier 1822 is associated with the controller 1812. The verifier 1822 is arranged to accept input regarding a card 1820. In one embodiment, the verifier 1822 includes input means, such as a keyboard, bar code reader, optical scanner or any of a variety of other input devices. In one embodiment, the verifier 1822 is used to accept information which is used to verify a card, including the status of the card. The status information may include the fact the card is issued and valid, that the card is unauthorized, that a winning combination of indicia has been received in relation to the indicia displayed on the card, or other information.

In one embodiment, information regarding the card 1820, such as the identifier, is provided to the verifier 1822. This information is transmitted to the controller 1812. The controller 1812 utilizes the identification information to access the data file regarding the card. Status information may then be obtained. For example, a player may indicate that he or she has received a winning result while playing a particular card. A host may use the verifier to confirm that the player has indeed won. As indicated, the controller 1812 preferably accesses the card file and, with the card file being updated with matches showing a win, send a signal back to the verifier 1822 that the card is a winner.

The verifier 1822 may also be used to place a card 1820 in play. For example, a plurality of cards may be printed. A player may be required to purchase each card to be played, in the form of a wager or ante. When a card is purchased, the host may scan the card or otherwise input the identifier of the card. The identifier is then used by the controller 1812 to update the status of the card at its card file. In addition, when updating the status as "issued," the controller 1812 may also cause displayed indicia to be compared against those of the card for determining if a match occurs.

The play of the game of Zingo using the apparatus and system as described is similar to that described above. As indicated, there are a wide variety of options for play, and a wide variety of other systems and devices which may be used to present the game.

The game in principal may be played in a variety of formats and including a variety of options. In one embodiment, the spun or rolled symbols need not be displayed on the same display as the player's symbols. For example, the outcome of a roll or spin may be displayed on another device or in another area, such as on a separate monitor or projector. In one embodiment, the game may be implemented in a slot machine type format including reels, where the reels display the symbols and the reels rotate to represent each spin or roll. The spinning of the reels may be initiated remotely, and in a multi-player game format, a signal may be sent to each machine causing the reels to rotate and all stop in the same position.

In one embodiment, the player's symbols may be displayed in a manner other than by a physical card or touch-sensitive or other video type display. For example, the symbols may be associated with reels as well. At the beginning of a game, the reels may all rotate and stop to display the matrix of indicia which comprise the symbols of the second area. In another embodiment, the symbols may be printed on cards or similar members. In such event, the outcome of the game may require manual confirmation of the matches.

In one embodiment the player's symbols need not comprise a matrix of symbols. Instead, the symbols may be arranged in a variety of fashions, such as an X or T or the like. In this embodiment, instead of or in addition to providing a score for matched symbols, the goal may be to attempt to match each and every symbol of the configuration. The winner of the game may be the player or players who matches all of the symbols of the pattern.

The combinations of symbols may also be arranged in vertical columns. Not all of the symbols need to be displayed at the same time. For example, in one embodiment a first row of symbols may be displayed and the other five rows of symbols may remain blank until the successive rounds of the game progress.

In one embodiment, a player may be provided a bonus score or award if the player receives a predetermined pattern of symbols from a group of symbols. For example, while playing a game comprising a matrix of 36 symbols, a player may be provided a bonus score or award for matching the symbols forming an X through the matrix. For example, FIG. 19 illustrates a configuration of indicia arranged in a 6×6 matrix. The player of the card is a winner if the player matches the indicia which are highlighted and arranged in the pattern of an "I."

In one or more embodiments, bonuses or other events and awards may be provided, including one or more of the bonus events described above. For example, with reference to the embodiment illustrated in FIG. 17, a player may be provided a bonus score or award if the player matches at least 4 symbols of each of the 6 rows. A player may be awarded a bonus score or award for matching every symbol.

In one embodiment, a player may be permitted to play one or more wild cards. The wildcards may be placed anywhere in the combination of player symbols and constitutes an automatic match, regardless of whether the symbol is actually matched during play of the game. Preferably, the player must indicate the location of the wildcard(s) before play of the game begins.

As indicated above, in one embodiment of the invention, the game is divided into rounds including three rolls per line of indicia to be matched. In one embodiment, each round may include a single roll. For example, in an embodiment where dice are used, the dice may be rolled and matched against the first line of displayed indicia (such as on the player's card or display). The dice may then be rolled again and matched against the indicia displayed on the second line. In one embodiment, the game may end after a roll has occurred corresponding to each line or row, and the winning player(s) may be the players who match the predetermined combination of displayed indicia or who have achieved the highest score. In another embodiment, the game may continue with a roll of the dice and re-comparison back to the top or first row/line of indicia until a player receives matches forming a winning combination.

The game of the invention is particularly suited to the multi-player game format described above where the timing of certain aspects or events of play is controlled. In this arrangement, all players are provided a set of player symbols. A single set of symbols is displayed to all players for comparison of a match.

In one embodiment of the invention, a match may be declared if a symbol displayed in the first area matches a symbol of a row in the second area, regardless of whether the matching symbols are displayed in the same position. For example, referring to FIG. 17, if at the beginning of the game the first set of symbols were as displayed, the player would be permitted a match for the display of the 2 in the first position of the first set of symbols with the 2 in the first row of the second set of symbols.

In another embodiment, a player may be permitted to declare a match when any symbol which is displayed in the first area matches any symbol displayed in the second area. In one embodiment, a player may use a displayed symbol in the first area only once. The game may comprise the rolling or display of a predetermined number of sets of first symbols. The player attempts to match as may of the symbols in the second set as possible. In one embodiment, a player may attempt to match every symbol in the second set in order to win. In another embodiment, the player may be provided a score comprising the sum of the matched symbol values.

In the event the game comprises matching symbols regardless of position, the symbols which are displayed in the first area need not be arranged similar to those in the second area. For example, a single symbol, pair of symbols or the like may be displayed and used by the players in matching to the symbols in the player area.

In one embodiment, when a player receives a match, they may indicate the match or the match may be automatically indicated. In the case of a card, the player may daub the indicia to show that it has been matched. In the case of a display, the player may touch the screen at the location of the matched indicia to verify the match or generate a visual indication of a match. The visual indication may comprise a highlighting of the indicia or its surroundings, or darkening thereof, or transformation of the indicia to another indica, such as a symbol or picture which is not one of the indicia used to play the main game. In one embodiment, a computer, such as controller 1812 (illustrated in FIG. 18) may cause the visual indication of the match to occur automatically.

A wide variety of apparatus may be used to generate the indicia which are randomly provided as the first or main indicia which are compared to the indicia printed on the cards or the user's display. Besides the mechanical roller illustrated in FIG. 18 and described above, a blower type device as is commonly used in Lotto games may be used. In this arrangement, the dice may take the form of balls. The balls need not be perfectly spherical, and may include planar areas containing the dice indicia and "alignable" so that the outcome of the spin or roll of the dice-ball may be determined.

In one embodiment, the indicia may be located on wheels, reels or other elements. For example, the sides of a dice may be represented on a single flat disc. The wheels or reels may be rotated or moved to produce the random outcome. For example, six wheels (each displaying the six sides of a dice) may be rotated and stop in an indicator position. The resultant six indicia may be used in the play of the game.

In an embodiment where physical elements, such as physical dice or balls with dice indicia, are used to generate random indicia used in the game, the number of physical elements may vary. As illustrated in FIG. 18, in the case of a game where a player attempt to match a row or line of six indicia with six randomly selected indicia, six dice 1808 may be used. In another embodiment, however, a greater or lesser number of dice may be used. For example, a single dice may be used and rerolled to obtain the six outcomes. In another embodiment, the total number of dice may equal the total number of indicia on the card. In the embodiment illustrated in FIG. 19, this may be 36. The 36 dice may each be used once, so that each dice corresponds to a single location.

As one aspect of the invention, there is a method and system for providing the groups or sets of player indicia. As indicated above, the player indicia may be printed on a card or sheet. In one embodiment, a gaming establishment may place an order for such cards or sheets to a remote location.

In one embodiment, a gaming operator is provided with one or more cards or sheets in blank format. The blank form of the card may have printing thereon, such as pre-printed instructions and an outlined matrix. A gaming operator requests validation of the card, upon which a set of indicia is transmitted to the gaming operator and printed on the card.

In one embodiment, the method may be implemented over a computer network. The gaming operator may place the request for indicia, and a computer or computing device at a remote location, such as an indicia provider, may provide a set of player indicia. The set of player indicia may be selected randomly from pre-defined sets of indicia or may be generated, such as by using a random number generator. In either event, data representing the indicia set is transmitted to the gaming operator, such as by a communication link. The indicia data is used by the gaming operator, such as by input to a computing device controlling a printer, to print the set of indicia on the card or sheet.

In one embodiment, the provider's obligation to provide the indicia may be dependent upon payment from the game operator for the set of indicia. In this manner, the indicia provider is paid for each game which the gaming operator presents.

In another embodiment, the game operator need not even have partially printed game cards or sheets. Instead, the game operator may simply provide basic paper stock, such as paper in regular sheet form. The indicia provider may provide all of the information which is to be printed on the paper stock, thus allowing the game operator to print each card in its entirety.

The principle of the invention may also be applied to an arrangement where the indicia are displayed on a display of a gaming device. In this arrangement, the requested indicia may be transmitted and stored in electronic form by the gaming operator. The stored indicia may be transmitted to a particular gaming machine for use in play of the game.

In one embodiment, the provided indicia may be transmitted along with a unique identifier, such as an identification number. The identification number may be printed on the card or be associated with the displayed and stored indicia data. In this manner, the authenticity of the card or data may be verified, such as in the manner described above.

An advantage of this embodiment of the invention is that the game operator need not obtain and run complex software or obtain specific hardware for presenting the game. In addition, the operator need not obtain and store large quantities of pre-printed cards. When such cards are stored, they are subject to risk of damage, loss or tampering.

In one embodiment, the dice may have other than the values or numbers 1–6 associated with the sides thereof. For example, the dice may have the letters Z, B, I, N, G, O on the sides thereof. The indicia which are to be matched by player are then selected from this group of indicia. In this regard, it is noted that a variety of physical element may be used to generate the indicia, and the indicia may or may not include dice side or value indicia.

In one embodiment, the score may comprise other than the sum of the dice value. For example, in the event symbols such as fruit are utilized, each symbol may have an associated value. The value for each symbol may remain the same or change based on criteria such as the row in which the symbol is located. In one or more embodiments, instead of providing a player with a pre-printed card or other pre-arranged configuration of indicia, the player may be permitted to select one or more of the indicia which will comprise their game play indicia. For example, in a game in which a player attempts to match a group of six indicia with six indicia which are displayed, a player may select a combination of six dice indicia comprising a row of indicia which the player attempts to match with the displayed game indicia.

Another game in accordance with the invention will be described with reference to FIG. 20. This game is referred to herein as "Link." The game is preferably presented on an electrronic gaming device such as that described above, which device includes a video display 1920. In other embodiments, the game may be presented as a reel or other type game. In general, in this game a player attempts to obtain a predetermined combination of indicia, either in sequence or in linked or connected relationship.

In accordance with the game, a player places a wager or bet in order to establish entitlement to play the game. As described below, the size of the bet may determine how the game is presented or how a winning result is determined.

Figure 20:
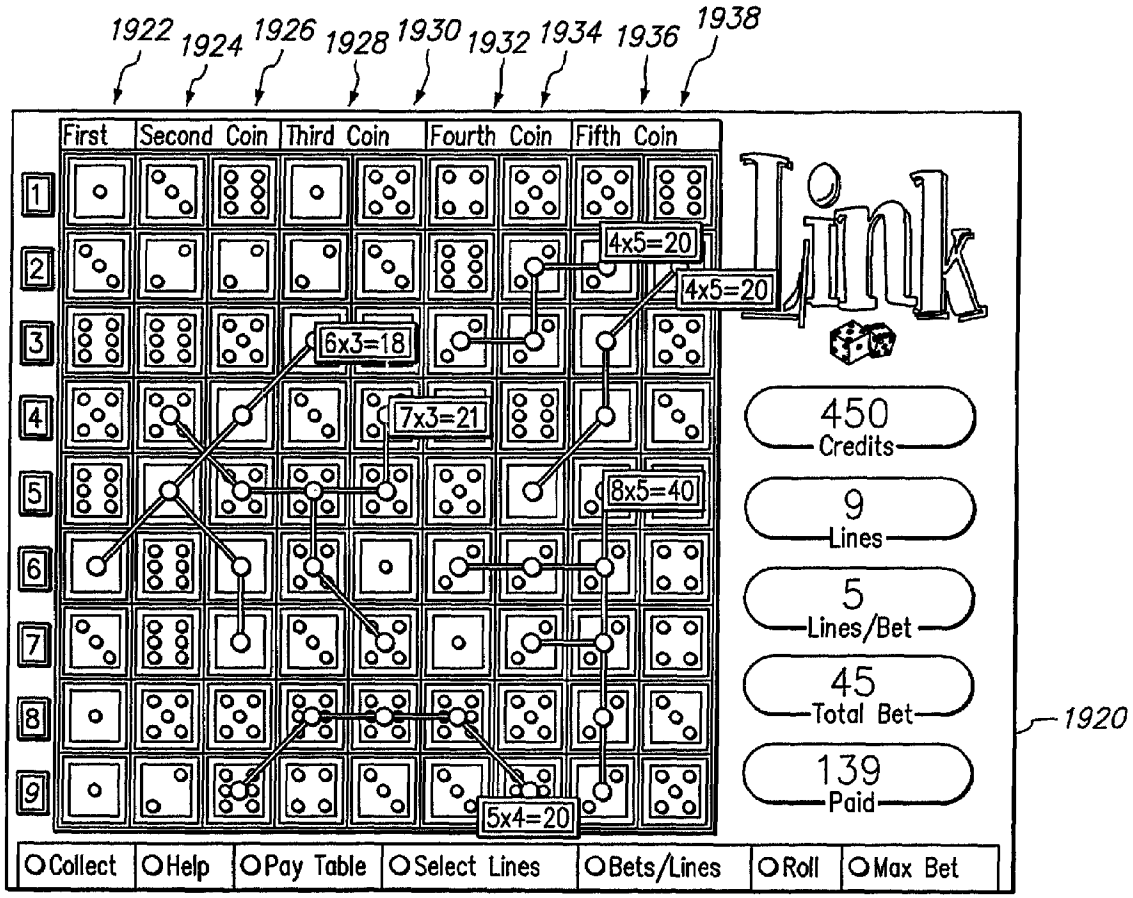
FIG. 20 illustrates a display containing graphical information presented during the play of yet another embodiment game of the invention.
Figure 1:
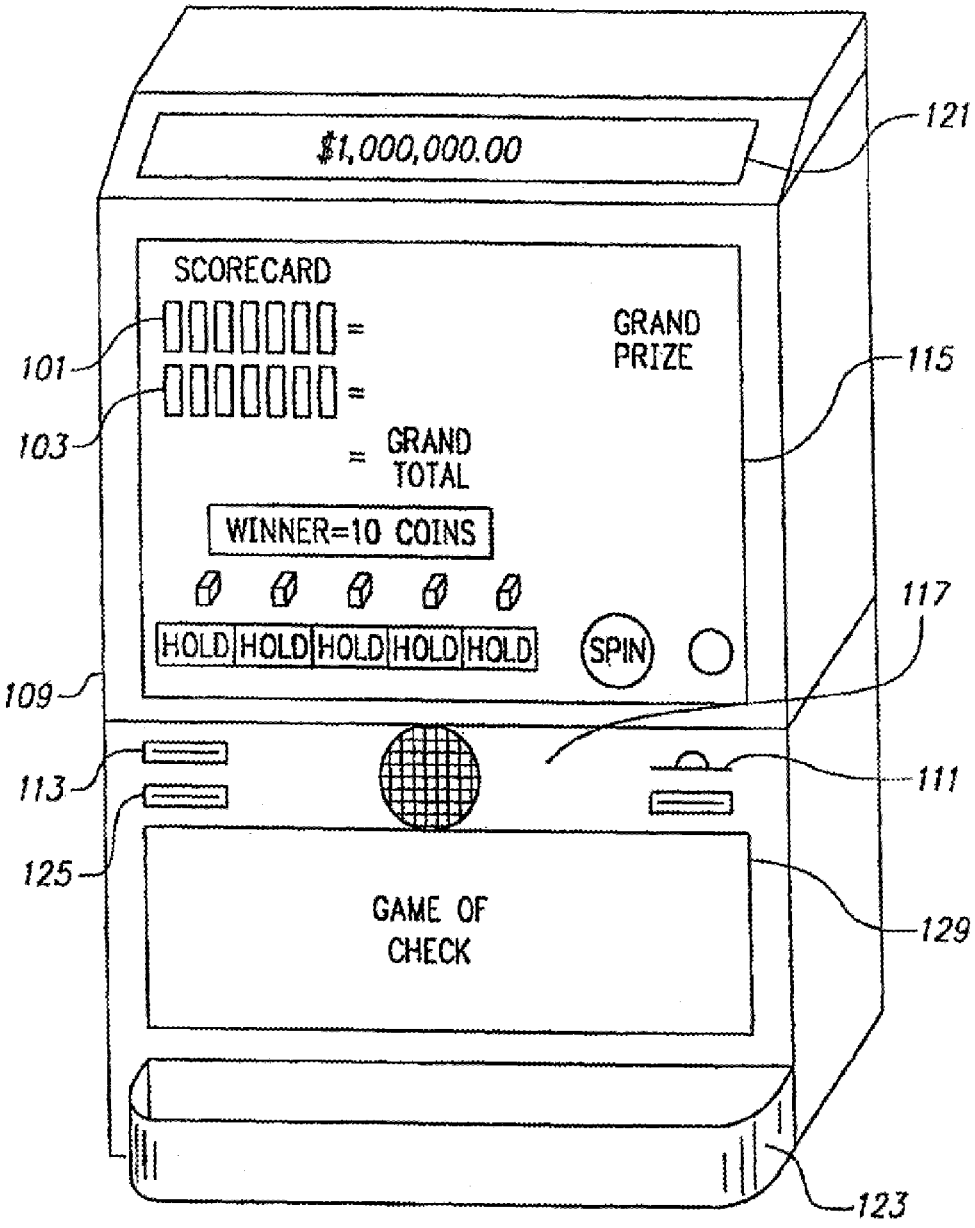
Figure 2:
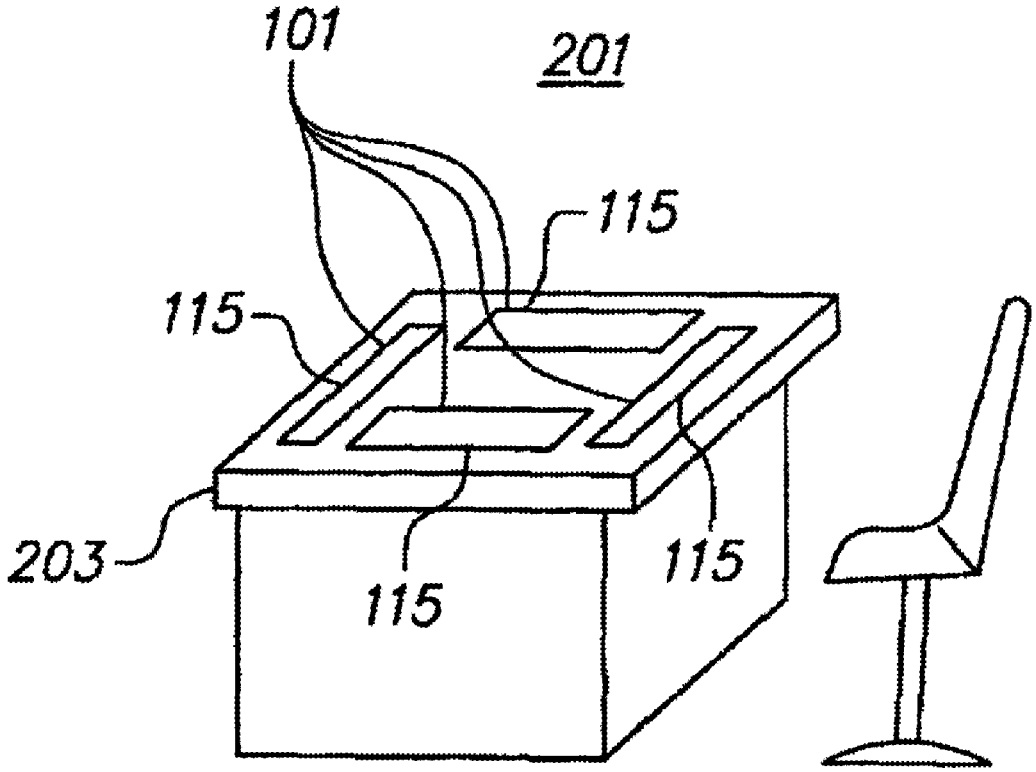
Figure 3:
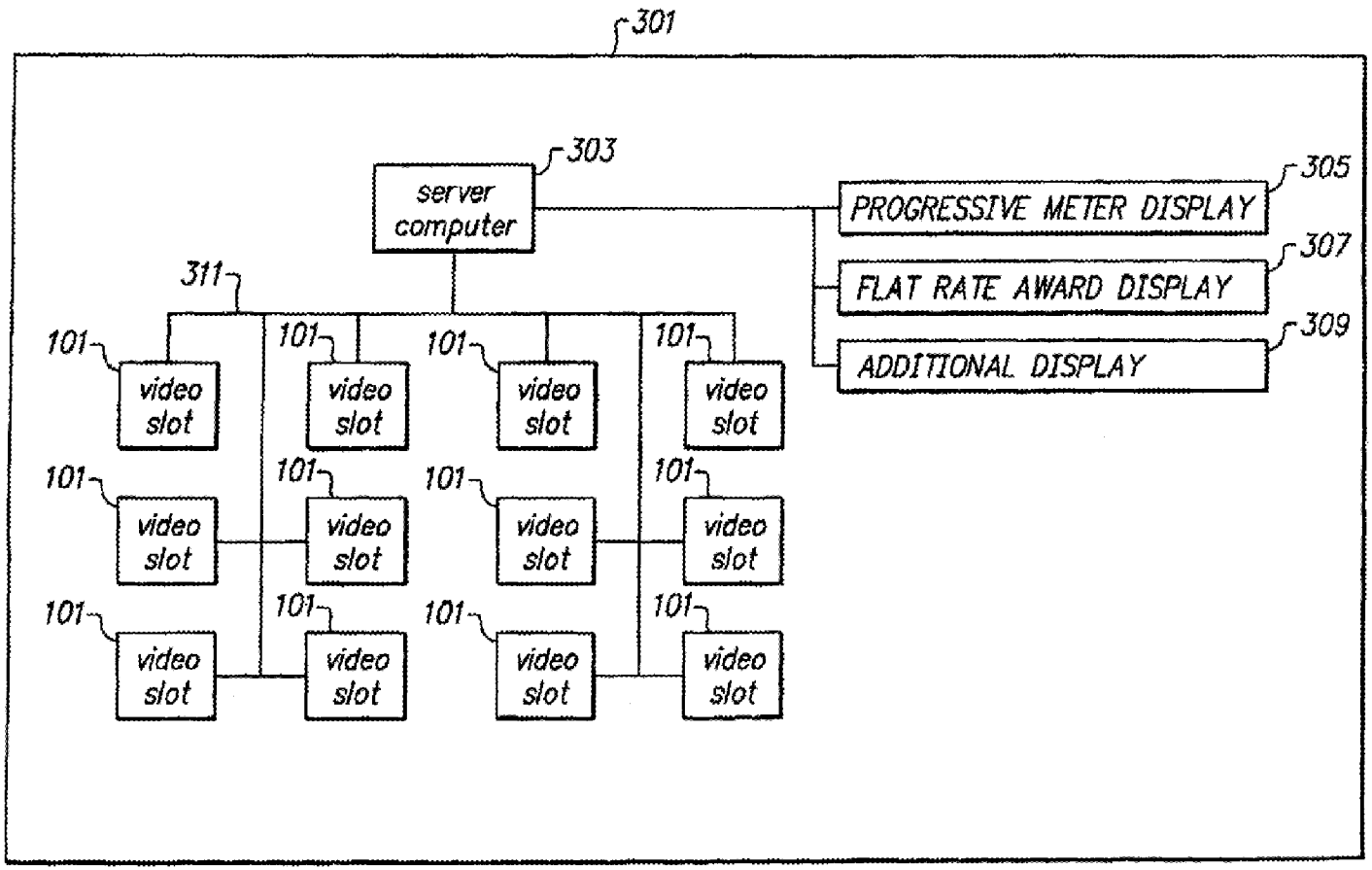
Figure 4:
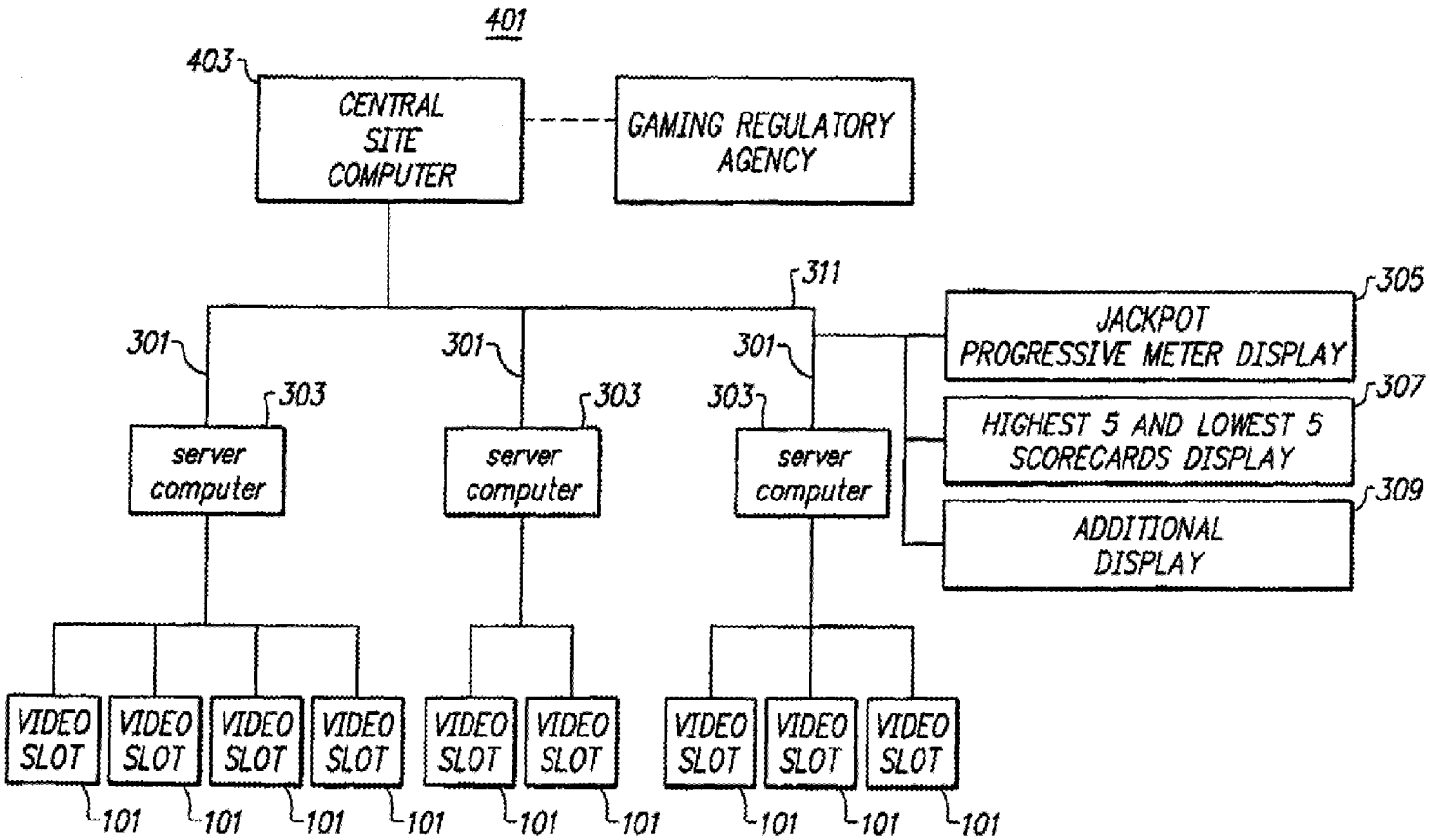
Figure 5:
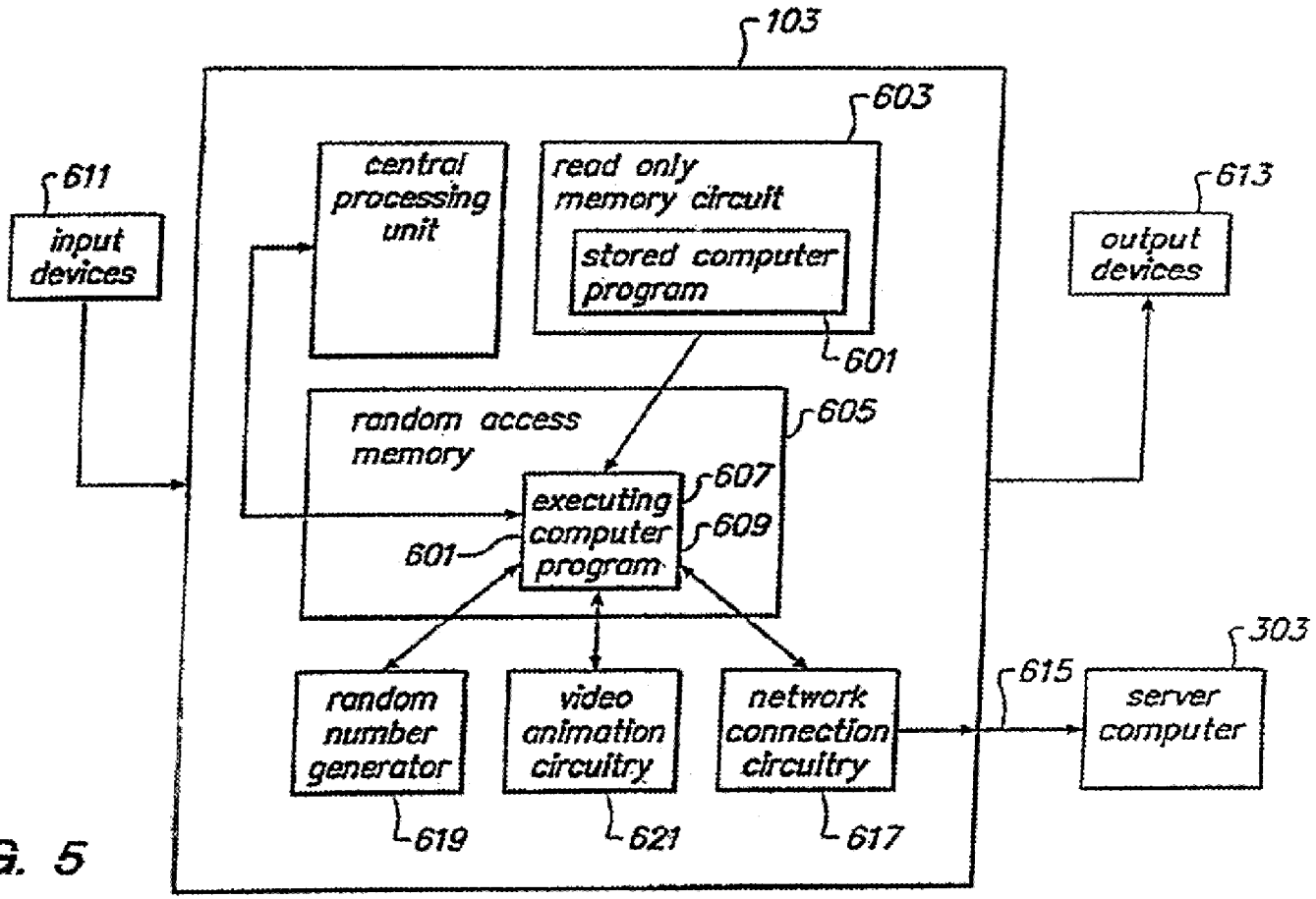
Figure 6:
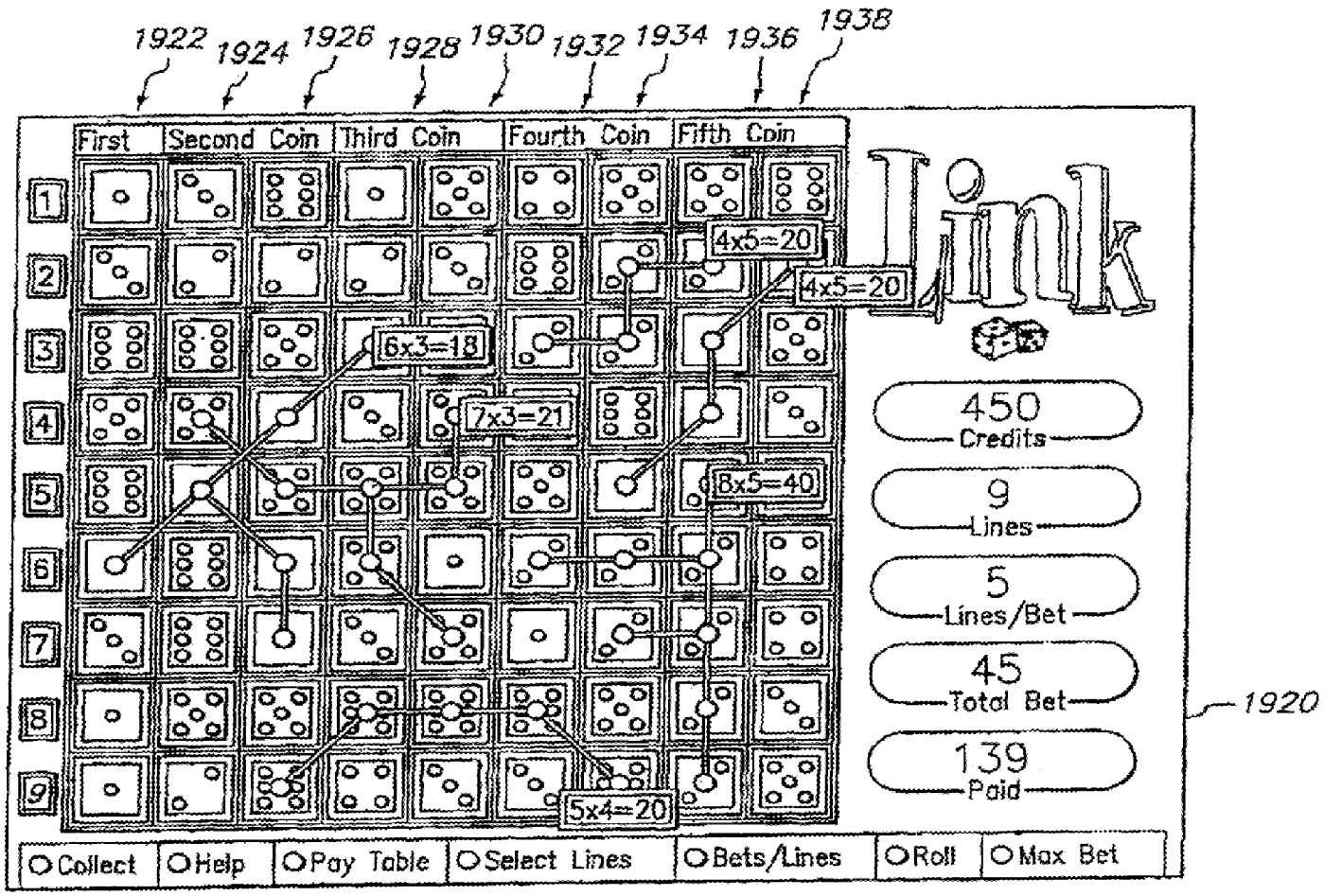

In one embodiment, at least one row, or as illustrated in FIG. 20, at least a first column 1922 of dice indicia are displayed. The number of indicia which are displayed may vary. As detailed below, the number of indicia displayed may be dependent upon the size of the player's bet. The number of indicia are preferably at least two, and more preferably three or more. The dice indicia are preferably randomly selected, such as by generation with a random number generator where each number is associated with a particular dice side.

In one embodiment, then the player is a winner only if the player receives a predetermined combination of dice indicia in the first set or column 1922 of displayed indicia. In a preferred embodiment, winning combinations of dice indicia comprise two or more of the same dice indicia in adjacent displayed positions. In one embodiment, a player is awarded a winning, such as a payout, based upon the amount bet.

In accordance with one embodiment of the invention, additional rows or columns of dice indicia are displayed. In one embodiment, a first column 1922 of dice indicia is displayed based on a bet of a first amount, and an additional column or columns are displayed based upon larger amounts bet. In one embodiment, two additional columns 1924,1926 of dice indicia, for a total of three columns, are displayed based upon a second bet. Likewise, two additional columns 1928,1930 of dice indicia, for a total of five columns, are displayed based upon a third bet. Lastly, two additional columns 1932,1934 of dice indicia, for a total or seven columns for a fourth bet, and two additional columns 1936,1938, for a total of nine columns, for a fifth bet.

In this arrangement, a maximum bet results in a total of 9 (nine) columns of dice indicia being displayed. When the number of dice indicia per column is 9 as illustrated, then the result is a matrix which is 9 by 9, for a total of 81 dice indicia. Of course, the matrix may have a variety of sizes, such as n×m where n and/or m are as few as 1 or greater than 9. Further, a greater or lesser number of dice indicia may be displayed in the possible indicia positions of the matrix.

Preferably, a matrix of indicia where n and m are both 2 or greater is displayed in response to a single bet. In an embodiment where either n or m is 1, the game preferably proceeds in accordance with the embodiment described below wherein indicia are displayed sequentially, rather than in a matrix form.

In one embodiment, the dice indicia may be displayed in rows instead of columns. For example, upon placing a first bet, a first row of dice indicia may be displayed. Upon placing a larger bet, an additional row or rows of dice indicia may be displayed.

In one embodiment, a player is declared a winner as to one or more predetermined combinations of dice indicia which are achievable with the dice indicia which are displayed. In one embodiment, the combination of dice indicia may be generated not only from indicia located in the same row or column, but in joined or linked rows or columns. In one embodiment, winning combinations of dice indicia may be achieved from associated dice indicia. By "associated" it is meant located in an adjacent position (i.e. to the top, bottom, side, or corner) to an indicia.

In one embodiment, a winning result may be declared if a plurality of the same dice indicia appear in a horizontal row. In one embodiment, a winning result may be declared if a plurality of the same dice indicia appear in a vertical column. In one embodiment, a winning result may be declared if a plurality of the same dice indicia appear in a diagonal line. In one embodiment, a winning result may be declared if a plurality of the same dice indicia are associated or connected in any pattern. In one embodiment, a winning result may be declared if a plurality of the same dice indicia are associated or connected in a predetermined pattern. In one embodiment, a winning result may be declared if the plurality of dice appear in one or more of the above-described manners, such as horizontally, vertically or diagonally.

FIG. 20 illustrates an example in which a combination of dice indicia is declared a winning combination if the dice indicia are the same and are linked or associated in any manner.

In one embodiment, a player may be declared a winner for receiving a predetermined number of linked or associated identical indicia, such as 2 or 3 linked indicia. In other embodiments, the result may not be a winning result unless 4 or more of the same indicia are linked.

Winnings may be paid for winning combinations. The winnings paid may comprise the number of linked indicia multiplied by the largest bet (such as coin) for any column in which one of the dice indicia lies. For example, in the embodiment illustrated, five dice indicia bearing the number 5 (five) are linked in rows eight and nine. The last of these dice indicia is located in column 1934 which was displayed as a result of the fourth bet or coin. As such, the total winning is 5 (indicia) multiplied by 4 (highest bet), or 20 coins. In another embodiment, a payout table may be provided which dictates fixed amounts for combinations of indicia.

In another embodiment, a predetermined amount may be paid for combinations of indicia, such as a certain amount for 2 linked indicia, 3 linked indicia or the like. Preferably, the winnings increase as the total number of linked indicia increases. Jackpot winnings may be awarded for receiving a high number of associated indicia, such as 9 or more. The jackpot may be funded from a portion of each player's bet which is set aside in a jackpot fund.

The winnings paid may also depend on the arrangement of the linked indicia. For example, if the linked indicia are all in the same row or column, than a larger winning may be awarded than if the linked indicia are in another arrangement. A particular winning may be awarded if the linked indicia are along a diagonal line.

In another embodiment, a player is declared a winner for receiving a particular pattern of related dice indicia. One such pattern is a string of the same dice indicia which extends in uninterrupted fashion from the first column to the last column of the matrix. In this embodiment, if a sequence of the same indicia are linked from the first column 1922 to the last column 1938, then the result may be declared a winning outcome. In one embodiment, the linked indicia may be located in any row. In another embodiment, a winning outcome may be declared if the indicia are all located in the same row and extend from the first to the last column. In one embodiment, this winning outcome is only declared if the player has placed the maximum bet and the indicia link across all columns. In another embodiment, a winning outcome may be declared if the same indicia are linked across multiple columns, even if the maximum bet is not placed. Of course, the amount awarded preferably increases as the likelihood of obtaining the outcome decreases.

Another pattern may be that where a string of the same dice indicia extends in linked fashion from the top to the bottom of the matrix. Another pattern may be where the same dice indicia extend along the diagonals of the matrix or are otherwise linked from corner to corner.

A player may also be paid winnings if a particular indicia appears anywhere more than a predetermined number of times. For example, in the case of the 9×9 matrix illustrated in FIG. 20, a player may be paid a winning if any particular indicia appears more than 15 times. The greater the number of occurrences of the indicia above the minimum, the larger the amount which may be awarded.

In one embodiment, the game may include the step of providing a visual indication of the winning combinations of indicia. For example, linked or connected indicia may be highlighted, as illustrated in FIG. 20. In one embodiment, highlighting of a first color is used to identify a first set of linked indicia, and highlighting of a second color to identify a second set, and so on.

As illustrated in FIG. 20, information other than the displayed indicia may be provided to the player. For example, information regarding the number of credits or other monies or awards belonging to the player may be displayed. Information may also be provided regarding the number of lines and rows of indicia displayed or wagered.

A variety of betting options may be presented which affect the way the game is played or the way winnings results are determined. As indicated, in one embodiment, a player may be required to place incrementally larger bets in order to have additional columns or rows of playable indicia displayed. For example, a single column or row may be displayed upon placing a bet of a first amount, and one or more additional columns or rows may be displayed if the player places a bet of a second amount larger than the first amount. The amounts may be incrementally larger than one another, such as by denomination (i.e. $0.25, $0.50, $0.75 or $1.00, $2.00, $3.00, etc.).

In another embodiment, all indicia are displayed if a player places a required minimum bet, and winning combinations are determined and winnings paid. However, if the player places a second, larger bet, then the winnings paid for winning combinations are, for one or more winning combinations, larger than the amounts paid if the player places only the minimum bet.

As one variation of the game, the "ways" by which the combinations of dice indicia are determined to be winning combinations may depend upon the size of the bet. For example, if a player places only a first bet, the entire matrix of indicia are displayed, but only vertical (i.e. in column) combinations of dice may be eligible to be declared winning. If a player places a bet of a second, larger amount, then all vertical and horizontal (i.e. in row) combinations may be eligible. Upon placing larger bets, diagonal and any associated indicia combinations may be added.

In accordance with another embodiment of the game of Link, a player may attempt to obtain a particular sequence of indicia. In one embodiment, this game may comprise the above-described game wherein the indicia are displayed in a single row or column (i.e. n or m equals 1).

In one embodiment of the invention, the game involves the sequential display of dice indicia. In this embodiment, a player places a first bet and preferably, two dice indicia are displayed. If the dice indicia are the same, then the player is a winner of a first award. The player may elect to end the game and receive the first award. Alternatively, the player is entitled to place an additional bet, upon which a third or next dice indicia is displayed. If the next dice indicia is the same as the first two, then the player is the winner of a second award. This award will generally be larger than the first award as a result of the lower odds or receiving the indicia combination. If the third indicia is not the same as the first two, then the outcome of the game is a losing outcome.

In one embodiment, a player may be permitted to continue placing additional bets and display indicia until a predetermined maximum number of dice indicia are displayed. If the player reaches that predetermined maximum and all of the dice indicia are the same, then the player may receive a particularly large winning, such as a jackpot winning.

In this embodiment, the dice indicia are preferably displayed sequentially in a single row, column or other line. In one embodiment, dice indicia locations may be displayed, and the number of locations displayed may be dependent on the size of the player's bet. Once the bet is placed and the locations displayed, the player may touch the first location to initiate a simulated dice roll. Thereafter, the player may sequentially touch each additional dice location to effectuate the simulated spin.

As a variation to this embodiment of the invention, a player places a bet to start the game. At least a two (i.e. a first and second) indicia are displayed. If they are the different, the game ends. If they are the same, then the player is placed an additional bet or wager to have at least one additional indicia displayed. The game continues as described above, with the game ending if the combination of displayed indicia do not match or otherwise comprise a predetermined combination of indicia, and permissibly continuing if the player elects.

In another variations or embodiments of the game of Link, a matrix of indicia positions, such as blank circles or boxes, is displayed. A player is permitted to select one or more indicia to be displayed based upon one or more wagers. For example, a player may be permitted to have a single indicia displayed for each bet placed. The player attempts to select positions which result in the display of indicia resulting in a predetermined combination of winning indicia.

As an example of this embodiment invention, a matrix of 9 by 9 possible indicia locations may be displayed. A player places a first bet and is entitled to select one of the locations. The indicia at that location is displayed. The player is entitled to place a second bet and then select a second location and have the indicia displayed at that location, and so on. If the player receives a predetermined combination of indicia as a result of the player's selections, then the player may be declared a winner of the event. In this embodiment, a player may be declared a winner of a first winning amount after a certain combination of indicia have been displayed. The player may, however, continue to place additional bets and make additional selections in an attempt to receive a winning outcome which results in a higher reward. For example, a player may receive the same indicia for three selections along a row of the matrix and be entitled to a reward of a first amount. The player may place an additional bet and select the next space. If the same indicia is displayed, resulting in four of the same indicia being displayed in sequence, the player may be entitled to larger award. In another embodiment, upon placing a bet of a first amount, a player may be permitted to make a certain number of selections. If the player places a larger bet of a second amount, the player may be permitted to make a larger number of selections.

The indicia may be displayed in a variety of manners. In an embodiment where the indicia comprise the images of the sides of dice, simulated dice may spin or roll and stop in one position. In another embodiment, a plurality of mechanical reels may be provided, the one or more reels displaying all or some of the indicia. The player may spin the first reel or reels, and spin additional reels based on the size of the bet.

In another arrangement, a player may use a "scratch" card having a number of indicia hidden under a removable covering. The player may attempt to scratch off or remove the covering from one or more of the indicia in an attempt to receive a particular combination of indicia.

In one embodiment, a row, column, matrix or other arrangement of indicia positions may be provided. A player may "throw" (in simulated video fashion, or in a mechanical fashion as described above) a set of dice. The result of the throw may be posted to the row or column of the matrix. The player may then "throw" the dice additional times to post dice indicia to the additional rows or columns as described above, such as upon wagers or bets placed.

In one or more embodiments of the invention, the games described above may be played with dice or simulated dice having more than 6 sides. For example, dice having 9 sides may be used, or dice having 12 sides may be used. Such dice may be provided with dots representing the values 1–9, the actual numerical values 1–9, or even include traditional dice indicia as well as other indica, such as wild card symbols or letters.

The use of one or more of such dice has the advantage that a number of additional combinations of dice indicia are provided, and the odds of receiving certain combinations or outcomes change. For example, in the event the 9 sided dice are utilized, the probability of obtaining a sequence of six matching indicia in six successive rolls or spins is much less than if 6 sided dice are utilized (in this case, approximately 10 times less likely).

It will be appreciated that the indicia which are displayed for use in playing the game need not be arranged in a matrix as illustrated in FIG. 20. For example, the number of indicia or indicia positions per row and per column need not be the same for every row and every column. For example, the indicia positions may be arranged in a pyramid format with a greater number of indicia in one row at the bottom than at a row at the top. The indicia positions may also be arranged in a square or other design.

The game of Link may be played with indicia other than dice indicia. For example, the indicia utilized may comprise pictures of different animals or of different fruit. The number of indicia in the set of indicia utilized may vary, thus varying the odds of receiving a particular indicia. For example, in the case of a six-sided dice, there are six different possible indicia. A set of animal indicia may be utilized, however, including pictures of 10 different animals. In the latter case, the odds of receiving any particular indicia are reduced. In one embodiment, the "set" of indicia utilized need not include the same number of each indicia. For example, there may be only two "lion" indicia, but ten "jaguar" indicia. Winning paid may be greater for linking the less common indicia.

In one or more embodiments of the invention, a bonus game or event is associated with the above-described game of Link. In accordance with the bonus game or event, a player is awarded a bonus or winning for receiving a predetermined number of identical indicia. Preferably, the indicia which are utilized to determine the outcome of this bonus game or event are the same indicia which are displayed while playing the underlying game of Link.

In one embodiment, the bonus event/game comprises the display of a plurality of indicia. In one embodiment, the indicia are selected from a group of indicia. In the embodiment described below where the bonus game is based upon the game of Link, the set of indicia are displayed by rolling real or simulated dice, with each indicia selected from the sides of a die.

A player is a winner of the bonus game if the player receives a predetermined minimum number of identical indicia. In one embodiment, the predetermined number of identical indicia is half of the displayed indicia or more. It will be appreciated that the predetermined number of identical indicia may be any number between two and the total number of indicia displayed.

In accordance with the bonus game or event, if the predetermined number of identical indicia (i.e. in one embodiment 8 dice having the same number of pips) are displayed, the outcome of the bonus game or event is declared a winning outcome and a bonus award is awarded to the player. In a preferred embodiment, the amount of the bonus award increases for each number of identical indicia that the player receives in excess/above the predetermined number of identical indicia. The bonus award is preferably independent of any winnings or awards based upon play of the underlying game, such as winnings paid based upon the outcome of the underlying game of Link.

In a preferred embodiment, the identical indicia do not have to be linked/connected or in any other way associated with each other as required in the underlying game of Link. However, in another embodiment only those identical indicia that are linked may be used to determine the number of identical indicia displayed to the player of the bonus game.

In a preferred embodiment, the matrix containing the indicia that is displayed to a player used to play the game of Link is simultaneously used to play the bonus game. In this embodiment, the same dice indicia that are displayed to the player in the underlying Link game are also used to determine the total number of identical indicia in the bonus game. The outcome of the bonus event may then be based on the identical indicia which are different from the indicia in the game of Link that determine the outcome of such.

In another embodiment, after play of the underlying game of Link, a new matrix or other set of new indicia may be displayed to the player for play of the bonus game. In this embodiment, the number of indicia displayed to the player may be the same as or different (i.e. more or less) than the number of indicia displayed in the underlying game of Link. Further, the type of indicia displayed may be different from those indicia displayed in the underlying game.

In one or more embodiments, in order for a player to be a winner of the bonus game, the player does not have to be a winner of the underlying game of Link. In a preferred embodiment, the bonus game is an automatically occurring event for having played the underlying game. However, in another embodiment, a player must qualify to partake in the bonus game. For example, in one embodiment, in order for the player to be entitled to participate in the bonus game, the player must be determined to be a winner of the underlying game of Link. In another embodiment, the qualifying event consists of obtaining a predetermined number of linked indicia during play of the underlying game.

In a preferred embodiment, the wager placed for play of the underlying game entitles the player to play the bonus game. In another embodiment the player must place a separate wager or bet in order to establish entitlement to play the bonus game.

It will be appreciated that in some instances depending on the number of indicia displayed and the number of identical indicia required to be a winner of the bonus game, multiple identical indicia for different indicia (i.e. 8 threes and 8 twos) may be displayed to a player. In one or more embodiments the player may receive a bonus award for both winning events. In another embodiment only one bonus award is awarded. In another embodiment, a bonus award is only awarded for the single largest group of identical indicia.

In a preferred embodiment, a winning/bonus award is paid for obtaining a predetermined number of identical indicia. In one or more embodiments the bonus award is based on the amount of the wager.

In one embodiment, a visual indication is provided for identifying the identical indicia displayed. Preferably, only those identical indica that are winning combinations are visually identified. For example, the identical indicia may be highlighted. In instances where more than one set of winning identical indica are displayed, each may be highlighted in a different color.

In a preferred embodiment, the game is referred to as a bonus game or event for the reason that the game is presented to the player without the requirement of placing an additional bet or wager aside from the bet or wager placed to play the underlying game. In other embodiment, the bonus game or event may only be played if an additional bet or wager is presented and the player elects to play the base or underlying game.

In another embodiment of the invention, the bonus game or event may be played as a completely independent game. The game is preferably presented on an electronic gaming device such as that described above, which device includes a video display. In other embodiments, the game may be presented as a reel or other type game. In general, in this game a player attempts to obtain a predetermined number of identical indicia.

In accordance with this embodiment of the game, a player places a wager or bet in order to establish entitlement to play the game. Upon the player placing the required wager or bet, a predetermined number of indica are displayed to the player.

In a preferred embodiment, at least one row and one column of indicia are displayed. The number of indicia that are displayed may vary. In one or more embodiments the number of indicia displayed may be dependent on the amount of the wager. The indicia are preferably randomly selected, such as by generation with a random number generator where each number is associated with a particular dice side. In another embodiment, an entire matrix or other group of indicia are displayed so long as the minimum required bet is placed. In one embodiment, amounts bet over the required minimum simply change the amounts awarded if the outcome is a winning outcome.

The indicia may be displayed in various manners. As indicated, the display may be by electronic presentation, the spinning of reels, or even the throw or roll of actual dice.

In a preferred embodiment, similar to play as a bonus game, a player is a winner only if the player receives a predetermined number of identical indicia from the group or set of displayed indicia. In a preferred embodiment, winning combinations of indicia comprise two or more of the same indicia displayed anywhere. If the player receives a predetermined minimum number of the same indicia in the set of display indicia, the outcome of the game may be declared a winning outcome and the player paid an award or winning.

It will be understood that the above described arrangements of apparatus and the method therefrom are merely illustrative of applications of the principles of this invention and many other embodiments and modifications may be made without departing from the spirit and scope of the invention as defined in the claims.

I claim:

1. A method of playing a game comprising the steps of:

providing a matrix comprising m rows by n columns of possible indicia positions, where n and m are at least 2;

accepting a wager;

displaying indicia in each of said indicia positions of said matrix, said indicia displayed in each of said positions randomly selected from a group of indicia and having the possibility of being the same or different from indicia displayed in other positions of said matrix;

identifying each grouping of three or more identical indicia located anywhere in said matrix;

declaring as a winning combination each identified grouping where the indicia are in linked positions;

declaring as a non-winning combination any identified grouping where the indicia are not in linked positions; and awarding a winning if at least one winning combination of indicia is received.

2. The method in accordance with claim 1 including the step of displaying indicia in a first plurality of rows and columns in response to a wager of a first size and displaying indicia in a second plurality of rows and columns greater than said first plurality of rows and columns in response to a wager of a second size greater than said first size.

3. The method in accordance with claim 1 including the step of displaying a visible element connecting the indicia forming each winning combination of indicia.

4. The method in accordance with claim 3 wherein said visible element comprises a bar extending between positions containing said indicia.

5. A method of playing a game comprising the steps of:

providing a matrix comprising m rows by n columns of possible indicia positions, where n and m are at least 2;

accepting a wager;

displaying indicia in each of said indicia positions of said matrix, said indicia displayed in each of said positions randomly selected from a group of indicia and having the possibility of being the same or different from indicia displayed in other positions of said matrix;

identifying occurrences of three or more of the same indicia located anywhere in said matrix;

identifying as winning groupings only said linked sets;

declaring as losing any identified occurrences where the indicia are not in linked positions; and awarding winnings for said winning groupings.

6. The method in accordance with claim 5 including the step of displaying one or more elements connecting the displayed indicia of each identified winning grouping after said groupings have been identified.

* * * * *

UNITED STATES PATENT AND TRADEMARK OFFICE

CERTIFICATE OF CORRECTION

PATENT NO. : 7,090,579 B2
APPLICATION NO. : 10/143367
DATED : August 15, 2006
INVENTOR(S) : Tarantino It is certified that error appears in the above-identified patent and that said Letters Patent is hereby corrected as shown below:

Please delete entire patent title pages, drawings 1-18, and columns 1 line 1 and columns 58 line 61

And insert title pages, drawings 1–6, and columns 1 line 1 and columns 18 line 20 as shown on the attached pages.

Signed and Sealed this

Thirteenth Day of May, 2008

JON W. DUDAS
*Director of the United States Patent and Trademark Office*

(12) United States Patent
Tarantino

(10) Patent No.: US 7,090,579 B2
(45) Date of Patent: Aug. 15, 2006

(54) DICE GAME AND GAMING SYSTEM

(75) Inventor: Elia Rocco Tarantino, Las Vegas, NV (US)

(73) Assignee: Colepat, LLC, North Las Vegas, NV (US)

( * ) Notice: Subject to any disclaimer, the term of this patent is extended or adjusted under 35 U.S.C. 154(b) by 0 days.

(21) Appl. No.: 10/143,367

(22) Filed: May 9, 2002

(65) Prior Publication Data

US 2002/0193160 A1 Dec. 19, 2002

Related U.S. Application Data

(63) Continuation-in-part of application No. 10/004,102, filed on Oct. 23, 2001, now Pat. No. 6,702,671, which is a continuation-in-part of application No. 09/838,949, filed on Apr. 19, 2001, now abandoned, which is a continuation-in-part of application No. 09/684,759, filed on Oct. 6, 2000, now abandoned, which is a continuation-in-part of application No. 09/553,915, filed on Apr. 20, 2000, now Pat. No. 6,605,001, which is a continuation-in-part of application No. 09/439,934, filed on Nov. 12, 1999, now Pat. No. 6,656,047, which is a continuation-in-part of application No. 09/298,604, filed on Apr. 23, 1999, now abandoned.

(51) Int. Cl.
*A63F 9/24* (2006.01)

(52) U.S. Cl. ..... 463/20

(58) Field of Classification Search ..... 463/20, 463/22, 19, 25, 13, 16; 273/146
See application file for complete search history.

(56) References Cited

U.S. PATENT DOCUMENTS 1,696,359 A * 12/1928 Nelson ..... 273/143 R
2,035,084 A * 3/1936 May ..... 273/143 R
4,718,672 A 1/1988 Okada
4,834,386 A 5/1989 Rosenthal et al.
5,031,914 A * 7/1991 Rosenthal ..... 463/22
5,413,342 A 5/1995 Kaplan
5,580,053 A 12/1996 Crouch
5,609,524 A 3/1997 Inoue
5,611,535 A 3/1997 Tiberio
5,695,188 A 12/1997 Ishibashi (Continued)

OTHER PUBLICATIONS

Marshall Fey, "Slot Machines, A Pictorial History of the First 100 Years", 1983, Liberty Belle Books, pp. 74-75.

*Primary Examiner*—Corbett B. Coburn
(74) *Attorney, Agent, or Firm*—Weide & Miller, Ltd.

(57) ABSTRACT

A variety of methods of playing games using dice or other indicia and apparatus for implementing the games are disclosed. In one embodiment, the game involves the step of accepting a wager, displaying indicia such as images of the sides of dice and determining if identical indicia are connected. Winning combinations of indicia comprise two or more indicia located in adjoining or connecting relationship within the matrix. In one embodiment, a player's bet determines how many indicia are displayed in the matrix. In one embodiment a bonus or separate game comprises using the existing displayed indicia or displaying a new set of indicia and determining the maximum number of identical indicia. If the maximum number exceeds a predetermined number, the outcome is a winning outcome.

6 Claims, 6 Drawing Sheets

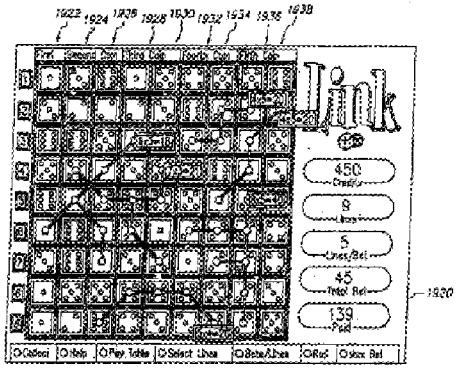

U.S. PATENT DOCUMENTS

| | | | | |
|---|---|---|---|---|
| 5,807,172 | A | 9/1998 | Piechowiak | |
| 5,823,873 | A * | 10/1998 | Moody | 463/13 |
| 5,976,016 | A * | 11/1999 | Moody et al. | 463/13 |
| 6,159,098 | A * | 12/2000 | Slomiany et al. | 463/25 |
| 6,173,955 | B1 * | 1/2001 | Perrie et al. | 273/146 |
| 6,213,876 | B1 * | 4/2001 | Moore, Jr. | 463/22 |
| 6,220,959 | B1 | 4/2001 | Holmes, Jr. et al. | |
| 6,241,607 | B1 | 6/2001 | Payne | |
| 6,277,025 | B1 | 8/2001 | Margolin | |
| 6,296,569 | B1 | 10/2001 | Congello, Jr. | |
| 6,322,445 | B1 * | 11/2001 | Miller | 463/13 |
| 6,443,837 | B1 * | 9/2002 | Jaffe et al. | 463/16 |
| 6,471,208 | B2 * | 10/2002 | Yoseloff et al. | 273/143 R |

* cited by examiner

DICE GAME AND GAMING SYSTEM

CROSS REFERENCE TO RELATED APPLICATIONS

This application is a continuation-in-part of U.S. application Ser. No. 10/004,102 filed on Oct. 23, 2001 now U.S. Pat. No. 6,702 671, which is a continuation-in-part of U.S. application Ser. No. 09/838,949 filed Apr. 19, 2001 now abandoned, which is a continuation-in-part of U.S. application Ser. No. 09/684,759 filed Oct. 6, 2000 now abandoned, which is a continuation-in-part of U.S. application Ser. No. 09/553,915 filed Apr. 20, 2000 now U.S. Pat. No. 6,605,001, which is a continuation-in-part of U.S. application Ser. No. 09/439,934, filed on Nov. 12, 1999 now U.S. Pat. No. 6,656,047, which is a continuation-in-part of U.S. application Ser. No. 09/298,604 filed on Apr. 23, 1999 now abandoned, each of which is incorporated herein by reference.

FIELD OF THE INVENTION

The present invention relates generally to methods of playing games, gaming devices and systems.

BACKGROUND OF THE INVENTION

Traditional slot machine play typically involves wagering on the spin of a mechanical or video-simulated reel. No decision making is involved, other than the decision to play. No skill is involved where the outcome of such gaming is based upon chance.

The interconnection of multiple gaming machines to facilitate a gaming system with progressive jackpots is in use today. Although such wide area links involve progressive jackpots, they do not take full advantage of the potential created by the interconnection of a plurality of gaming machines. Wide area links of gaming machines typically involve traditional computer-controlled slot machines, which, although popular, do not involve a substantial skill element. Furthermore, traditional slot machines facilitate a limited persistence of play. After any given spin, a player is likely to leave the computer-controlled slot machine, because each spin is a completed cycle rather than part of an ongoing game. A game in which each spin or turn is a part of an ongoing game would be advantageous because such a system would encourage a player to continue playing in order to complete a game in progress.

Additionally, traditional slot machine play is a solitary activity. Players compete only against the house, in an introverted process in which they interact not with each other, but only with the gaming machines. With the advent of wide area links of gaming machines, a tremendous potential exists to facilitate multiple player tournaments, in which players would not only compete for the same progressive jackpots, but actually compete against each other in real time. Such multiple player gaming would be more socially interactive, and would facilitate a fun gaming dynamic.

Also, traditional slot machines are not equipped to permit a player to take a break, and to later resume game play. If a player physically leaves an individual slot machine, that player may never revisit the specific game state which the player left behind. Because players like to take short and long term breaks for a variety of reasons, a method to allow a player to save a game state and later restore the saved game would be advantageous. Players would like to be able to take breaks of any length and later resume a saved game at the same or another physical location.

SUMMARY OF THE INVENTION

The present invention provides apparatus and methods for playing various casino games. The games include the use of a plurality of symbols or indicia, such as dice indicia, in games of skill and/or chance.

One embodiment of the invention comprises a game called Link. In one embodiment of this game, at least two indicia are displayed in response to the placing of a wager. A player is permitted to continue to display indicia in sequence, in one embodiment the additional indicia displayed in response to the placing of one or more additional wagers. The player attempts to achieve a predetermined combination of indicia, such as a sequence of the same indicia. If the combination of displayed indicia is not a predetermined combination of winning indicia, then the game is ended.

In another embodiment of the game, a matrix of indicia positions is provided. Preferably, the matrix has m rows by n columns where n or m is at least 2. In one embodiment, the size of a wager placed by a player determines the number of indicia displayed, such as the number of rows or columns of indicia displayed. After the indicia are displayed, it is determined if any of the linked indicia, i.e. indicia which are connected or located in adjacent matrix positions, comprise a predetermined winning combination of indicia. In one embodiment, the predetermined winning combination of indicia comprises a predetermined minimum, such as three, of the same indicia which are linked anywhere in the matrix of displayed indicia. In another embodiment, a predetermined winning combination of indicia results if linked indicia span the entire matrix, such as side-to-side, diagonally, or top-to-bottom.

In one embodiment of the invention, indicia are displayed sequentially and a player attempts to receive matching indicia. In one embodiment, a player places a first wager and two indicia are displayed. If they are matching, the player is permitted to place an additional bet and have one or more additional indicia displayed. If the indicia are matching, a player may be paid winnings or may attempt to continue play to receive additional matching indicia. If the indicia do no match, the game ends.

In one embodiment of the invention a game comprises the steps of displaying a set of indicia and determining if a maximum number of identical displayed indicia exceeds a predetermined number. If a number of identical indicia exceeds the predetermined number, the outcome of the game is a winning outcome and a winning is awarded.

In one embodiment, this game is played as a bonus game to the game of Link. The set of indicia which are utilized to play the game of Link are used to play the bonus game. The bonus game comprises determining if there are any identical indicia from the set of indicia, and if so, whether the number of identical indicia exceeds the predetermined number. In a preferred embodiment, the identical indicia do not need to be connected or linked, but may appear anywhere in the set of displayed indicia.

In one embodiment, a bonus winning is paid if the outcome of the bonus game is a winning outcome. This bonus winning is separate from any winning paid based upon a winning outcome of the game of Link. In one embodiment, a player is entitled to play the game of Link regardless of whether the outcome of the game of Link is a winning outcome and without having to place a separate or additional bet or wager.

Further objects, features, and advantages of the present invention over the prior art will become apparent from the detailed description of the drawings which follows, when considered with the attached figures.

DESCRIPTION OF THE DRAWINGS

Figure 5:
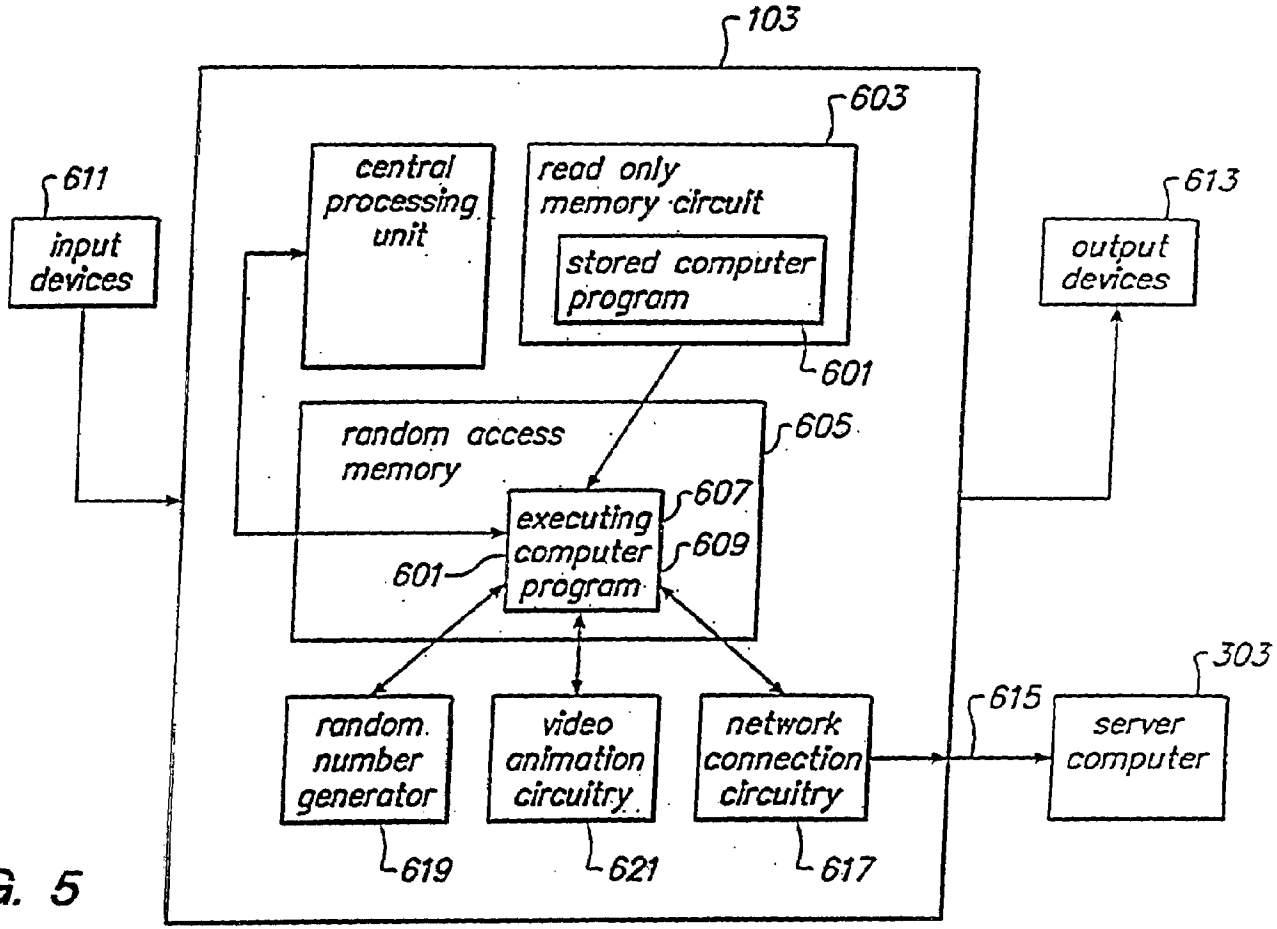
FIG. 5A is a diagram of a touch-sensitive display of a computer-controlled slot machine, in accordance with one embodiment of the gaming system of the present invention.
FIG. 5B is a diagram of a touch-sensitive display of a computer-controlled slot machine, in accordance with an alternative embodiment of the gaming system of the present invention.

FIG. 1 is a perspective view of a computer-controlled slot machine, in accordance with one embodiment of the gaming system of the present invention;

FIG. 2 is a perspective view of four computer-controlled slot machines assembled in a bar table according to another embodiment of the present invention for single or simultaneous multiple user play;

FIG. 3 is a block diagram of a local area network of computer-controlled slot machines, according to the present invention for progressive gaming activity;

FIG. 4 is a block diagram of a wide area network of computer-controlled slot machines, according to the present invention for progressive gaming activity;

FIG. 5 is a block diagram of the microprocessor-controlled computer and the computer program which facilitate game play according to one embodiment of the present invention; and FIG. 6 illustrates a display containing graphical information presented during the play of a game of the invention.

DETAILED DESCRIPTION OF THE INVENTION

The invention comprises methods and apparatus for presenting and playing a game. In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

One or more embodiments of the invention comprise a game in which one attempts to achieve one or more particular combinations of indicia. One or more embodiments of the invention comprise a game in which a player attempts to obtain indicia in a particular sequence or specific indicia linked or connected in one or more arrangements. These and other aspects of the invention will become apparent when considering the detailed description below.

In a preferred embodiment of the present invention, one or more games are presented for play on a computer-controlled slot machine, for example as shown in FIG. 1. The computer-controlled slot machine 101 includes a microprocessor-controlled computer 103 within a tamper proof and lockable cabinet 109 having a coin acceptor 111 for wagers and a bill validator 113 for wagers, and preferably including a touch-sensitive display 115 for player input and game display. In addition, the computer-controlled slot machine includes a sound speaker 117 for output of digital sound and voice simulations, a tower light 119 (not shown) to indicate jackpots and other game statistics, and a meter 121 to display progressive jackpot information and other text. The computer 103 controls release of coins to a coin hopper 123 for paying players, and controls a ticket printer 125 for generating vouchers. The computer 103 also controls a machine-readable medium reading and writing device 129 for saving and restoring games in progress.

An alternative embodiment of the computer-controlled slot machine is illustrated in FIG. 2. A "bar buddy" version of a computer-controlled slot machine 201 includes all of the features of the computer-controlled slot machine 101. Each "bar buddy" computer-controlled slot machine 201 contains four such computer-controlled slot machines 101, assembled within a bar table 203. Each of the four touch-sensitive displays 115 for player input and game display are mounted in the surface of the bar table 203. The bar buddy computer-controlled slot machine 201 enables from one to four players to play games of the invention simultaneously, either against each other or against the house. The various modes of game play are detailed below.

Each computer-controlled slot machine 101 is preferably connected to a local area computer network as illustrated in FIG. 3. The local area computer network 301 is controlled by a microprocessor-controlled server computer 303 which controls game play, records game statistics, accounts for vouchers and jackpots, and links the games together. The local area computer network 301 also preferably includes a progressive meter display 305 for showing progressive jackpot information, a flat rate award display 307 for showing flat rate jackpot information, and an additional display 309 for showing the scores that presently qualify for jackpots on the local area network 301. In the preferred embodiment of the present invention, all of the computer-controlled slot machines 101 are connected to the local area computer network 301 in conventional manner via private dedicated lines 311. In an alternative embodiment, some or all of the computer-controlled slot machines 101 positioned at remote locations are connected to the local area computer network 301 via modems and public telephone lines operated in secure mode through encryption/decryption techniques.

Each local area network 301 of computer-controlled slot machines 101 may be connected to a wide area computer network as illustrated in FIG. 4. The wide area computer network 401 includes local area computer networks 301 at various physical locations. The wide area computer network 401 is controlled by a central-site computer 403 which operates in 24-hour-a-day communication with all local area computer networks 301 on the wide area computer network 401 for security, accounting, and verification of games and jackpots. If a local area computer network 301 is connected to a wide area computer network 401, the progressive meter display 305, the flat rate award display 307, and the additional display 309 of that local area computer network 301 all display jackpot and other information pertaining to the entire wide area network 401. For example, the additional display 309 of a local area computer network 301 which is connected to a wide area computer network 401 shows scores that presently qualify for jackpots on the wide area network 401. In the preferred embodiment of the present invention, each local area computer network 301 is connected to the wide area computer network 401 in conventional secured cryptographic manner via private dedicated lines 311. In an alternative embodiment, some or all of the local area computer networks 301 are connected to the wide area computer network 401 in secured cryptographic manner via modems and public telephone lines.

In one embodiment the games of the invention may be presented on gaming devices which are linked by a satellite communication link. In one arrangement, a first local area computer network is connected to a second local area computer network via a satellite communication link which includes a transmitter/receiver at the location of the first network and a transmitter/receiver at the location of the second network. Data is transmitted from one location to the other via one or more satellites.

This communication network is particularly suited to an arrangement where one local area computer network is located in a first sovereign territory (such as Indian lands) and the second local area computer network is located in a second sovereign territory. In this communication network, the transmission of data can be completed between the first and second sovereign territories without the communication needing to pass through a third or other sovereign territory (ies). This may avoid the necessity of compliance with rules and regulations of the third or additional sovereign territory, simplifying the implementation of the game.

This communication arrangement using satellite links may be applied to games or gaming networks other than that described herein and other than those used to implement the one or more games described herein. For example, in one embodiment, the central site or main computer 403 or other host may be located in one of the sovereign territories, and gaming machines in the other sovereign territory may be linked via the satellite communication link, such as by a transmitter/receiver associated with a server computer 303 in that territory.

In a preferred embodiment of the present invention, the computer-controlled slot machine 101 includes a touch-sensitive display 115 for player input and game display. The touch-sensitive display 115 allows the player to make input selections conveniently, and displays game information in various ways, depending upon game state.

FIG. 5 illustrates the computer system that facilities game play. In one embodiment of the present invention, game play is facilitated by a computer program 601 executing in the microprocessor-controlled computer 103 within the computer-controlled slot machine 101. In the preferred embodiment of the present invention, the computer program is stored on a read-only memory integrated circuit 603 that is operatively coupled to the microprocessor-controlled computer 103 in the computer-controlled slot machine 101. Of course, in alternative embodiments, the computer program may be stored on various other storage media, such as semiconductor memory or optical or magnetic disk, or the like.

The computer program 601 executes from the random access memory 605 of the microprocessor-controlled computer 103 in the computer-controlled slot machine 101, and includes code 607 and data 609 to facilitate the play of the game in accordance with the game rules, as detailed below with respect to game play.

The computer program accepts user input from various user input devices 611 of the types previously described, including coin acceptor 111, bill validator 113, the touch-sensitive display 115, and the machine-readable medium reading and writing device 129. Other input devices including mechanical button type switches and lever-arm switch actuators may be used in alternative embodiments as desired.

The computer program also controls computer operation of the various output devices 613 such as the display 115, the sound speaker 117, a tower light 119, the meter 121, the coin hopper 123, the ticket printer 125, and the machine-readable medium reading and writing device 129.

Preferably, the computer program 601 also controls communication with the microprocessor-controlled server computer 303 which controls the local area computer network 301. The computer program 601 controls this communication via a network port 615 and network connectivity circuitry 617 contained within the microprocessor-controlled computer 103.

The computer program 601 utilizes a random number generator 619 to produce random numbers that represent the results of the simulated rolling of the simulated dice 543. The computer program 601 utilizes animation circuitry 621 to produce the simulation of dice on the display 115.

Utilizing a local area computer network 301 and a wide area computer network 401, multiple players may play a game against one another instead of "against the house." The same methodology can be utilized across a wide area computer network 401, allowing players at different physical locations to compete against each other in real time.

In a preferred embodiment of the invention, the process of game play of games played by more than one player is linked or commonly controlled. In one embodiment, a common controller controls the or governs the play of the multiple games. As one example, the common controller may comprise a server 303 such as illustrated in FIG. 3.

In one embodiment, the controller provides control information to two or more computer-controlled gaming machines (such as machines 101 in FIG. 3). The control information may comprise a control signal transmitted over a network (or other communication link) connecting the controller and the gaming machines, such as dedicated lines 311 as illustrated in FIG. 3.

In one or more embodiments, based on the control information, at least one or more events associated with or regarding the play of the games by the one or more players is dictated. In one embodiment, the one or more events comprise a game start, game stop or individual game play steps. In one or more embodiments, the aspect of these one or more events which is dictated comprises the timing of the event. The dictated timing may comprise a precise time or a time window or window by which an event must occur, as detailed below.

In one or more embodiments of the invention, the multiple players play against one another in an attempt to win a prize. The player who receives the highest total score for a particular game may be awarded a jackpot. Other criteria may be utilized for determining one or more winners of the multi-player game, such as lowest score or the highest three scores. In a preferred embodiment, a player is awarded winnings based on the outcome of their game, regardless of whether their result qualified them for winnings when compared to all other players.

In one embodiment other prizes may be awarded based on other criteria. For example, the player(s) who receives the highest score may be awarded a prize, such as money or bonus points towards their total score.

As one aspect of the invention, the order or sequence of the play of the game by a plurality of players is generally synchronized or otherwise controlled. In the embodiment just described, the timing of each step of the game as played by the players is controlled from a time perspective. It will be appreciated that only the play of the game broadly need be controlled from a time perspective. For example, the controller may define a window during which all players are entitled to a play an entire instance of the game.

As indicated, in one or more embodiments, the controller controls the time or time periods for certain activities to occur, such as a player input. One or more embodiments of the invention include a method and system for providing time information to a player. In an embodiment where a player is permitted a time period during which an activity must occur in order for the player to proceed or for the player's act/selection to occur, time period information may be displayed. The time period information may comprise numeric time information, graphical information or other forms of information recognizable by a player.

In one or more embodiments, audible or visible alarms or alerts may be provided to a player. For example, an area of the display may flash and indicate to a player that the player only has a short period of time remaining (such as 1 minute, 15 seconds or the like) to take action.

In one or more embodiments, when the player takes action, the time indicator may be removed or other information displayed to the player indicating that the player's action/selection has been accepted. In one or more embodiments, certain actions by a player may be rescinded and a new action/selection permitted. For example, a player may elect to rescind particular held dice and hold different dice, so long as such action occurs during the particular time period or by the time indicated.

In one or more embodiments, a method of game play is disclosed in which one or more aspects of game play must occur within a particular time period or before a certain time. If one or more of the acts or inputs are not provided within the required time, the player may be prevented from continuing further and completing the game.

Selections by a player, game state information and similar information is preferably forwarded from each gaming device or machine to the controller. In the event a player does not take the necessary action within the required time, then the controller may be adapted to send a signal to the gaming machine to cause the gaming machine to not accept input from the player for proceeding in game play. This same signal may cause the display of information to the player that the player did not act in sufficient time and that the player is not permitted to continue playing.

In one or more embodiments, a player's bet may be refunded if the player does not take action within the required time. For example, if a player places a bet but does not then spin the reels within the required time, the player's bet may be credited back or refunded. Preferably, the player's bet is not refunded if the player fails to provide input after one or more of the steps which define the outcome of the game occurs. For example, a player may not be entitled to a refund of their bet if after a spin of the dice the player does not hold one or more dice, as such may allow the player to take advantage of the casino/house by ceasing to act except where a favorable combination of dice are received on the first spin.

In one or more embodiments of the invention, the multiple gaming machines which are used to present the games to the multiple players may be located adjacent to one another or located remote from one another. For example, a plurality of gaming machines associated with a controller may be located in a particular room or rooms of a casino. On the other hand, the gaming machines may be associated with a local or wide area network allowing the gaming machines to be located remote from one another and/or the controller. For example, one or more of the gaming machines may be located in a first casino and other of the gaming machines located in an entirely different casino.

In one or more embodiments, the controller need not be entirely computer controlled. As one aspect of the invention, a human "caller" may be involved in the control of the multi-player game. The caller may provide information to players, such as instructions to take particular actions. The caller may also provide time information and generate or cause the generation of a control signal event. For example, the caller may cause the initiation of a time period via a computer or other device associated with the controller or providing input directly to the controller. The caller may provide an input to the controller causing the controller to start a period of time running or set a time by which an event is to occur. In this arrangement, the caller may provide gaps of time between events.

As one aspect of the invention, the caller may be provided with information regarding player activities, such as the total number of players and the number of players having made and/or not made a selection or engaged in the require activity. This information may be used by the caller to prompt players to take action or permit an extension of the time period for taking action.

A caller may be utilized even when the gaming machines are located remotely from one another. In one embodiment, the image of the caller may be transmitted to each player, such as by a separate communication channel and one or more displays which are visible to players of the gaming machines, or even by picture-in-picture display of the information to the player directly at the gaming machine. In one or more other embodiments, a caller may be utilized even though the caller is not present or visible to the player. For example, a caller may be used to controller the game play, such as starting and stopping time periods, which time periods are only indicated to a player.

The arrangement of the system including the one or more devices for implementing a method of multi-player game play in accordance with the invention may vary. As indicated, in one embodiment, a plurality of gaming machines or devices are associated with at least one controller via one or more communication pathways. In one embodiment, each gaming device may be provided with its own gaming controller, such as including a random number generator for generating game outcomes. The main controller may provide control information to each gaming machine, and each gaming machine may be arranged to generate (within the control of the main controller) the game information specific to that gaming machine, such as the outcome of a particular spin.

In another embodiment, all or substantially all of the game play information may be generated remotely from the gaming machine. For example, the controller including a random number generator for generating a plurality of game outcomes for the differing gaming machines. This game play information may then be transmitted to each particular gaming machine.

In one or more embodiments of the invention, information regarding each player's own game play, including prior game play, and others' game play may be presented. In one embodiment, information regarding a player's previous game play may be displayed.

In one or more embodiments, the multiple players may play against the house, such as a computer generated game result.

As used herein, the term "computer-controlled slot machine" denotes a computer controlled machine which facilitates wagering, which generally requires the input of money in order to be operated, and which outputs money in response to the achievement of winning wagering results. It will be appreciated that one or more aspects of the machine, including the interface or what is referred to herein as the touch sensitive display may be electrical, mechanical and/or electro-mechanical in nature. For example, while the buttons may comprise touch-sensitive areas of a display, they may comprise electro-mechanical buttons which are activated by mechanical movement (such as depression) by a player. In addition, simulated dice (as used in one embodiment of a game of Link described below) may, instead of comprising solely computer generated images, actually comprise dice or dice faces mounted on a rotating reel and arranged to stop in controlled positions. The simulated dice or other symbols may be provided in a variety of other manners, such as by laser light generation. The dice or other symbols are referred to in certain instances as "simulated," but could actually comprise faces of actual physical dice. The displays and display areas may comprise CRT type displays, LCD or LED displays or any other means for displaying information now known or later developed.

Of course, the present invention is not limited to the generation and display of images in the form of the video simulated dice. In other embodiments, other images are generated and displayed in the course of game play. For example, in one embodiment, the images generated and displayed are in the form of different colors. In another embodiment, graphical representations of different types of fruit are generated and displayed. In yet another embodiment, roman numerals are utilized. The generation and subsequent display of any image in a set of at least two display areas in the course of game play is within the scope of the present invention.

In one or more embodiments of the invention, such as illustrated in FIG. 5, a gaming machine in accordance with the invention may include a random number generator. The random number generator is adapted to produce random numbers which represent the outcome of the rolls of the dice or other symbols.

In another embodiment of the invention, permutations of roll outcomes are stored in a memory. One of the permutations is selected in order to determine the outcome of a roll. In one embodiment, the selection is random. In one embodiment, particular permutations may be removed depending on the status of the game.

In one embodiment, the indicia which are used to play the game may be located on wheels, reels or other elements. For example, the sides of a dice may be represented on a single flat disc. The wheels or reels may be rotated or moved to produce the random outcome.

In an embodiment where physical elements, such as physical dice or balls with dice indicia, are used to generate random indicia used in the game, the number of physical elements may vary.

A game in accordance with the invention will be described with reference to FIG. 6. This game is referred to herein as "Link." The game is preferably presented on an electronic gaming device such as that described above, which device includes a video display 1920. In other embodiments, the game may be presented as a reel or other type game. In general, in this game a player attempts to obtain a predetermined combination of indicia, either in sequence or in linked or connected relationship.

In accordance with the game, a player places a wager or bet in order to establish entitlement to play the game. As described below, the size of the bet may determine how the game is presented or how a winning result is determined.

In one embodiment, at least one row, or as illustrated in FIG. 6, at least a first column 1922 of dice indicia are displayed. The number of indicia which are displayed may vary. As detailed below, the number of indicia displayed may be dependent upon the size of the player's bet. The number of indicia are preferably at least two, and more preferably three or more. The dice indicia are preferably randomly selected, such as by generation with a random number generator where each number is associated with a particular dice side.

In one embodiment, then the player is a winner only if the player receives a predetermined combination of dice indicia in the first set or column 1922 of displayed indicia. In a preferred embodiment, winning combinations of dice indicia comprise two or more of the same dice indicia in adjacent displayed positions. In one embodiment, a player is awarded a winning, such as a payout, based upon the amount bet.

In accordance with one embodiment of the invention, additional rows or columns of dice indicia are displayed. In one embodiment, a first column 1922 of dice indicia is displayed based on a bet of a first amount, and an additional column or columns are displayed based upon larger amounts bet. In one embodiment, two additional columns 1924,1926 of dice indicia, for a total of three columns, are displayed based upon a second bet. Likewise, two additional columns 1928,1930 of dice indicia, for a total of five columns, are displayed based upon a third bet. Lastly, two additional columns 1932,1934 of dice indicia, for a total or seven columns for a fourth bet, and two additional columns 1936,1938, for a total of nine columns, for a fifth bet.

In this arrangement, a maximum bet results in a total of 9 (nine) columns of dice indicia being displayed. When the number of dice indicia per column is 9 as illustrated, then the result is a matrix which is 9 by 9, for a total of 81 dice indicia. Of course, the matrix may have a variety of sizes, such as n x m where n and/or m are as few as 1 or greater than 9. Further, a greater or lesser number of dice indicia may be displayed in the possible indicia positions of the matrix.

Preferably, a matrix of indicia where n and m are both 2 or greater is displayed in response to a single bet. In an embodiment where either n or m is 1, the game preferably proceeds in accordance with the embodiment described below wherein indicia are displayed sequentially, rather than in a matrix form.

In one embodiment, the dice indicia may be displayed in rows instead of columns. For example, upon placing a first bet, a first row of dice indicia may be displayed. Upon placing a larger bet, an additional row or rows of dice indicia may be displayed.

In one embodiment, a player is declared a winner as to one or more predetermined combinations of dice indicia which are achievable with the dice indicia which are displayed. In one embodiment, the combination of dice indicia may be generated not only from indicia located in the same row or column, but in joined or linked rows or columns. In one embodiment, winning combinations of dice indicia may be achieved from associated dice indicia. By "associated" it is meant located in an adjacent position (i.e. to the top, bottom, side, or corner) to an indicia.

In one embodiment, a winning result may be declared if a plurality of the same dice indicia appear in a horizontal row. In one embodiment, a winning result may be declared if a plurality of the same dice indicia appear in a vertical column. In one embodiment, a winning result may be declared if a plurality of the same dice indicia appear in a diagonal line. In one embodiment, a winning result may be declared if a plurality of the same dice indicia are associated or connected in any pattern. In one embodiment, a winning result may be declared if a plurality of the same dice indicia are associated or connected in a predetermined pattern. In one embodiment, a winning result may be declared if the plurality of dice appear in one or more of the above-described manners, such as horizontally, vertically or diagonally.

FIG. 6 illustrates an example in which a combination of dice indicia is declared a winning combination if the dice indicia are the same and are linked or associated in any manner.

In one embodiment, a player may be declared a winner for receiving a predetermined number of linked or associated identical indicia, such as 2 or 3 linked indicia. In other embodiments, the result may not be a winning result unless 4 or more of the same indicia are linked.

Winnings may be paid for winning combinations. The winnings paid may comprise the number of linked indicia multiplied by the largest bet (such as coin) for any column in which one of the dice indicia lies. For example, in the embodiment illustrated, five dice indicia bearing the number 5 (five) are linked in rows eight and nine. The last of these dice indicia is located in column 1934 which was displayed as a result of the fourth bet or coin. As such, the total winning is 5 (indicia) multiplied by 4 (highest bet), or 20 coins. In another embodiment, a payout table may be provided which dictates fixed amounts for combinations of indicia.

In another embodiment, a predetermined amount may be paid for combinations of indicia, such as a certain amount for 2 linked indicia, 3 linked indicia or the like. Preferably, the winnings increase as the total number of linked indicia increases. Jackpot winnings may be awarded for receiving a high number of associated indicia, such as 9 or more. The jackpot may be funded from a portion of each player's bet which is set aside in a jackpot fund.

The winnings paid may also depend on the arrangement of the linked indicia. For example, if the linked indicia are all in the same row or column, than a larger winning may be awarded than if the linked indicia are in another arrangement. A particular winning may be awarded if the linked indicia are along a diagonal line.

In another embodiment, a player is declared a winner for receiving a particular pattern of related dice indicia. One such pattern is a string of the same dice indicia which extends in uninterrupted fashion from the first column to the last column of the matrix. In this embodiment, if a sequence of the same indicia are linked from the first column 1922 to the last column 1938, then the result may be declared a winning outcome. In one embodiment, the linked indicia may be located in any row. In another embodiment, a winning outcome may be declared if the indicia are all located in the same row and extend from the first to the last column. In one embodiment, this winning outcome is only declared if the player has placed the maximum bet and the indicia link across all columns. In another embodiment, a winning outcome may be declared if the same indicia are linked across multiple columns, even if the maximum bet is not placed. Of course, the amount awarded preferably increases as the likelihood of obtaining the outcome decreases.

Another pattern may be that where a string of the same dice indicia extends in linked fashion from the top to the bottom of the matrix. Another pattern may be where the same dice indicia extend along the diagonals of the matrix or are otherwise linked from corner to corner.

A player may also be paid winnings if a particular indicia appears anywhere more than a predetermined number of times. For example, in the case of the 9×9 matrix illustrated in FIG. 6, a player may be paid a winning if any particular indicia appears more than 15 times. The greater the number of occurrences of the indicia above the minimum, the larger the amount which may be awarded.

In one embodiment, the game may include the step of providing a visual indication of the winning combinations of indicia. For example, linked or connected indicia may be highlighted, as illustrated in FIG. 6. In one embodiment, highlighting of a first color is used to identify a first set of linked indicia, and highlighting of a second color to identify a second set, and so on.

As illustrated in FIG. 6, information other than the displayed indicia may be provided to the player. For example, information regarding the number of credits or other monies or awards belonging to the player may be displayed. Information may also be provided regarding the number of lines and rows of indicia displayed or wagered.

A variety of betting options may be presented which affect the way the game is played or the way winnings results are determined. As indicated, in one embodiment, a player may be required to place incrementally larger bets in order to have additional columns or rows of playable indicia displayed. For example, a single column or row may be displayed upon placing a bet of a first amount, and one or more additional columns or rows may be displayed if the player places a bet of a second amount larger than the first amount. The amounts may be incrementally larger than one another, such as by denomination (i.e. $.25, $.50, .$75 or $1.00, $2.00, $3.00, etc.).

In another embodiment, all indicia are displayed if a player places a required minimum bet, and winning combinations are determined and winnings paid. However, if the player places a second, larger bet, then the winnings paid for winning combinations are, for one or more winning combinations, larger than the amounts paid if the player places only the minimum bet.

As one variation of the game, the "ways" by which the combinations of dice indicia are determined to be winning combinations may depend upon the size of the bet. For example, if a player places only a first bet, the entire matrix of indicia are displayed, but only vertical (i.e. in column) combinations of dice may be eligible to be declared winning. If a player places a bet of a second, larger amount, then all vertical and horizontal (i.e. in row) combinations may be eligible. Upon placing larger bets, diagonal and any associated indicia combinations may be added.

In accordance with another embodiment of the game of Link, a player may attempt to obtain a particular sequence of indicia. In one embodiment, this game may comprise the above-described game wherein the indicia are displayed in a single row or column (i.e. n or m equals 1).

In one embodiment of the invention, the game involves the sequential display of dice indicia. In this embodiment, a player places a first bet and preferably, two dice indicia are displayed. If the dice indicia are the same, then the player is a winner of a first award. The player may elect to end the game and receive the first award. Alternatively, the player is entitled to place an additional bet, upon which a third or next dice indicia is displayed. If the next dice indicia is the same as the first two, then the player is the winner of a second award. This award will generally be larger than the first award as a result of the lower odds or receiving the indicia combination. If the third indicia is not the same as the first two, then the outcome of the game is a losing outcome.

In one embodiment, a player may be permitted to continue placing additional bets and display indicia until a predetermined maximum number of dice indicia are displayed. If the player reaches that predetermined maximum and all of the dice indicia are the same, then the player may receive a particularly large winning, such as a jackpot winning.

In this embodiment, the dice indicia are preferably displayed sequentially in a single row, column or other line. In one embodiment, dice indicia locations may be displayed, and the number of locations displayed may be dependent on the size of the player's bet. Once the bet is placed and the locations displayed, the player may touch the first location to initiate a simulated dice roll. Thereafter, the player may sequentially touch each additional dice location to effectuate the simulated spin.

As a variation to this embodiment of the invention, a player places a bet to start the game. At least a two (i.e. a first and second) indicia are displayed. If they are the different, the game ends. If they are the same, then the player is placed an additional bet or wager to have at least one additional indicia displayed. The game continues as described above, with the game ending if the combination of displayed indicia do not match or otherwise comprise a predetermined combination of indicia, and permissibly continuing if the player elects.

In another variations or embodiments of the game of Link, a matrix of indicia positions, such as blank circles or boxes, is displayed. A player is permitted to select one or more indicia to be displayed based upon one or more wagers. For example, a player may be permitted to have a single indicia displayed for each bet placed. The player attempts to select positions which result in the display of indicia resulting in a predetermined combination of winning indicia.

As an example of this embodiment invention, a matrix of 9 by 9 possible indicia locations may be displayed. A player places a first bet and is entitled to select one of the locations. The indicia at that location is displayed. The player is entitled to place a second bet and then select a second location and have the indicia displayed at that location, and so on. If the player receives a predetermined combination of indicia as a result of the player's selections, then the player may be declared a winner of the event. In this embodiment, a player may be declared a winner of a first winning amount after a certain combination of indicia have been displayed. The player may, however, continue to place additional bets and make additional selections in an attempt to receive a winning outcome which results in a higher reward. For example, a player may receive the same indicia for three selections along a row of the matrix and be entitled to a reward of a first amount. The player may place an additional bet and select the next space. If the same indicia is displayed, resulting in four of the same indicia being displayed in sequence, the player may be entitled to larger award. In another embodiment, upon placing a bet of a first amount, a player may be permitted to make a certain number of selections. If the player places a larger bet of a second amount, the player may be permitted to make a larger number of selections.

The indicia may be displayed in a variety of manners. In an embodiment where the indicia comprise the images of the sides of dice, simulated dice may spin or roll and stop in one position. In another embodiment, a plurality of mechanical reels may be provided, the one or more reels displaying all or some of the indicia. The player may spin the first reel or reels, and spin additional reels based on the size of the bet.

In another arrangement, a player may use a "scratch" card having a number of indicia hidden under a removable covering. The player may attempt to scratch off or remove the covering from one or more of the indicia in an attempt to receive a particular combination of indicia.

In one embodiment, a row, column, matrix or other arrangement of indicia positions may be provided. A player may "throw" (in simulated video fashion, or in a mechanical fashion as described above) a set of dice. The result of the throw may be posted to the row or column of the matrix. The player may then "throw" the dice additional times to post dice indicia to the additional rows or columns as described above, such as upon wagers or bets placed.

In one or more embodiments of the invention, the games described above may be played with dice or simulated dice having more than 6 sides. For example, dice having 9 sides may be used, or dice having 12 sides may be used. Such dice may be provided with dots representing the values 1-9, the actual numerical values 1-9, or even include traditional dice indicia as well as other indica, such as wild card symbols or letters.

The use of one or more of such dice has the advantage that a number of additional combinations of dice indicia are provided, and the odds of receiving certain combinations or outcomes change. For example, in the event the 9 sided dice are utilized, the probability of obtaining a sequence of six matching indicia in six successive rolls or spins is much less than if 6 sided dice are utilized (in this case, approximately 10 times less likely).

It will be appreciated that the indicia which are displayed for use in playing the game need not be arranged in a matrix as illustrated in FIG. 6. For example, the number of indicia or indicia positions per row and per column need not be the same for every row and every column. For example, the indicia positions may be arranged in a pyramid format with a greater number of indicia in one row at the bottom than at a row at the top. The indicia positions may also be arranged in a square or other design.

The game of Link may be played with indicia other than dice indicia. For example, the indicia utilized may comprise pictures of different animals or of different fruit. The number of indicia in the set of indicia utilized may vary, thus varying the odds of receiving a particular indicia. For example, in the case of a six-sided dice, there are six different possible indicia. A set of animal indicia may be utilized, however, including pictures of 10 different animals. In the latter case, the odds of receiving any particular indicia are reduced. In one embodiment, the "set" of indicia utilized need not include the same number of each indicia. For example, there may be only two "lion" indicia, but ten "jaguar" indicia. Winning paid may be greater for linking the less common indicia.

In one or more embodiments of the invention, a bonus game or event is associated with the above-described game of Link. In accordance with the bonus game or event, a player is awarded a bonus or winning for receiving a predetermined number of identical indicia. Preferably, the indicia which are utilized to determine the outcome of this bonus game or event are the same indicia which are displayed while playing the underlying game of Link.

In one embodiment, the bonus event/game comprises the display of a plurality of indicia. In one embodiment, the indicia are selected from a group of indicia. In the embodiment described below where the bonus game is based upon the game of Link, the set of indicia are displayed by rolling real or simulated dice, with each indicia selected from the sides of a die.

A player is a winner of the bonus game if the player receives a predetermined minimum number of identical indicia. In one embodiment, the predetermined number of identical indicia is half of the displayed indicia or more. It will be appreciated that the predetermined number of identical indicia may be any number between two and the total number of indicia displayed.

In accordance with the bonus game or event, if the predetermined number of identical indicia (i.e. in one embodiment 8 dice having the same number of pips) are displayed, the outcome of the bonus game or event is declared a winning outcome and a bonus award is awarded to the player. In a preferred embodiment, the amount of the bonus award increases for each number of identical indicia that the player receives in excess/above the predetermined number of identical indicia. The bonus award is preferably independent of any winnings or awards based upon play of the underlying game, such as winnings paid based upon the outcome of the underlying game of Link.

In a preferred embodiment, the identical indicia do not have to be linked/connected or in any other way associated with each other as required in the underlying game of Link. However, in another embodiment only those identical indicia that are linked may be used to determine the number of identical indicia displayed to the player of the bonus game.

In a preferred embodiment, the matrix containing the indicia that is displayed to a player used to play the game of Link is simultaneously used to play the bonus game. In this embodiment, the same dice indicia that are displayed to the player in the underlying Link game are also used to determine the total number of identical indicia in the bonus game. The outcome of the bonus event may then be based on the identical indicia which are different from the indicia in the game of Link that determine the outcome of such.

In another embodiment, after play of the underlying game of Link, a new matrix or other set of new indicia may be displayed to the player for play of the bonus game. In this embodiment, the number of indicia displayed to the player may be the same as or different (i.e. more or less) than the number of indicia displayed in the underlying game of Link. Further, the type of indicia displayed may be different from those indicia displayed in the underlying game.

In one or more embodiments, in order for a player to be a winner of the bonus game, the player does not have to be a winner of the underlying game of Link. In a preferred embodiment, the bonus game is an automatically occurring event for having played the underlying game. However, in another embodiment, a player must qualify to partake in the bonus game. For example, in one embodiment, in order for the player to be entitled to participate in the bonus game, the player must be determined to be a winner of the underlying game of Link. In another embodiment, the qualifying event consists of obtaining a predetermined number of linked indicia during play of the underlying game.

In a preferred embodiment, the wager placed for play of the underlying game entitles the player to play the bonus game. In another embodiment the player must place a separate wager or bet in order to establish entitlement to play the bonus game.

It will be appreciated that in some instances depending on the number of indicia displayed and the number of identical indicia required to be a winner of the bonus game, multiple identical indicia for different indicia (i.e.8 threes and 8 twos) may be displayed to a player. In one or more embodiments the player may receive a bonus award for both winning events. In another embodiment only one bonus award is awarded. In another embodiment, a bonus award is only awarded for the single largest group of identical indicia.

In a preferred embodiment, a winning/bonus award is paid for obtaining a predetermined number of identical indicia. In one or more embodiments the bonus award is based on the amount of the wager.

In one embodiment, a visual indication is provided for identifying the identical indicia displayed. Preferably, only those identical indica that are winning combinations are visually identified. For example, the identical indicia may be highlighted. In instances where more than one set of winning identical indica are displayed, each may be highlighted in a different color.

In a preferred embodiment, the game is referred to as a bonus game or event for the reason that the game is presented to the player without the requirement of placing an additional bet or wager aside from the bet or wager placed to play the underlying game. In other embodiment, the bonus game or event may only be played if an additional bet or wager is presented and the player elects to play the base or underlying game.

In another embodiment of the invention, the bonus game or event may be played as a completely independent game. The game is preferably presented on an electronic gaming device such as that described above, which device includes a video display. In other embodiments, the game may be presented as a reel or other type game. In general, in this game a player attempts to obtain a predetermined number of identical indicia.

In accordance with this embodiment of the game, a player places a wager or bet in order to establish entitlement to play the game. Upon the player placing the required wager or bet, a predetermined number of indica are displayed to the player.

In a preferred embodiment, at least one row and one column of indicia are displayed. The number of indicia that are displayed may vary. In one or more embodiments the number of indicia displayed may be dependent on the amount of the wager. The indicia are preferably randomly selected, such as by generation with a random number generator where each number is associated with a particular dice side. In another embodiment, an entire matrix or other group of indicia are displayed so long as the minimum required bet is placed. In one embodiment, amounts bet over the required minimum simply change the amounts awarded if the outcome is a winning outcome.

The indicia may be displayed in various manners. As indicated, the display may be by electronic presentation, the spinning of reels, or even the throw or roll of actual dice.

In a preferred embodiment, similar to play as a bonus game, a player is a winner only if the player receives a predetermined number of identical indicia from the group or set of displayed indicia. In a preferred embodiment, winning combinations of indicia comprise two or more of the same indicia displayed anywhere. If the player receives a predetermined minimum number of the same indicia in the set of display indicia, the outcome of the game may be declared a winning outcome and the player paid an award or winning.

It will be understood that the above described arrangements of apparatus and the method therefrom are merely illustrative of applications of the principles of this invention and many other embodiments and modifications may be made without departing from the spirit and scope of the invention as defined in the claims.

I claim:

1. A method of playing a game comprising the steps of:

providing a matrix comprising m rows by n columns of possible indicia positions, where n and m are at least 2;

accepting a wager;

displaying indicia in each of said indicia positions of said matrix, said indicia displayed in each of said positions randomly selected from a group of indicia and having the possibility of being the same or different from indicia displayed in other positions of said matrix;

identifying each grouping of three or more identical indicia located anywhere in said matrix;

declaring as a winning combination each identified grouping where the indicia are in linked positions;

declaring as a non-winning combination any identified grouping where the indicia are not in linked positions; and awarding a winning if at least one winning combination of indicia is received.

2. The method in accordance with claim 1 including the step of displaying indicia in a first plurality of rows and columns in response to a wager of a first size and displaying indicia in a second plurality of rows and columns greater than said first plurality of rows and columns in response to a wager of a second size greater than said first size.

3. The method in accordance with claim 1 including the step of displaying a visible element connecting the indicia forming each winning combination of indicia.

4. The method in accordance with claim 3 wherein said visible element comprises a bar extending between positions containing said indicia.

5. A method of playing a game comprising the steps of:

providing a matrix comprising m rows by n columns of possible indicia positions, where n and m are at least 2;

accepting a wager;

displaying indicia in each of said indicia positions of said matrix, said indicia displayed in each of said positions randomly selected from a group of indicia and having the possibility of being the same or different from indicia displayed in other positions of said matrix;

identifying occurrences of three or more of the same indicia located anywhere in said matrix;

identifying as winning groupings only said linked sets;

declaring as losing any identified occurrences where the indicia are not in linked positions; and awarding winnings for said winning groupings.

6. The method in accordance with claim 5 including the step of displaying one or more elements connecting the displayed indicia of each identified winning grouping after said groupings have been identified.

* * * * *